US008012668B2

(12) United States Patent
Aoshima et al.

(10) Patent No.: US 8,012,668 B2
(45) Date of Patent: Sep. 6, 2011

(54) PLANOGRAPHIC PRINTING PLATE PRECURSOR

(75) Inventors: Toshihide Aoshima, Haibara-gun (JP); Toyohisa Oya, Haibara-gun (JP)

(73) Assignee: FUJIFILM Corporation, Tokyo (JP)

( * ) Notice: Subject to any disclaimer, the term of this patent is extended or adjusted under 35 U.S.C. 154(b) by 663 days.

(21) Appl. No.: 12/025,870

(22) Filed: Feb. 5, 2008

(65) Prior Publication Data

US 2008/0206675 A1 Aug. 28, 2008

(30) Foreign Application Priority Data

Feb. 28, 2007 (JP) ..... 2007-050393

(51) Int. Cl.
*G03C 1/00* (2006.01)

(52) U.S. Cl. ..... 430/270.1

(58) Field of Classification Search ..... 430/270.1, 430/281.1, 271.1, 272.1, 302; 101/450.1
See application file for complete search history.

(56) References Cited

U.S. PATENT DOCUMENTS 7,351,513 B2 * 4/2008 Yamasaki et al. ..... 430/138

FOREIGN PATENT DOCUMENTS

| | | | |
|---|---|---|---|
| JP | 7-1853 | A | 1/1995 |
| JP | 8-272087 | A | 10/1996 |
| JP | 8-292558 | A | 11/1996 |

* cited by examiner

*Primary Examiner* — Cynthia H Kelly
*Assistant Examiner* — Chanceity Robinson
(74) *Attorney, Agent, or Firm* — Sughrue Mion, PLLC

(57) ABSTRACT

A planographic printing plate precursor including: a support; a hydrophilic layer including a hydrophilic polymer chemically bonded to a surface of the support, where the hydrophilic polymer has a positively-charged substituent and at least one reactive group selected from the group consisting of a reactive group capable of directly chemically bonding to a surface of the support and a reactive group capable of chemically bonding to a surface of the support via a crosslinked structure; and an image forming layer, wherein the hydrophilic layer and the image forming layer are provided in that order on the support.

7 Claims, No Drawings

PLANOGRAPHIC PRINTING PLATE PRECURSOR

CROSS-REFERENCE TO RELATED APPLICATION

This Application claims priority under 35 USC 119 from Japanese Patent Application No. 2007-050393, the disclosure of which is incorporated by reference herein.

BACKGROUND OF THE INVENTION

1. Technical Field

The present invention relates to a planographic printing plate precursor.

2. Background Art

Planographic printing is a method of printing using plate material having ink-receiving lipophilic regions and ink-repellent regions (hydrophilic regions) that do not receive ink but receive dampening water. Photosensitive planographic printing plate precursors (PS plates) are currently widely used. In practice, for such PS plates, PS plates are widely used that include a support, such as an aluminum plate, and a photosensitive layer provided on the support. Such PS plates are exposed imagewise and developed, thereby removing the photosensitive layer in non-image portions, and printing is performed utilizing the hydrophilicity of the substrate surface and the lipophilicity of the photosensitive layer in image portions. Highly hydrophilic properties are required of the substrate surface in order to prevent the non-image portions from being stained.

Conventionally, anodized aluminum substrates, or anodized aluminum substrates which have been subjected to silicate treatment in order to further increase the hydrophilicity thereof, have been typically used as the hydrophilic substrate or as the hydrophilic layer employed in planographic printing plates. Much research into hydrophilic substrates and hydrophilic layers employing such aluminum supports has been carried out. Techniques that use polymers are known where a substrate is processed with an undercoating agent including polyvinylphosphonic acid, or a polymer having a sulfonic acid group is used as an undercoat layer below a photosensitive layer. In addition, there are also proposals for the use of polyvinylbenzoic acid or the like as an undercoating agent.

Further, there are proposals regarding hydrophilic layers where a flexible support such as PET (polyethylene terephthalate) or cellulose acetate is used rather than a metal support such as aluminum. For example: Japanese Patent Application Laid-Open (JP-A) No. 8-272087 discloses a technique in which a hydrophilic layer including a polymer, which is cured with hydrolyzed tetraalkyl orthosilicate, is provided on a PET support; JP-A No. 8-292558 discloses a technique of providing a hydrophilic layer which has a phase separation structure having two phases, including a phase with a hydrophilic polymer as a main component and a phase with a hydrophobic polymer as a main component; and JP-A No. 7-1853 discloses a hydrophilic layer including a copolymer of vinylphosphonic acid and acrylamide provided on an aluminum support. In addition, there are techniques proposed which use polyvinylbenzoic acid or the like as an undercoating agent.

Such hydrophilic layers exhibit better hydrophilic properties than those conventionally used, thereby providing planographic printing plates with which prints with no stains can be obtained when printing is initiated. However, there is the problem that such layers tend to peel off during the course of repeated printing and their hydrophilic properties tend to deteriorate over time. There is thus a demand for planographic printing plate precursors with which many prints can be obtained with no staining, and without causing the hydrophilic layer to peel from the support and without deterioration in the surface hydrophilic properties, even under more severe printing conditions. There is also a demand for further improved hydrophilicity and improved printing durability by the adhesiveness between image portions and a support (hydrophilic layer), from a practical perspective.

SUMMARY OF THE INVENTION

The present invention has been made in view of the above circumstances and provides a planographic printing plate precursor.

According to an aspect of the present invention, there is provided a planographic printing plate precursor including a support; a hydrophilic layer including a hydrophilic polymer chemically bonded to a surface of the support, where the hydrophilic polymer has a positively-charged substituent and at least one reactive group selected from the group consisting of a reactive group capable of directly chemically bonding to a surface of the support and a reactive group capable of chemically bonding to a surface of the support via a crosslinked structure; and an image forming layer, wherein the hydrophilic layer and the image forming layer are provided in that order on the support.

DETAILED DESCRIPTION OF THE INVENTION

The present inventors have found that the aforementioned objects can be achieved by providing a hydrophilic layer, which is formed by chemically bonding a hydrophilic polymer having a specific reactive group and a positively-charged substituent, on a support surface, and thus completed the invention.

That is, the invention includes the following constitutions.

The planographic printing plate precursor of the invention includes a support; a hydrophilic layer including a hydrophilic polymer chemically bonded to a surface of the support, where the hydrophilic polymer has a positively-charged substituent and at least one reactive group selected from a reactive group capable of directly chemically bonding to a surface of the support and a reactive group capable of chemically bonding to a surface of the support via a crosslinked structure; and an image forming layer, wherein the hydrophilic layer and the image forming layer are provided in that order on the support.

It is preferable that the hydrophilic polymer has the reactive group on a terminal thereof It is more preferable that the hydrophilic polymer includes a structural unit (i) and a structural unit (ii) of the following Formula (1):

Formula (1)

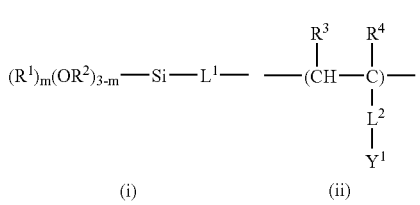

Formula (1) represents a polymer having a silane coupling group represented by the structural unit (i) on an end of a polymer unit represented by the structural unit (ii). In Formula (1), $R^1$, $R^2$, $R^3$, and $R^4$ each independently represents a hydrogen atom or a substituent having 1 to 30 carbon atoms; m represents 0, 1, or 2; $L^1$ and $L^2$ each independently represents a single bond or an organic linking group; and $Y^1$ represents a positively-charged substituent.

Herein, $Y^1$ in Formula (1) is preferably an ammonio group, a substituted ammonio group, a phosphonio group, or a substituted phosphonio group.

It is preferable that the hydrophilic polymer includes a structural unit (iii) and a structural unit (iv) of the following Formula (2):

Formula (2)

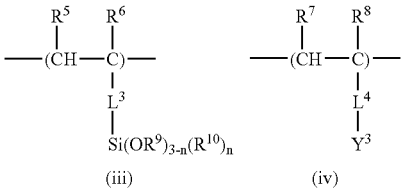

In Formula (2), $R^5$, $R^6$, $R^7$, $R^8$, $R^9$, and $R^{10}$ each independently represents a hydrogen atom or a substituent having 1 to 30 carbon atoms; n represents 0, 1, or 2; $L^3$ and $L^4$ each independently represents a single bond or an organic linking group; and $Y^3$ represents a positively-charged substituent.

Herein, $Y^3$ in Formula (2) is preferably an ammonio group, a substituted ammonio group, a phosphonio group, or a substituted phosphonio group.

For the planographic printing plate precursor of the invention, it is preferable that the support is an aluminum support, and more preferable that the purity of aluminum in the aluminum support is in the range of 95 to 99.4 mol %.

It is also preferable that the aluminum support contains 0.3 to 1 mass % of Fe, 0.15 to 1 mass % of Si, 0.1 to 1 mass % of Cu, 0.1 to 1.5 mass % of Mg, 0.1 to 1.5 mass % of Mn, 0.1 to 1.5 mass % of Zn, 0.01 to 0.1 mass % of Cr, 0.01 to 0.5 mass % of Ti, and 95 to 99.4 mass % of Al.

The mode of action of the invention is not clear, but it is assumed that since the hydrophilic polymer forming a hydrophilic layer includes, in a molecule thereof, a reactive group capable of either directly chemically boning to a surface of the support or chemically bonding via a crosslinked structure, thereby allowing the polymer to firmly bond with a functional group such as —$Al^{3+}$ or —OH present on a surface of the support, adhesiveness between a hydrophilic layer formed by the polymer and a support and durability thereof are improved.

The hydrophilic layer exhibits an excellent hydrophilic property which is derived from a positively-charged substituent in a hydrophilic polymer of the hydrophilic layer. In consequent, it is believed that excellent hydrophilicity can be provided on a surface of the support without being limited by the material of the support. It is also believed that, in an embodiment of the invention, further improved hydrophilicity can be obtained by using a hydrophilic polymer having a reactive group on a terminal thereof because one end of this polymer firmly bonds to the support surface while the other end of the polymer remaining in a relatively free state, thereby providing an excellent polymer mobility.

Further, it is believed that an electrostatic interaction formed between a positive charge in the hydrophilic polymer and the image forming layer results in improved adhesiveness between the hydrophilic layer and the image forming layer.

Planograhic Printing Plate Precursor

The planographic printing plate precursor of the invention includes a support; a hydrophilic layer which is formed by chemically bonding a hydrophilic polymer to a surface of the support, where the hydrophilic polymer has a positively-charged substituent and at least one reactive group selected from a reactive group capable of directly chemically bonding to a surface of the support and a reactive group capable of chemically bonding to a surface of the support via a crosslinked structure; and an image forming layer, wherein the hydrophilic layer and the image forming layer are provided in that order on the support.

Herein, the term 'the hydrophilic layer and the image forming layer are provided in that order on the support' means that the hydrophilic layer and the image forming layer are stacked in the said order on the support, and the description is not limiting the presence of any other known layers such as a back coat layer, an undercoat layer, and an overcoat layer, that may be optionally provided.

Hereinbelow, constitutions of the support, the hydrophilic layer, and the image forming layer will be described in the order.

Support

The support used for the planographic printing plate precursor of the invention is not particularly limited as long as it is a tabular substrate having good dimensional stability that satisfies required strength, durability, flexibility, and the like. Examples thereof include paper, paper laminated with plastic (e.g., polyethylene, polypropylene, polystyrene, etc.), metal sheets (e.g., aluminium, zinc, copper, etc.), plastic films (e.g., cellulose diacetate, cellulose triacetate, cellulose propionate, cellulose acetate propionate, cellulose butyrate, cellulose acetate butyrate, cellulose nitrate, polyethylene terephthalate, polyethylene, polystyrene, polypropylene, polycarbonate, polyvinylacetal, polyimide, etc.), the aforementioned metal-laminated or -deposited papers and plastic films, and the like.

Among these, the support for the invention is preferably a polyester film or an aluminum plate, and particularly preferably an aluminum plate since it has a good dimensional stability and is relatively inexpensive.

Preferably, the aluminium plate for use in the invention may be an alloy plate including mainly aluminum and trace amount of hetero elements. Alternatively, the aluminum plate may be aluminum-laminated or -deposited plastic film. Examples of the hetero elements that may be included in the aluminium alloy include silicon, iron, manganese, copper, magnesium, chromium, zinc, bismuth, nickel, titanium, and the like. The total content of the hetero elements in the alloy is preferably 5 mass % at most. In the present invention, pure aluminum is particularly preferable. However, since it is difficult to produce 100% pure aluminum in view of the smelting technology, aluminum containing trace amount of hetero elements may be used for the support. The aluminum plate used for the invention is not particularly limited in its composition, and any known aluminium plate generally used in the art may be suitably used herein. The thickness of the aluminium plate for use in the invention may be approximately from 0.1 mm to 0.6 mm, preferably 0.15 mm to 0.4 mm, and more preferably 0.2 mm to 0.3 mm.

Aluminum Plate

The aluminum plate for use in the invention will be explained.

The composition of the aluminum material for use in the aluminum plate may be any known ones. For example, relatively low purity aluminum substrates in which the aluminum content is in the range of 99.4 to 95 mass % may be also preferably used, as well as a high purity aluminum substrate used in general purposes.

Accordingly, materials hardly used in high-quality printing, such as aluminum materials obtained by rolling used beverage can (UBC) metals or materials prepared by mixing UBC metals with other aluminum metals in an arbitrarily ratio, may be also preferably used for the support in the invention.

General examples of the hetero elements that may be included in the aluminium plate include silicon, iron, copper, titanium, gallium, vanadium, zinc, chromium, zirconium, barium, cobalt, and the like. The content of the hetero element in the alloy is 5 mass % or less.

Examples of the inevitable impurities included in the aluminum alloy include lead, nickel, tin, indium, boron, and the like.

With respect to the hetero elements included in the aluminum plate and contents thereof, the aluminum plate preferably includes 0.3 to 1 mass % of Fe, 0.15 to 1 mass % of Si, 0.1 to 1 mass % of Cu, 0.1 to 1.5 mass % of Mg, 0.1 to 1.5 mass % of Mn, 0.1 to 1.5 mass % of Zn, 0.01 to 0.1 mass % of Cr, and 0.01 to 0.5 mass % of Ti; and more preferably includes more than 0.30 to 0.70 mass % of Fe, 0.20 to 0.50 mass % of Si, 0.10 to 0.50 mass % of Cu, 0.02 to 0.3 mass % of Ti, 0.50 to 1.5 mass % of Mg, 0.1 to 1.3 mass % of Mn, 0.01 to 0.08 mass % of Cr, and 0.1 to 1.3 mass % of Zn. In addition, inevitable impurities may also be included therein, but it is preferable that the aluminum content is at least 95 mass %, and those having the aluminium content of 95 to 99.4 mass % are preferably used.

Particularly preferably, aluminum plates includes more than 0.40 to 0.50 mass % of Fe, more than 0.25 to 0.30 mass % of Si, 0.10 to 0.15 mass % of Cu, 0.02 to 0.05 mass % of Ti, 0.80 to 1.5 mass % of Mg, 0.10 to 1.00 mass % of Mn, 0.01 to 0.05 mass % of Cr, 0.1 to 0.3 mass % of Zn, and the remainder containing 95 to 99.4 mass % of Al and inevitable impurities.

The hetero element in the aluminum plate has a large effect on uniformity of pits given by electrochemical roughening process. In order to achieve uniform pits to realize well-balanced printing durability, resistance to stains, and exposure stability at high level, advanced adjustment of the type of hetero elements, adding amount, or the like is required. According to the invention, it is possible to prepare an excellent planographic printing plate precursor which provides a good printing durability even in the case of using a support employing an organic polymer such as a resin or a support formed from an aluminum material including a large content of hetero elements, due to the function of a hydrophilic layer formed from a specific hydrophilic polymer described later.

Hereinbelow, preferred amounts of hetero elements that may be included in an aluminum material used as the support for the invention and effects upon preparing the support will be described in detail.

Fe is an element also included in the amount of around 0.1 to 0.2 mass % in a primary metal. It is very small amount that is dissolved in aluminum and mostly remains as an intermetallic compound. Fe has an effect on increasing mechanical strength of the aluminum plate, but if the Fe content is more than 1 mass %, breakage during rolling readily occurs and if the content is less than 0.15 mass %, mechanical strength cannot be maintained, and thus a problem such as reduction in yield during rolling may be caused.

For the invention, the Fe content may be from 0.3 to 1 mass %, preferably from more than 0.30 to 0.70 mass %, and more preferably from more than 0.30 to 0.50 mass %.

Si is an element included in the amount of around 0.02 to 0.1 mass % also in a primary metal. Si exists in aluminum either in a solid solution form, or as an intermetallic compound or a single precipitate. When heat is applied during the process for preparing a support for planographic printing plate, Si in a solid solution form may be precipitated as a simple Si. According to the present applications, when a simple Si is in excess, there may be a case where Si in a solid solution form is readily precipitated as a simple Si and resistance to ink staining in severe condition is deteriorated.

In addition, the Si content has an effect on electrochemical roughening of the aluminum plate, and if the content is less than 0.03 mass %, there may be a case where pits are dissolved during the electrochemical roughening treatment thereby failing to give a uniform surface structure.

For the invention, the Si content may be from 0.15 to 1 mass %, preferably from 0.20 to 0.50 mass %, and more preferably from more than 0.20 to 0.40 mass %.

Cu is an element included a lot in JIS 2000, 4000 materials scrap, and is relatively easily dissolved in Al.

The Cu content has a large effect on the electrochemical roughening treatment. Especially in an electrochemical roughening treatment employing an alternating current in electrolyte containing nitric acid (Hereinbelow, simply referred to as 'nitric acid AC electrolyte'), there may be a case where a latitude is narrowed relative to temperature change in electrolysis when the Cu content is less than 0.0001 mass %.

The Cu content is from 0.1 to 1 mass %, preferably from 0.10 to 0.50 mass %, and more preferably from 0.10 to 0.30 mass %.

Ti is an element usually added in the amount of 0.005 to 0.04 mass % as a crystal refining substance. In JIS 5000, 6000, and 7000 scraps, relatively large amount is included as the metal impurity. The Ti content has effects on the degree of crystal refining (degree of size of crystal particle in the aluminum plate) and electrochemical roughening. There may be a case where no crystal refining effect is obtained when the Ti content is less than 0.0010 mass %.

The Ti content may be from 0.01 to 0.5 mass %, preferably from 0.02 to 0.3 mass %, and more preferably from 0.02 to 0.05 mass %.

The Mg content has an effect on the electrochemical roughening treatment. If the Mg content is less than 0.0001 mass %, non-etched part is readily caused in the nitric acid AC electrolysis.

The Mg content may be from 0.1 to 1.5 mass %, preferably from 0.30 to 1.5 mass %, and more preferably from 0.50 to 1.35 mass %.

The Mn content has an effect on the electrochemical roughening treatment. If the Mn content is less than 0.0001 mass %, non-etched part is readily caused in the hydrochloride AC electrolysis.

The Mn content may be from 0.1 to 1.5 mass %, preferably from 0.30 to 1.40 mass %, and more preferably from 0.50 to 1.30 mass %.

Cr and Zn each exhibits an effect on improving resistance to ink staining in severe condition by being included in the amount of at least 0.00005 mass %. In addition, when an alkaline etching treatment in which the amount of aluminum dissolved is minute, is carried out after the electroroughening treatment, Cr and Zn each gives an effect on a surface structure after that alkaline etching treatment. That is, Cr and Zn have an effect on a fine structure in minimal etching. Cr is a hetero element included in a small amount in JISA 5000, 6000, and 7000 scraps.

Too high contents of Cr and Zn results in a ceiling effect, thereby being costwisely disadvantageous, thus not preferable. For the invention, the Cr content may be from 0.01 to 0.1 mass %, preferably from 0.01 to 0.08 mass %, and more preferably from 0.01 to 0.05 mass %.

The Zn content may be from 0.1 to 1.5 mass %, preferably from 0.1 to 1.3 mass %, and more preferably from 0.1 to 0.3 mass %.

In order to obtain a plate material from an aluminum alloy, for example, following method can be employed. First, an aluminum alloy molten metal containing a predetermined amount of alloy components is subjected to a cleaning treatment according to a usual method, followed by casting. In the cleaning treatment, a degassing treatment employing a flux treatment, argon gas, or chlorine gas, to remove unnecessary gas such as hydrogen in the molten metal; a filtering treatment employing a rigid media filter such as a ceramic tube filter or a ceramic foam filter, a filter of which the filtering media is alumina flake, alumina ball, or the like, or a glass cloth filter; or a combination of the degassing treatment and the filtering treatment, is carried out.

The cleaning treatment is preferably carried out to prevent a defect due to foreign substances such as non-metallic inclusion and oxides in the molten metal, or a defect due to gas intervened in the molten metal. The filtering of molten metal is described in JP-A No. 6-57432, JP-A No. 3-162530, JP-A No. 5-140659, JP-A No. 4-231425, JP-A No. 4-276031, JP-A No. 5-311261, JP-A No. 6-136466, and the like. The degassing of molten metal is described in JP-A No. 5-51659, Japanese Utility Model Application Laid-Open (JP-Y No. 5-49148, and the like. A technique on the degassing of molten metal is also proposed in JP-A No. 7-40017.

The molten metal subjected to a cleaning treatment in the above manner is then subjected to casting. As the casting method, there are a method employing a solid ingot which is typified by DC casting process and a method employing a drive ingot which is typified by continuous casting process.

In DC casting, coagulation takes place at a cooling rate ranging from 0.5 to 30° C./sec. At less than 1° C., large number of coarse intermetallic compounds may be formed. Upon DC casting, an ingot having a plate thickness of 300 to 800 mm can be produced. As necessary, this ingot is shaved from a surface thereof by usually a depth of 1 to 30 mm, preferably 1 to 10 mm according to a usual method. Before or after the shaving treatment, a soaking treatment may be also carried out as necessary. When carrying out the soaking treatment, it is necessary to subject a heat treatment at a temperature between 450 and 620° C. for 1 to 48 hour(s) so that an intermetallic compound is not formed into a rough and large mass. If the heat treatment is subjected for less than 1 hour, an effect of soaking treatment under heating may not be sufficiently exhibited. There is an advantage when the homogenization treatment is not subjected that the cost can be reduced.

Thereafter, the plate is hot-rolled and cold-rolled to form an aluminum rolled plate. The initiation temperature for the hot-rolling is suitably from 350 to 500° C. An interannealing treatment may also be subjected before, after, or in the middle of the heat-rolling. The interannealing treatment is carried out by either heating at a temperature between 280 and 600° C. for 2 to 20 hours, preferably at a temperature between 350 and 500° C. for 2 to 10 hours in a batch annealing furnace; or heating at a temperature between 400 and 600° C. for 6 minutes or less, preferably at a temperature between 450 and 550° C. for 2 minutes or less in a continuous annealing furnace. It is also possible to refine crystals by heating at a temperature increasing rate of 10 to 200° C./sec in a continuous annealing furnace.

The aluminum plate having a predetermined thickness e.g., 0.1 to 0.5 mm, which is obtained in the above manner, may be placed in an appliance such as a tension leveler or a roller leveler to further improve flatness. For the treatment for improving the flatness, the aluminum plate cut into a sheet may be used, but a continuous coil shape is more preferably used from the viewpoint of improving productivity. In addition, a slitter-line passing-through may be employed for processing into a predetermined plate width. Further, a surface of the aluminum plate may be provided with a thin oil film so as to prevent forming scratches caused when aluminum plates are rubbed to one another.

The oil film may be volatile or non-volatile which is selected suitably according to need.

The aluminum plate for use in the invention is preferably a plate well-tempered H18 by JIS.

Following various characteristics are demanded for the aluminum plates manufactured in such manner.

For the strength of the aluminum plate, 0.2% bearing force is preferably 120 MPa or greater to provide a strength required for the support for use in the planographic printing plate. In addition, in order to provide a certain degree of strength even in the case where a burning treatment is performed, 0.2% bearing force after the heat treatment at 270° C. for 3 to 10 minutes is preferably 80 MPa or greater, more preferably 100 MPa or greater. Herein, 0.2% bearing force is described on page 743 of physical and chemical science encyclopedia (Rikagaku Ziten) $4^{th}$ edition (published by Iwanami Shoten), and can be measured using a generally used tensile machine.

In particular, when an aluminum material including Mg or Mn is used to impart strength to the aluminum plate, the aluminum plate becomes harder to be fit into a plate cylinder of a printing machine, and thus the material and the adding amount of trace amount of components are suitably selected depending on the purpose.

Further, it is more preferable that the aluminum plate has a tensile strength of 140 to 300 $N/mm^2$ and extension of 1 to 10% by JIS Z2241 and Z2201, the disclosures of which are incorporated by reference herein.

The crystal structure of the aluminum plate is preferable to be not so bulky at the surface thereof, because the crystal structure on a surface of the aluminum plate may sometimes be the cause of a poor image quality when a chemical roughening treatment or electrochemical roughening treatment is carried out. The width of the crystal structure on a surface of the aluminum plate is preferably 200 μm or less, more preferably 100 μm or less, and even more preferably 50 μm or less, and the length of which is preferably 5,000 μm or less, more preferably 1,000 μm or less, and even more preferably 500 μm or less.

The thickness of the aluminium plate for use as a support in the invention is approximately from 0.1 mm to 0.6 mm, preferably 0.15 mm to 0.4 mm, and more preferably 0.2 mm to 0.3 mm.

Surface Roughening Treatment

For preparing an aluminum support, an aluminum plate used as the substrate may be subjected to a surface treatment, such as a surface roughening treatment, an anodic oxidation treatment, and a silicate treatment, depending on necessity. These surface treatments will be briefly described below.

Before surface roughening the aluminum plate, if necessary, a degreasing treatment is carried out with a surfactant, an organic solvent, or an alkaline aqueous solution, in order to remove a rolling oil from the surface of the plate.

The surface roughening treatment of the surface of the aluminum plate may be carried out by various methods. For example, it may be carried out by a method of mechanically roughening the surface, a method of electrochemically dissolving and roughening the surface, or a method of chemically and selectively dissolving the surface. As the mechanical method, a known method such as a ball grinding method, a brush grinding method, a blast grinding method, and a buff grinding method can be used. As the electrochemical surface roughening method, there is a method wherein a plate is treated in a hydrochloric or nitric acid electrolytic solution with an alternating current or a direct current. A method combining both methods disclosed in JP-A No. 54-63902 may also be employed.

For the aluminum plate of low aluminum purity, it may be sometimes difficult to carry out some or all of the method of mechanically roughening the surface, the method of electrochemically dissolving and roughening the surface, and the method of chemically and selectively dissolving the surface, from the viewpoint of achieving suitable and uniform surface roughening. However, by forming a hydrophilic layer formed from a specific hydrophilic polymer which to be described later, according to the invention, it is possible to obtain a support for planographic printing plate excellent in surface hydrophilicity and adhesiveness to an image forming layer.

Anodic Oxidation Treatment

The aluminum plate having a surface roughened in such manner is subjected, depending on necessity, to an alkaline etching treatment and a neutralizing treatment, and then it is subjected to an anodic oxidation treatment optionally in order to improve the water holding capacity and the wear resistance of the surface. As an electrolyte used for the anodic oxidation treatment of the aluminum plate, various kinds of electrolytes that form a porous oxide film can be used. In general, sulfuric acid, phosphoric acid, oxalic acid, chromic acid, and a mixed acid thereof are used as the electrolyte. The concentration of the electrolyte is suitably determined depending on the kind of the electrolyte.

The treating conditions of the anodic oxidation cannot be necessarily determined because they may vary depending on the electrolyte used. However, in general, it is suitable when the concentration of the electrolyte is from 1 to 80 mass %, the liquid temperature is from 5 to 70° C., the electric current density is from 5 to 60 A/dm$^2$, the voltage is from 1 to 100 V, and the electrolysis time is from 10 seconds to 5 minutes. When the amount of the anodic oxidized film formed is less than 1.0 g/m$^2$, the printing durability may become insufficient or the non-image portion of the planographic printing plate may be liable to be damaged, whereby the so-called 'staining due to scratch' is tend to occur by an ink adhering on the flaw upon printing.

Silicate Treatment

When the support is formed from an aluminum material, the surface of the aluminum substrate thus obtained is preferably subjected to a silicate treatment from the viewpoint of improving adhesiveness to a hydrophilic layer.

The method of silicate treatment is not particularly limited and any known method may be arbitrarily employed. For example, a method of immersing the aluminum substrate in an aqueous solution containing an alkali metal silicate salt is exemplified.

The concentration of the aqueous alkali metal silicate salt solution is preferably about 1 to 30 mass %, and more preferably about 2 to 15 mass %. pH of the aqueous solution at 25° C. is preferably about 10 to 13. The silicate treatment according to the invention is carried out by immersing the aluminum substrate in the aqueous solution kept at a temperature between 15 and 80° C., preferably 15 and 50° C., for 0.5 to 120 seconds, preferably 5 to 60 seconds.

The alkali metal silicate salts used for the silicate treatment include sodium silicate, potassium silicate, lithium silicate, and the like.

In addition, hydroxide may be added to the aqueous alkali metal silicate salt solution to give a higher pH. Examples of the hydroxides include sodium hydroxide, potassium hydroxide, lithium hydroxide, and the like. The content of the hydroxide in the aqueous solution is preferably around 0.01 to 10 mass %, and more preferably around 0.05 to 5.0 mass %.

An alkaline earth metal salt or a Group IVB metal salt may be also added to the aqueous solution. Examples of the alkaline earth metal salts include water-soluble salts, for example, nitric acid salts such as calcium nitrate, strontium nitrate, magnesium nitrate, and barium nitrate, sulfate salts, hydrochloric acid salts, phosphate salts, acetate salts, oxalate salts, borate salts, and the like. Examples of the Group IVB metal salts include titanium tetrachloride, titanium trichloride, titanium potassium fluoride, titanium potassium oxalate, titanium sulfate, titanium tetraiodide, zirconium chloride oxide, zirconium dioxide, zirconium oxychloride, zirconium tetrachloride, and the like. The alkaline earth metal or Group IVB metal salts may be used alone or in combination of two or more kinds. The preferable content of these metal salts in the aqueous solution is about 0.01 to 10 mass %, preferably about 0.05 to 5.0 mass %.

Alternatively, the silicate electrodeposition described in a specification of U.S. Pat. No. 3,658,662 is also effective. Further, combination of the support previously subjected to an electrolytic graining as disclosed in JP-B No. 46-27481, and JP-A Nos. 52-58602 and 52-30503 and the surface treatment in which the anodizing and silicate hydrophilic treatments are carried out is also applicable.

The metal silicate salt coated film obtained by such silicate treatment is formed at an amount of 2 to 40 mg/m$^2$, more preferably 4 to 30 mg/m$^2$ as Si element. The coating amount can be determined by fluorescent X-ray analysis.

When a plastic film such as a polyester film is used as the support for the invention, a support in which the surface of a side where a hydrophilic layer is formed is surface roughened by a well-known method is preferably used from the viewpoints of formability of a hydrophilic layer and adhesiveness between the support and the hydrophilic layer.

Hydrophilic Layer

The planographic printing plate precursor of the invention is provided with, on the support, a hydrophilic layer (hereinafter, simply referred to as 'specific hydrophilic layer') including a hydrophilic polymer chemically bonded to a surface of the support, where the hydrophilic polymer has a positively-charged substituent and at least one reactive group selected from a reactive group capable of directly chemically bonding to a surface of the support and a reactive group capable of chemically bonding to a surface of the support via a crosslinked structure.

In other words, the hydrophilic layer according to the invention is constituted by including a hydrophilic polymer having a reactive group and a positively-charged substituent (hereinafter, also may be referred to as 'specific hydrophilic polymer').

Hereinbelow, the specific hydrophilic polymer will be described.

Specific Hydrophilic Polymer

The hydrophilic layer according to the invention is formed by chemically bonding a hydrophilic polymer to a surface of the support.

Examples of the reactive group capable of directly chemically bonding to a surface of the support herein include functional groups capable of chemically bonding with a functional group such as —$Al^{3+}$ or —OH present on a surface of the support, e.g., a hydroxylsilyl group, an alokoxysilyl group, an aryloxysilyl group, a halosilyl group (a chlorosilyl group, etc.), and an aminosilyl group. Examples of the reactive group capable of chemically bonding to a surface of the support via a crosslinked structure include functional groups such as a hydroxysilyl group, an alkoxysilyl group, an aryloxysilyl group, a halosilyl group (a chlorosilyl group, etc.), an aminosilyl group, a hydroxyl group, an amino group, an epoxy group, a carboxyl group, and a vinyl group. In order to form a crosslinked structure in the latter reactive group, a sol-gel crosslinked structure which will be described later or structures of a polymerizable vinyl group, a polymerizable epoxy group, and a polymerizable oxetane group may be employed. Among those mentioned above, preferable examples of the hydrophilic layer in which the polymer chemically bonds to a surface of the support via a crosslinked structure include a hydrophilic layer having a crosslinked structure formed through hydrolysis and polycondensation of an alkoxide compound including an element selected from Si, Ti, Zr, and Ar.

The reactive groups may be either on the terminal or a side chain of the hydrophilic polymer chain, but they are preferably on the terminal from the viewpoint of water holding capacity or on the side chain from the viewpoint of film strength, and this may be suitably selected or combined.

The positively-charged substituent according to the invention refers to a substituent having a positive charge in the atom. The positively-charged substituent is preferably a substituent having a positively-charged hetero atom from the viewpoints of charge stability and heat stability.

As an example of the specific hydrophilic polymer for use in forming the hydrophilic layer according to the invention, a hydrophilic polymer including a structural unit (i) and a structural unit (ii) shown in following Formula (1) can be exemplified. Hereinafter, this specific hydrophilic polymer may be also referred to as 'Specific Hydrophilic Polymer (1)'.

Formula (1)

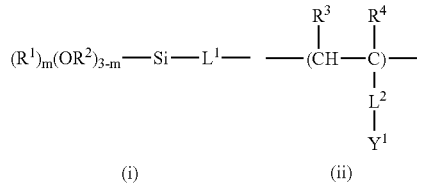

The hydrophilic polymer including structural units represented in Formula (1) (Specific Hydrophilic Polymer (1)) will be described.

Specific Hydrophilic Polymer (1) which may be used in the invention is a polymer having a silane coupling group represented by the structural unit (i) on at least one end of the structure formed by linking a plurality of repeating units represented by the structural unit (ii) in the Formula (1).

The repeating units represented by the structural unit (ii) in Specific Hydrophilic Polymer (1) may be one or more kinds. Specific Hydrophilic Polymer (1) may also include a copolymerization component other than the repeating units represented by the structural unit (ii).

In Formula (1), $R^1$, $R^2$, $R^3$, and $R^4$ each independently represents a hydrogen atom or a substituent having 1 to 30 carbon atoms. In particular, they are each preferably a substituent having 1 to 20 carbon atoms, more preferably a substituent having 1 to 15 carbon atoms, and particularly preferably a substituent having 1 to 8 carbon atoms.

$R^1$, $R^2$, $R^3$, and $R^4$ may be each more specifically a linear, branched, or cyclic alkyl group, aryl group, heterocyclic group, or the like.

Examples of the alkyl group include a methyl group, an ethyl group, a propyl group, a butyl group, a pentyl group, a hexyl group, a heptyl group, an octyl group, an isopropyl group, an isobutyl group, an s-butyl group, a t-butyl group, an isopentyl group, a neopentyl group, a 1-methylbutyl group, an isohexyl group, 2-ethylhexyl group, a 2-methylhexyl group, a cyclopentyl group, and the like.

Examples of the aryl group include a phenyl group, a 1-naphthyl group, a 2-naphthyl group, and the like.

Examples of the heterocyclic group include a furanyl group, a thiophenyl group, a pyridinyl group, and the like.

These groups may be further substituted. As the substituents, monovalent nonmetallic atom groups excluding hydrogen may be employed. Of those substituents, preferable examples include a halogen atom (—F, —Br, —Cl, —I), a hydroxyl group, an alkoxy group, an aryloxy group, a mercapto group, an alkylthio group, an arylthio group, an alkyldithio group, an aryldithio group, an amino group, an N-alkylamino group, an N,N-diarylamino group, an N-alkyl-N-arylamino group, an acyloxy group, a carbamoyloxy group, an N-alkylcarbamoyloxy group, an N-arylcarbamoyloxy group, an N,N-dialkylcarbamoyloxy group, an N,N-diarylcarbamoyloxy group, an N-alkyl-N-arylcarbamoyloxy group, an alkylsulfoxy group, an arylsulfoxy group, an acylthio group, an acylamino group, an N-alkylacylamino group, an N-arylacylamino group, an ureide group, an N'-alkylureido group, N',N'-dialkylureido group, an N'-arylureido group, an N',N'-diarylureido group, an N'-alkyl-N'-arylureido group, an N-alkylureido group, an N-arylureido group, an N'-alkyl-N-alkylureido group, an N'-alkyl-N-arylureido group, an N',N'-dialkyl-N-alkylureido group, an N',N'-dialkyl-N-arylureido group, an N'-aryl-N-alkylureido group, an N'-aryl-N-arylureido group, an N',N'-diaryl-N-alkylureido group, an N',N'-diaryl-N-arylureido group, an N'-alkyl-N'-aryl-N-alkylureido group, an N'-alkyl-N'-aryl-N-arylureido group, an alkoxycarbonylamino group, an aryloxycarbonylamino group, an N-alkyl-N-alkoxycarbonylamino group, an N-alkyl-N-aryloxycarbonylamino group, an N-aryl-N-alkoxycarbonylamino group, an N-aryl-N-aryloxycarbonylamino group, a formyl group, an acyl group, a carboxyl group, an alkoxycarbonyl group, an aryloxycarbonyl group, a carbamoyl group, an N-alkylcarbamoyl group, an N,N-dialkylcarbamoyl group, an N-arylcarbamoyl group, an N,N-diarylcarbamoyl group, an N-alkyl-N-arylcarbamoyl group, an alkylsulfinyl group, an arylsulfinyl group, an alkylsulfonyl group, an arylsulfonyl group, a sulfo group (—$SO_3H$), and conjugated base group thereof (hereinafter, referred to as a sulfonato group), an alkoxysulfonyl group, an aryloxysulfonyl group, a sulfinamoyl group, an N-alkylsulfinamoyl group, an N,N-dialkylsulfinamoyl group, an N-arylsulfinamoyl group, an N,N-diarylsulfinamoyl group, an N-alkyl-N-arylsulfinamoyl group, a sulfamoyl group, an N-alkylsulfamoyl group, an N,N-dialkylsulfamoyl group, an N-arylsulfamoyl group, an N,N-diarylsulfamoyl group, an N-alkyl-N-arylsulfamoyl group, a phosphono group (—$PO_3H_2$), and conjugated base group thereof (hereinafter, referred to as a phosphonato group), a dialkylphosphono group (—$PO_3(alkyl)_2$), a diarylphosphono group (—$PO_3(aryl)_2$), an alkylarylphosphono group (—$PO_3(alkyl)(aryl)$), a monoalkylphosphono group (—$PO_3H(alkyl)$) and conjugated base group thereof (hereinafter, referred to as an alkylphosphonato group), a monoarylphosphono group (—$PO_3H$ (aryl)) and conjugated base group thereof (hereinafter, referred to as an arylphosphonato group), a phosphonooxy group (—$OPO_3H_2$) and conjugated base group thereof (hereinafter, referred to as a phosphonatooxy group), a dialkylphosphonooxy group (—$OPO_3(alkyl)_2$), a diarylphosphonooxy group (—$OPO_3(aryl)_2$), an alkylarylphosphonooxy group (—OPO(alkyl)(aryl)), a monoalkylphosphonooxy group (—$OPO_3H(alkyl)$), and conjugated base group thereof (hereinafter, referred to as an alkylphosphonatooxy group), a monoarylphosphonooxy group (—$OPO_3H(aryl)$) and conjugated base group thereof (hereinafter, referred to as an arylphosphonatooxy group), a morpholino group, a cyano group, a nitro group, an aryl group, an alkenyl group, and an alkynyl group.

$R^1$, $R^2$, $R^3$, and $R^4$ are each particularly preferably, for example, a hydrogen atom, a methyl group, or an ethyl group, from the viewpoints of effectiveness and easy availability.

In Formula (1), $L^1$ and $L^2$ each independently represents a single bond or an organic linking group. Herein, the organic linking group refers to a polyvalent linking group formed with non-metallic atoms. In specific, it is composed of from 1 to 60 carbon atoms, from 0 to 10 nitrogen atoms, from 0 to 50 oxygen atoms, from 1 to 100 hydrogen atoms, and from 0 to 20 sulfur atoms. More specific examples of the organic linking group include the following structural units and those constituted with a combination thereof

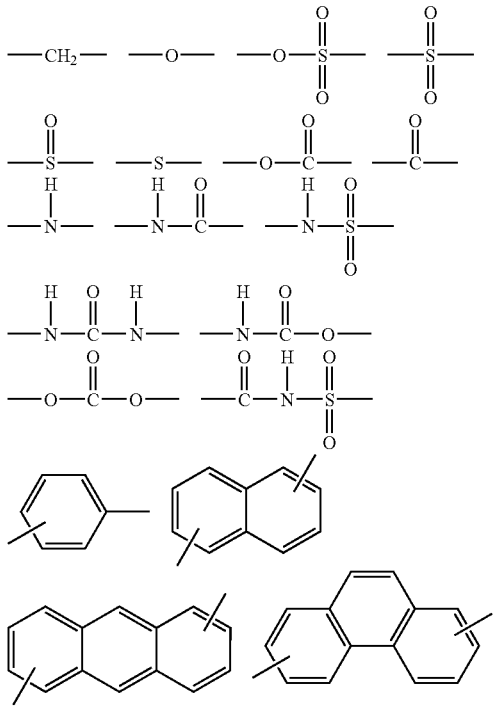

Particularly preferred structure of $L^1$ can be exemplified by —$(CH_2)_n$—S—. Herein, n is an integer of preferably 1 to 8, more preferably 1 to 5, and particularly preferably 2 to 4.

Particularly preferred structure of $L^2$ can be exemplified by a single bond or those shown below.

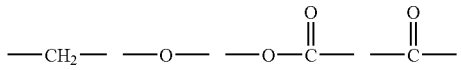

-continued

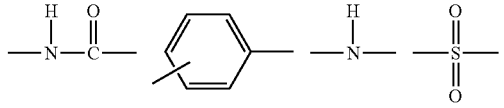

In Formula (1), $Y^1$ represents a substituent having a positive charge. Examples of the substituent include (substituted) ammonio groups such as a non-substituted ammonio group, a trimethylammonio group, a triethylammonio group, a tributylammonio group, a benzyldimethylammonio group, a diethylhexylammonio group, and a (2-hydroxyethyl)dimethylammonio group; (substituted)phosphonio groups such as a non-substituted phosphonio group, a trimethylphosphonio group, a triethylphosphonio group, and a triphenylphosphonio group; a pyridinio group; an N-methylimidazolino group; an N-acryldinio group; and the like.

Among these, preferred are (substituted) ammonio groups and (substituted) phosphonio groups, and particularly preferred are (substituted) ammonio groups, from the viewpoint of stability of the positive charge.

Examples of the counter anion of the positively-charged substituent include $SO_4^{2-}$, $S_2O_3^{2-}$, $SO_3^-$, a halogen ion, $ClO_4^-$, $BF_4^-$, $PF_6^-$, $SbF_6^-$, $BiCl_5^-$, $AsF_6^-$, $SbCl_6^-$, $SnCl_6^-$, R—$SO_3^-$, R—$COO^-$, and the like. Herein, R is a hydrogen atom, an alkyl group, an aryl group, or a heterocyclic group.

The hydrophilic polymer including the structural units represented by Formula (1) according to the invention may either be a homopolymer containing a single type of structural unit (ii) or a copolymer containing plural types of structural unit (ii). It may also be a copolymer containing other copolymer components (structural units) in addition to the structural unit (ii).

The molecular weight of Specific Hydrophilic Polymer (1) suitable for use in the invention is preferably from 1,000 to 100,000, more preferably from 1,000 to 50,000, and most preferably from 1,000 to 30,000.

Specific examples of Specific Hydrophilic Polymer (1) suitable for use in the invention will be shown as Exemplary Compounds (1-1) to (1-12) below, but the invention is not limited to these.

(1-1)

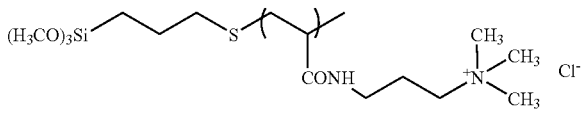

Mw = 5000

(1-2)

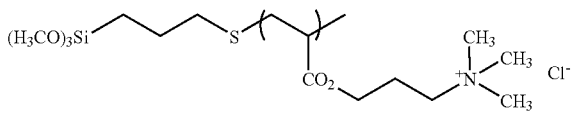

Mw = 5500

(1-3)

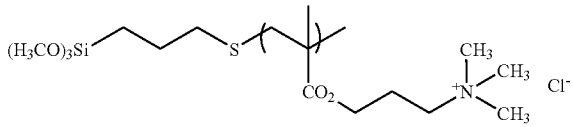

Mw = 7000

-continued (1-4)

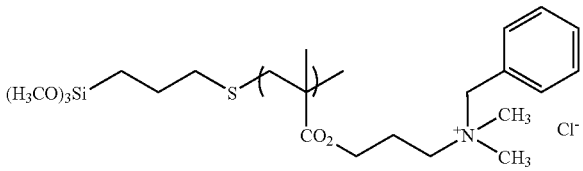

Mw = 6500

(1-5)

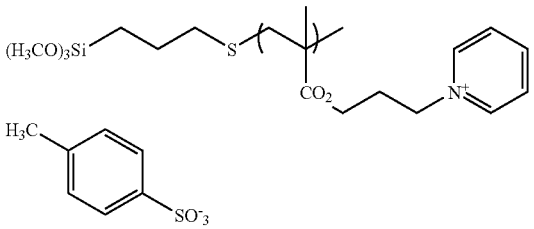

Mw = 7000

(1-6)

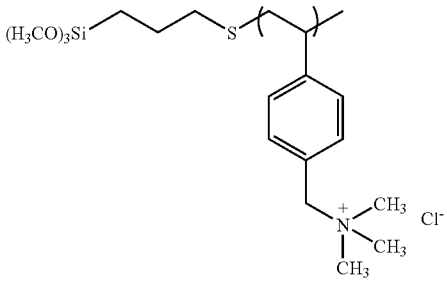

Mw = 8500

(1-7)

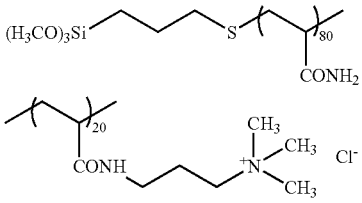

Mw = 7000

(1-8)

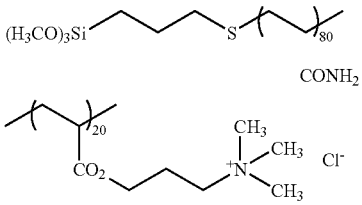

Mw = 6500

(1-9)

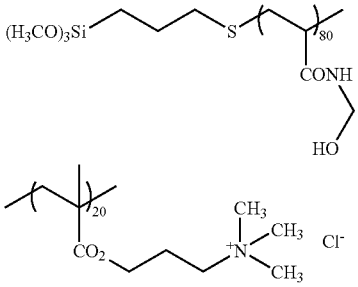

Mw = 8000

-continued (1-10)

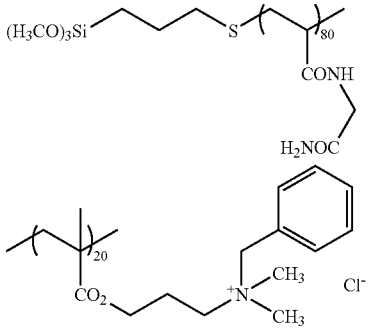

Mw = 5500

(1-11)

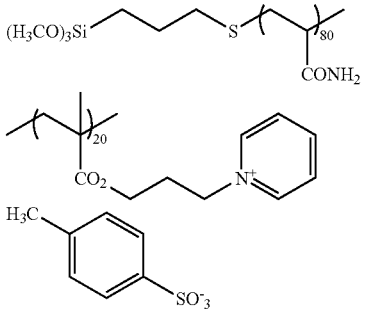

Mw = 7500

(1-12)

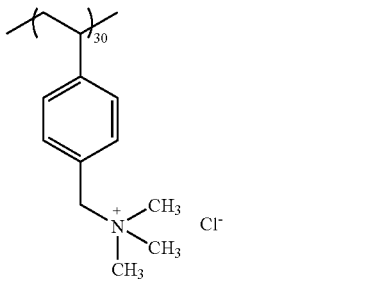

Mw = 9000

In addition, other examples of the specific hydrophilic polymer for forming the hydrophilic layer according to the invention may include those including a structural unit (iii) and a structural unit (iv) represented in the following Formula (2). Hereinafter, this specific hydrophilic polymer may be also referred to as 'Specific Hydrophilic Polymer (2)'.

Formula (2)

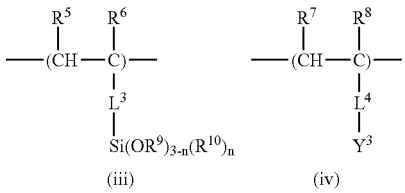

(iii) (iv)

The hydrophilic polymer including structural units represented by Formula (2) (Specific Hydrophilic Polymer (2)) will be described.

Specific Hydrophilic Polymer (2) which may be used in the invention is a polymer including both the repeating unit represented by the structural unit (iii) which has a silane coupling group and the repeating unit represented by the structural unit (iv). The polymer may include a single type or plural types of each of repeating units represented by the structural unit (iii) and the structural unit (iv), respectively, and may also include a copolymer component other than the repeating unit represented by the structural unit (iii) and the repeating unit represented by the structural unit (iv).

The molar composition ratio of the structural unit (iii) to the structural unit (iv) in Formula (2) is preferably from 99.5:0.5 to 0.5:99.5, more preferably from 99:1 to 50:50, and particularly preferably from 98:2 to 70:30.

$R^5$, $R^6$, $R^7$, $R^8$, $R^9$, and $R^{10}$ each independently represent a hydrogen atom or a substituent having 1 to 30 carbon atoms. In particular, they are each preferably a substituent having 1 to 20 carbon atoms, more preferably a substituent having 1 to 15 carbon atom(s), and particularly preferably a substituent having 1 to 8 carbon atoms.

$R^5$, $R^6$, $R^7$, $R^8$, $R^9$, and $R^{10}$ may be a linear, branched, or cyclic alkyl group, aryl group, heterocyclic group, or the like.

Specific examples of $R^5$, $R^6$, $R^7$, $R^8$, $R^9$, and $R^{10}$ may include those exemplified for $R^1$, $R^2$, $R^3$, and $R^4$ above.

$L^3$ and $L^4$ each independently represent a single bond or an organic linking group. Specific examples of $L^3$ and $L^4$ may include those exemplified for $L^1$ and $L^2$.

$Y^3$ represents a positively-charged substituent. Specific examples of $Y^3$ may include those exemplified for $Y^1$, and preferred examples thereof are also the same with those exemplified for $Y^1$.

The molecular weight of Specific Hydrophilic Polymer (2) is preferably from 1,000 to 100,000, more preferably from 1,000 to 50,000, and particularly preferably from 1,000 to 30,000.

Hereinbelow, specific examples of Specific Hydrophilic Polymer (2) suitable for use in the invention will be shown as Exemplary Compounds (2-1) to (2-11) below, but the invention is not limited to these.

(2-1)

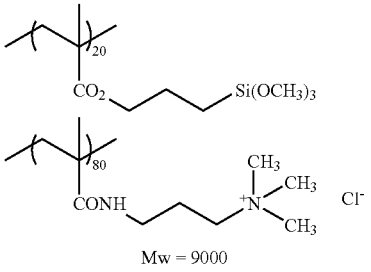

Mw = 9000

(2-2)

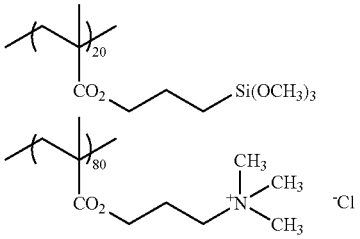

Mw = 6000

-continued (2-3)

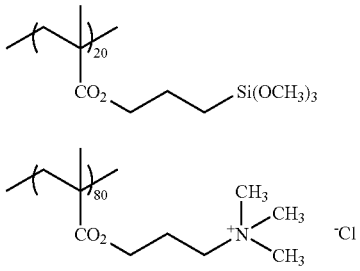

Mw = 8500

(2-4)

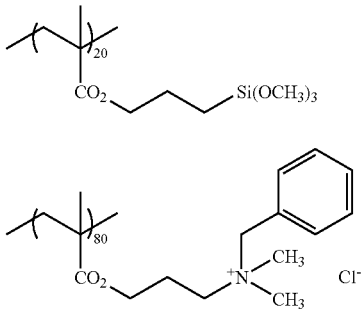

Mw = 7500

(2-5)

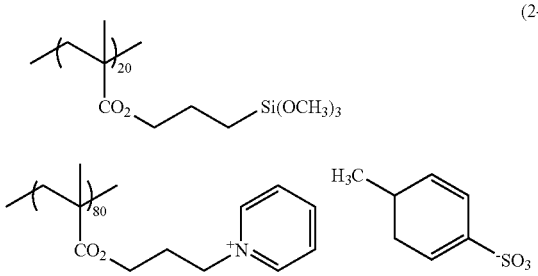

Mw = 6500

(2-6)

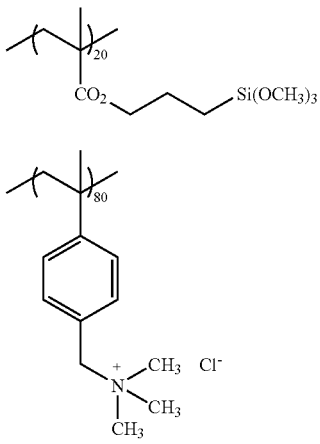

Mw = 9500

(2-7)

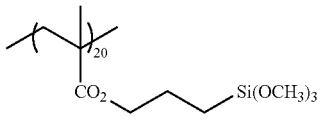

-continued

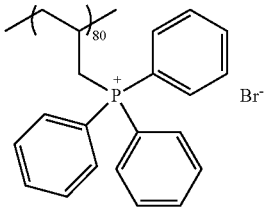

Mw = 6000

(2-8)

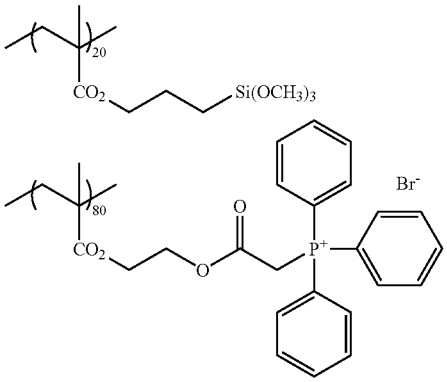

Mw = 7500

(2-9)

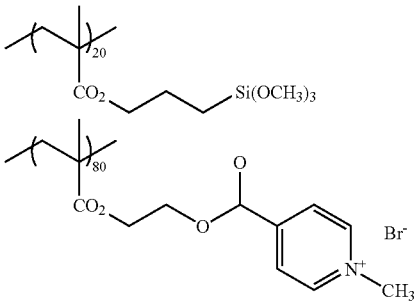

Mw = 9000

(2-10)

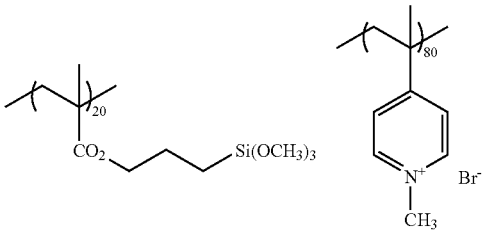

Mw = 6500

(2-11)

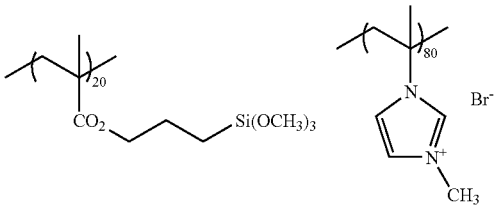

Mw = 6500

Specific Hydrophilic Polymer (1) or Specific Hydrophilic Polymer (2) can be synthesized according to any known method, and radical polymerization methods are preferably used. General radical polymerization methods, for example, are described in Shin Kobunshi Jikken-gaku 3 (New Polymer Experimentation 3), Kobunshi no Gousei to Hannou 1 (Synthesis and Reaction of Polymers 1), (edited by Polymer Society Japan, Kyoritsu Shuppan Co., Ltd.), Shin Jikken Kagaku Kouza 19 (Lectures on New Experimental Chemistry 19), Kobunshi Kagaku (I) (Polymer Chemistry (I)), (edited by The Chemical Society of Japan, Maruzen), and Busshitsu Kougaku Kouza (Lectures on Substance Engineering), Kobunshi Gousei Kagaku (Synthetic Polymer Chemistry), (Publishing Division of Tokyo Denki University), which can be applied thereto.

As mentioned above, Specific Hydrophilic Polymer (1) may be a copolymer including another structural unit (repeating unit) in addition to a repeating unit represented by the structural unit (ii) in Formula (1), and Specific Hydrophilic Polymer (2) may be a copolymer including another structural unit (repeating units) in addition to repeating units represented by the structural formula (iii) and structural unit (iv) in Formula (2).

Herein, structural units other than the structural unit (ii), the structural unit (iii), and the structural unit (iv) may include any known structural units (repeating units) derived from various monomers.

Preferred examples thereof include structural units derived from known monomers, such as acrylate esters, methacrylate esters, acrylamides, methacrylamides, vinyl esters, styrenes, acrylic acids, methacrylic acids, acrylonitrile, maleic anhydrides, and maleimides. Here, various properties, such as film forming property, film strength, hydrophilicity, hydrophobicity, solubility, reactivity, and stability, can be improved or controlled by employing a copolymer given by copolymerizing the other structural units selected above.

Specific examples of the acrylate esters include methyl acrylate, ethyl acrylate, (n- or i-) propyl acrylate, (n-, i-, sec- or t-) butyl acrylate, amyl acrylate, 2-ethylhexyl acrylate, dodecyl acrylate, chloroethyl acrylate, 2-hydroxyethylacrylate, 2-hydroxypropyl acrylate, 2-hydroxypentyl acrylate, cyclohexyl acrylate, allyl acrylate, trimethylolpropane monoacrylate, pentaerythritol monoacrylate, benzyl acrylate, methoxybenzyl acrylate, chlorobenzyl acrylate, hydroxybenzyl acrylate, hydroxyphenethyl acrylate, dihydroxyphenethyl acrylate, furfuryl acrylate, tetrahydrofurfuryl acrylate, phenyl acrylate, hydroxyphenyl acrylate, chlorophenyl acrylate, sulfamoylphenyl acrylate and 2-(hydroxyphenylcarbonyloxy)ethyl acrylate.

Specific examples of the methacrylate esters include methyl methacrylate, ethyl methacrylate, (n- or i-) propyl methacrylate, (n-, i-, sec- or t-) butyl methacrylate, amyl methacrylate, 2-ethylhexyl methacrylate, dodecyl methacrylate, chloroethylmethacrylate, 2-hydroxyethyl methacrylate, 2-hydroxypropyl methacrylate, 2-hydroxypentyl methacrylate, cyclohexyl methacrylate, allyl methacrylate, trimethylolpropane monomethacrylate, pentaerythritol monomethacrylate, benzyl methacrylate, methoxybenzylmethacrylate, chlorobenzyl methacrylate, hydroxybenzyl methacrylate, hydroxyphenethyl methacrylate, dihydroxyphenethyl methacrylate, furfuryl methacrylate, tetrahydrofurfuryl methacrylate, phenyl methacrylate, hydroxyphenyl methacrylate, chlorophenylmethacrylate, sulfamoylphenyl methacrylate and 2-(hydroxyphenylcarbonyloxy)ethyl methacrylate.

Specific examples of the acrylamides include acrylamide, N-methylacrylamide, N-ethylacrylamide, N-propylacrylamide, N-butylacrylamide, N-benzylacrylamide, N-hydroxyethylacrylamide, N-phenylacrylamide, N-tolylacrylamide, N-(hydroxyphenyl)acrylamide, N-(sulfamoylphenyl)acrylamide, N-(phenylsulfonyl)acrylamide, N-(tolylsulfonyl)acrylamide, N,N-dimethylacrylamide, N-methyl-N-phenylacrylamide and N-hydroxyethyl-N-methylacrylamide.

Specific examples of the methacrylamides include methacrylamide, N-methylmethacrylamide, N-ethylmethacrylamide, N-propylmethacrylamide, N-butylmethacrylamide, N-benzylmethacrylamide, N-hydroxyethylmethacrylamide, N-phenylmethacrylamide, N-tolylmethacrylamide, N-(hydroxyphenyl)methacrylamide, N-(sulfamoylphenyl)methacrylamide, N-(phenylsulfonyl)methacrylamide, N-(tolylsulfonyl)methacrylamide, N,N-dimethylmethacrylamide, N-methyl-N-phenylmethacrylamide and N-hydroxyethyl-N-methylmethacrylamide.

Specific examples of the vinyl esters include vinyl acetate, vinyl butyrate and vinyl benzoate. Specific examples of the styrenes include styrene, methylstyrene, dimethylstyrene, trimethylstyrene, ethylstyrene, propylstyrene, cyclohexylstyrene, chloromethylstyrene, trifluoromethylstyrene, ethoxymethylstyrene, acetoxymethylstyrene, methoxystyrene, dimethoxystyrene, chlorostyrene, dichlorostyrene, bromostyrene, iodostyrene, fluorostyrene and carboxystyrene.

For the invention, as a copolymer component of Specific Hydrophilic Polymer (1) or Specific Hydrophilic Polymer (2), preferably used is the following structural unit (v).

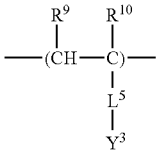

(v)

In the structural unit (v), $R^9$ and $R^{10}$ each independently represent a hydrogen atom or a substituent having 1 to 30 carbon atom(s), $L^5$ represents a single bond or an organic linking group, and $Y^3$ represents a substituent having 1 to 30 carbon atom(s).

$R^9$ and $R^{10}$ are each particularly preferably, for example, a hydrogen atom, a methyl group, or an ethyl group, from the viewpoints of effectiveness and easy availability.

It is also preferable that $L^5$ is a single bond and $Y^3$ is $—CONH_2$.

The content of the structural unit derived from the monomer, which is contained as a copolymer component together with the structural unit (ii), or together with the structural unit (iii) and the structural unit (iv) in the specific hydrophilic polymers, is preferably from 0 to 60 mol %, more preferably from 0 to 50 mol %, and particularly preferably from 0 to 40%.

The mode of action of the invention is not clear, but it is assumed that since the specific hydrophilic polymer includes, in a molecule thereof, a reactive group capable of either directly chemically boning to a surface of the support or chemically bonding via a crosslinked structure, the hydrophilic polymer firmly bonds with a functional group such as $—Al^{3+}$ or —OH present on a surface of the support. Further, since the substituent (e.g., positively-charged substituent) other than the group on the end of the specific hydrophilic polymer is present on a surface of the hydrophilic layer related to the invention in a relatively free state, it is believed that hydrophilicity can be provided on the hydrophilic layer surface derived from that substituent.

In an embodiment of the invention, the specific hydrophilic polymer has a graft structure, and via a crosslinked structure formed through hydrolysis and polycondensation of an alkoxide compound including an element selected from Si, Ti, Zr, and Ar, the polymer is chemically bonded to an aluminum substrate. It is also preferable that the support is an aluminum support subjected to a surface roughening treatment, an anodic oxidation treatment, and a silicate treatment. According to the embodiment, functional groups introduced in the form of graft chains are unevenly distributed in a relatively free state on the surface of the support, and an organic-inorganic composite film having a high density crosslinked structure is formed through hydrolysis and polycondensation of alkoxide, and thus it is believed that a film having high strength can be obtained and more significant effects of the invention can be exhibited.

The hydrophilic layer according to the invention may either be a layer in which the reactive group in the specific hydrophilic polymer is directly chemically bonded with the functional group such as $—SiO—Na^+$, $—Al^{3+}$, or a —OH group on a surface of the support or a layer formed by coating a hydrophilic coating liquid containing the specific hydrophilic polymer prepared on a surface of the support, and drying, so as to form a crosslinked structure (sol-gel crosslinked structure) through hydrolysis and polycondensation of the reactive group.

Crosslinking Component

As above, for forming the sol-gel crosslinked structure during the production of a hydrophilic layer according to the invention, it is preferable that the specific hydrophilic polymer and the crosslinking component represented by following Formula (3) are mixed and coated on a surface of the substrate, followed by drying. The crosslinking component represented by following Formula (3) is a compound having a polymerizable functional group in the structure thereof and exhibiting the function as a crosslinking agent, and it forms a firm film having a crosslinked structure through polycondensation with the specific hydrophilic polymer.

$$(R^{14})_n—X—(OR^{15})_{4-n} \qquad \text{Formula (3)}$$

In Formula (3), $R^{14}$ represents a hydrogen atom, an alkyl group, or an aryl group; $R^{15}$ represents an alkyl group or an aryl group; X represents Si, Al, Ti, or Zr; and n represents an integer of 0 to 2.

When each of $R^{14}$ and $R^{15}$ represents an alkyl group, the number of carbon atoms is preferably from 1 to 4. The alkyl group or the aryl group may be optionally substituted, and examples of the substituent which may be introduced include a halogen atom, an amino group, a mercapto group, and the like.

The molecular weight of the compound is preferably 1,000 or less.

Hereinafter, specific examples of the crosslinking component represented by general Formula (3) will be exemplified, but the invention is not limited to these.

Examples of the compound in which X is Si, namely silicon-containing hydrolyzable compounds, include trimethoxysilane, triethoxysilane, tripropoxysilane, tetramethoxysilane, tetraethoxysilane, tetrapropoxysilane, methyltrimethoxysilane, ethyltriethoxysilane, propyltrimethoxysilane, methyltriethoxysilane, ethyltriethoxysilane, propyltriethoxysilane, dimethyldimethoxysilane, diethyldiethoxysilane, γ-chloropropyltriethoxysilane, γ-mercaptopropyltrimethoxysilane, γ-mercaptopropyltriethoxysilane, γ-aminopropyltriethoxysilane, phenyltrimethoxysilane, phenyltriethoxysilane, phenyltripropoxysilane, diphenyldimethoxysilane, and diphenyldiethoxysilane.

Of those, especially preferable examples thereof include tetramethoxysilane, tetraethoxysilane, methyltrimethoxysilane, ethyltrimethoxysilane, methyltriethoxysilane, ethyltriethoxysilane, dimethyldiethoxysilane, phenyltrimethoxysilane, phenyltriethoxysilane, diphenyldimethoxysilane, and diphenyldiethoxysilane.

Examples of the compound in which X is Al, namely aluminium-containing hydrolyzable compounds, include trimethoxyaluminate, triethoxyaluminate, tripropoxyaluminate, and tetraethoxyaluminate.

Examples of the compound in which X is Ti, namely titanium-containing compounds, include trimethoxytitanate, tetramethoxytitanate, triethoxytitanate, tetraethoxytitanate, tetrapropoxytitanate, chlorotrimethoxytitanate, chlorotriethoxytitanate, ethyltrimethoxytitanate, methyltriethoxytitanate, ethyltriethoxytitanate, diethyldiethoxytitanate, phenyltrimethoxytitanate, and phenyltriethoxytitanate.

Examples of the compound in which X is Zr, namely zirconium-containing compounds, include zirconates corresponding to the titanium-containing compounds but containing zirconium in place of titanium.

Formation of Hydrophilic Layer

Preparation of Coating Liquid

In the present invention, upon the preparation of a coating liquid for use in forming the hydrophilic layer, the specific hydrophilic polymer is essentially used as mentioned above. The content of the specific hydrophilic polymer is preferably 10 mass % to less than 50 mass % based on the total solid content. If the content of the specific hydrophilic polymer is in the above range, a coated film exhibiting a sufficient film strength and good film properties as well as being not liable for cracking can be obtained, thus is preferable.

In an embodiment for preparing the coating liquid composition, the amount of the crosslinking component represented by Formula (3) to be added is preferably 5 mol % or more, more preferably 10 mol % or more, with respect to the silane coupling group (reactive group) in the specific hydrophilic polymer contained in the coating liquid for forming the hydrophilic layer. The upper limit of the amount of the crosslinking component to be added is not particularly limited as long as it is within the range of ensuring sufficient crosslinking with the specific hydrophilic polymer for the invention. However, if the amount of the crosslinking component added is too large, a problem may arise in that, for example, the excess crosslinking component not involved in crosslinking causes the surface of the formed hydrophilic layer to be sticky. From this point of view, the amount to be added is preferably 80 mol % or less.

Specific Hydrophilic Polymer (1) having a silane coupling group on a terminal of the main chain or Specific Hydrophilic Polymer (2) having a silane coupling on the side chain is dissolved in a solvent, preferably along with the crosslinking component and well stirred, and these are hydrolyzed and polycondensed to prepare an organic-inorganic composite sol. This is the coating liquid for use in forming the hydrophilic layer according to the invention, and the use of this liquid allows to form a hydrophilic layer exhibiting controlled properties such as hydrophilicity on the surface and high film strength.

To promote the hydrolysis and polycondensation in preparing the organic-inorganic composite sol which serves as the coating liquid for forming the hydrophilic layer, an acid catalyst or a basic catalyst, or a metal chelate compound is preferably used as the catalyst. For giving the preferred reaction efficiency in practice, such catalyst is essential. For the invention, the metal chelate compound is particularly preferably used as the catalyst.

As the acid catalyst or the basic catalyst, an acid or a basic compound itself or those dissolved in a solvent such as water or alcohol may be used. The catalyst concentration in the solvent is not particularly limited, and may be suitably selected depending on the properties of the acid or the basic compound used and on the desired content of the catalyst in the reaction system. The higher concentration tends to accelerate the hydrolysis and the polycondensation of the system. However, if the basic catalyst of high concentration is used, there may be a case where a precipitate is formed in the sol. Therefore, the concentration of the basic catalyst is desirably at most 1 N in terms of the concentration of the catalyst in the aqueous solution.

The acid catalyst and the basic catalyst for use herein are not particularly limited in their type. However, if the catalyst is used in high concentration, catalysts including elements that will remain little in the dried film are preferable.

Specific examples of the acid catalyst include hydrogen halides such as hydrochloric acid; nitric acid; sulfuric acid; sulfurous acid; hydrogen sulfide; perchloric acid; hydrogen peroxide; carbonic acid; carboxylic acids such as formic acid and acetic acid; substituted carboxylic acids of formula RCOOH in which R is substituted with any other element or substituent; sulfonic acids such as benzenesulfonic acid; and the like. Examples of the basic catalyst include ammonia bases such as aqueous ammonia; amines such as ethylamine and aniline; and the like.

In addition, specific examples of the metallic chelate compounds used in the invention include for example, zirconium chelate compounds such as tri-n-butoxyethylacetoacetate zirconium, di-n-butoxybis(ethylacetoacetate)zirconium, n-butoxytris(ethylacetoacetate)zirconium, tetrakis(n-propylacetoacetate)zirconium, tetrakis(acetylacetoacetate)zirconium, and tetrakis(ethylacetoaetate)zironium; titanium chelate compounds such as diisopropoxy-bis(ethylacetoacetate)titanium, diisopropoxy-bis(acetylacetate)titanium, and diisopropoxy-bis(acetylacetone)titanium; aluminum chelate compounds such as tris(acetylacetone)aluminum, diisopropoxyethylacetoacetate aluminum, diisopropoxy-acetylacetonate aluminum, isopropoxy bis(ethylacetoacetate)aluminum, isopropoxy bis(acetylacetonate)aluminum, tris(ethylacetoacetate)aluminum, tris(acetylacetonate)aluminum, and monoacetylacetate-bis(ethylacetoacetate)aluminum. Among these metallic chelate compounds, preferable are tri-n-butoxyethylacetoacetate zirconium, diisopropoxy bis(acetylacetonate)titanium, tris(acetylacetone)aluminum, diisopropoxyethylacetoacetate aluminum, and tris(ethylacetoacetate)aluminum. These metallic chelate compounds may be used alone or as mixture of two or more kinds.

The added amount of the metal chelate compound according to the invention may be usually about 0.01 to 15 mass %, preferably 0.1 to 15 mass %, and more preferably 0.1 to 10 mass %, with respect to the total solid content of the coating liquid for use in forming the hydrophilic layer.

To prepare the coating liquid for use in forming the hydrophilic layer, Specific Hydrophilic Polymer (1) or Specific Hydrophilic Polymer (2) is dissolved in a solvent such as water, methanol, or ethanol, preferably along with the crosslinking component, and optionally the catalyst described above is added thereto, and the mixture is stirred.

Preferably, the reaction temperature is between room temperature and 80° C., and the reaction time for which the mixture is stirred is between 1 and 72 hours. This stirring of the mixture promotes the hydrolysis and polycondensation of the two components to give the intended organic-inorganic composite sol.

The solvent which may be used for preparing the coating liquid for forming the hydrophilic layer that contains the specific hydrophilic polymer, preferably along with the crosslinking component, is not particularly limited as long as the solvent can uniformly dissolve or disperse the components. For example, the solvent is preferably an aqueous solvent such as methanol, ethanol, and water.

As mentioned above, the organic-inorganic composite sol for forming the hydrophilic layer (coating liquid for forming the hydrophilic layer) can be prepared by a sol-gel method. The sol-gel method is described in detail, for example, in Sumio Sakuhana's Science for Sol-Gel Process (published by Agune Shofusha, 1988); and Ken Hirashima's Technology for Functional Thin film Formation by Latest Sol-Gel Process (published by General Technology Center, 1992). The methods described in these can be employed in preparing the coating liquid for forming the hydrophilic layer according to the invention.

The coating liquid for forming the hydrophilic layer related to the invention may contain various additives in addition to those mentioned above for the purpose of controlling the degree of hydrophilicity, or improving the physical strength, mutual dispersibility of the components constituting the layer, coatability, printability, and so on. For example, a plasticizer, a pigment, a dye, a surfactant, fine particles, or the like, may be added.

Hereinbelow, the components that can be added to the coating liquid for forming the hydrophilic layer will be described.

The fine particle is not particularly limited, but preferred are silica, alumina, titanium oxide, magnesium oxide, magnesium carbonate, calcium alginate, and the like. These can be used for enhancing the hydrophilicity or strengthening the film. More preferred is silica, alumina, titanium oxide, or a mixture thereof.

The silica includes many hydroxide groups on the surface thereof and siloxane bond (—Si—O—Si—) inside thereof. The silica preferably used in the invention is a silica ultrafine particle with a particle diameter of 1 to 100 nm dispersed in water or a polar solvent, also known as colloidal silica. Specific details are described in Toshiro Kagamis's applied technology of high-purity silica (Kozyundo silicano ouyou gizyutsu) 3$^{rd}$ edition, supervised by Akira Hayashi, published by CMC (1991).

The alumina which may be preferably used is hydrated alumina (boehmite) having the colloid size of 5 to 200 nm, wherein anions in water (e.g., halogen ions such as fluorine ion and chlorine ion, carboxylate anions such as acetate ion, etc.) are dispersed as the stabilizer. The titanium oxide preferably used may include those in which anatase-form or rutile-form of titanium oxide having an average primary particle diameter of 50 to 500 nm is dispersed, along with a dispersant when necessary, in water or a polar solvent.

The average primary particle diameter of the hydrophilic fine particle which can be preferably used is from 1 to 5,000 nm, and more preferably from 10 to 1,000 nm. For the hydrophilic layer according to the invention, the hydrophilic fine particles may be included singly or in combination of two or more kinds. The used amount thereof may be from 5 to 80 mass %, preferably 10 to 70 mass %, and more preferably 20 to 60 mass %, with respect to the total solid mass content in the hydrophilic layer.

The coating liquid for forming the hydrophilic layer prepared in such manner is applied onto the support and dried to form thereon a hydrophilic layer. The thickness of the hydrophilic layer may be selected depending on the purpose, but dry weight of the layer may be generally from 0.01 to 3.0 g/m$^2$, preferably from 0.01 to 1.0 g/m$^2$, and more preferably from 0.03 to 1.0 g/m$^2$. Within the above range, sufficient film strength can be obtained, as well as effects of the invention such as surface hydrophilicity, adhesiveness with the substrate, and high sensitivity can be exhibited.

Image Forming Layer

On the hydrophilic layer formed on a surface of the support above, an image forming layer is formed, thereby a planographic printing plate precursor is obtained. Any known image forming layer may be formed, but preferably an image forming layer capable of forming an image by heat mode exposure such as with an infrared laser from the viewpoint of effectiveness.

The image forming layer may have a monolayer structure or a stack structure including a plurality of layers.

Hereinbelow, some representative examples of image forming layer for use in various planographic printing plate precursors and the plate thereof are described.

Infrared Laser Recording-Type Planographic Printing Plate Precursor

A planographic printing plate precursor capable of forming (recording) an image by infrared ray exposure with the use of infrared laser, which may be preferably used for the invention, will be described. Herein, any well-known image recording mode can be arbitrarily selected, such as negative-type or positive-type image forming layer which employs a material that changes the solubility in an alkali aqueous solution by infrared laser exposure, or an image forming layer which has a hydrophobic precursor capable of forming an ink-receiving region and forms a hydrophobic region on an infrared laser exposed part may be employed.

First, the positive-type or negative-type image forming layer will be described. The image forming layer can be classified into two types of negative type and positive type. After the imagewise exposure by infrared laser, a development treatment is carried out with an alkali aqueous solution, and when the alkali developability is lowered by irradiation with an active beam thereby the irradiated (exposed) part being the image portion, this is classified as the negative type, and alternatively when the developability is increased thereby the irradiated (exposed) part being the non-image portion, this is classified as the positive type.

As the positive-type image forming layer, there are an interaction removal-type (heat sensitive positive working) image forming layer, a well-known acid catalyst degrading-type image forming layer, a o-quinonediazido compound-containing type image forming layer, and the like. In these image forming layers, a bond of a high molecular weight compound included in the layer is removed by acid or a heat energy generated from the light irradiation or heating thereby allowing the layer to be soluble in water or alkaline water to be removed by development, and thus a non-image portion is formed.

As the negative-type image forming layer, there are a well-known acid catalyst crosslinking-type (including cation polymerization) image forming layer, a polymerization cured-type image forming layer, and the like. In these image forming layers, an acid generated from the light irradiation or heating may be acted as a catalyst to bring the compound constituting the image forming layer into a crosslinking reaction thereby being cured and thus an image portion is formed, or alternatively, a polymerizable compound is brought into a polymerization reaction by a radical generated from the light irradiation or heating thereby being cured and thus an image portion is formed.

Hereinbelow, each of image forming layers will be described in detail.

1. Positive-Type Image Forming Layer

As an embodiment of the invention, there is a planographic printing plate precursor including a positive-type image forming layer which is provided with an image forming layer which has at least 50 mass % of novolak-type phenol resin (hereinafter, simply referred to as 'novolak resin') and a photothermal conversion agent and is recordable by an infrared laser. The image forming layer may be a sinble layer or may have a stack structure including a plurality of image forming layers.

Novolak-Type Phenol Resin

First, the novolak-type phenol resin will be described. The novolak resin refers to a resin obtained by a polycondensation of at least one of phenols and at least one of aldehydes and ketones in the presence of an acid catalyst.

Here, examples of phenols include for example, phenol, o-cresol, m-cresol, p-cresol, 2,5-xylenol, 3,5-xylenol, o-ethylphenol, m-ethylphenol, p-ethylphenol, propylphenol, n-butylphenol, tert-butylphenol, 1-naphthol, 2-naphthol, pyrocatechol, resorcinol, hydroquinone, pyrogallol, 1,2,4-benzenetriol, phloroglucinol, 4,4'-biphenyldiol, and 2,2-bis (4'-hydroxyphenyl)propane. Examples of aldehydes include for example, formaldehyde, acetaldehyde, propionaldehyde, benzaldehyde, and furfural. Examples of ketones include for example, acetone, methyl ethyl ketone, and methylisobutylketone.

Preferable example is a polycondensation compound of phenols selected from group consisting of phenol, o-cresol, m-cresol, p-cresol, 2,5-xylenol, 3,5-xylenol, and resorcinol, with aldehydes selected from group consisting of formaldehyde, acetaldehyde, and propionaldehyde, or ketones, particularly preferable example is a polycondensation compound of mixed phenols in which the mixing ratio of m-cresol: p-cresol: 2,5-xylenol: 3,5-xylenol: resorcinol is 40 to 100:0 to 50:0 to 20:0 to 20:0 to 20, in molar ratio, or (mixed) phenols in which the mixing ratio of phenol: m-cresol: p-cresol is 0 to 100: 0 to 70: 0 to 60, in a molar ratio, with formaldehyde.

For the novolak resin, employable are those having the weight average molecular weight in terms of polystyrene when measured with gel permeation chromatography (hereinafter, simply referred to as 'weight average molecular weight') of preferably from 500 to 20,000, more preferably from 1,000 to 15,000, and particularly preferably from 3,000 to 12,000. When the weight average molecular weight is within the above range, a sufficient film formability and excellent alkali developability in exposed part can be obtained, thus is preferable.

In the case of using the novolak resin as the binder resin of the image forming layer, single kind or a combination of two or more kinds can be employed. In addition, all the binder resin may be the novolak resin or alternatively, other resins may also be employed in combination. In the case of employing other resins in combination, it is preferable that the novolak resin is the main binder. The proportion of the novolak resin in binder resin components in the image forming layer is preferably 50 mass % or more, and more preferably from 65 to 99.9 mass %.

The binder resin which may be used in combination includes generally used alkali-soluble resins, which are insoluble in water, having an acid group on at least one of main chain and side chain of a polymer. Also, phenol resins other than the novolak resin, such as resol resins, polyvinyl phenol resins, and acryl resins having a phenolic hydroxyl group may be preferably used. Specific examples of the resin which may be used in combination include polymers described in JP-A No. 11-44956, JP-A No. 2003-167343, and the like.

Photothermal Conversion Agent

The image forming layer according to the invention preferably includes a photothermal conversion agent. The photothermal conversion agent may be used without being particularly limited by the absorption wavelength region as long as it is a substance capable of absorbing light energy of irradiated radiation to generate heat. Especially preferable substances are dyes and pigments capable of effectively absorbing IR light and having a maximum absorption in the wavelength region of 760 nm to 1200 nm, from the viewpoint of adaptability to an easily available high-power laser.

The dyes for use may be any known ones such as those commercially available and those described in literature, e.g., 'Dye Handbook' (edited by the Organic Synthetic Chemistry Association of Japan, 1970). Specific examples of the dye include azo dyes, metal complexed azo dyes, pyrazolonazo dyes, naphtoquinone dyes, anthraquinone dyes, phthalocyanine dyes, carbonium dyes, quinoneimine dyes, methine dyes, cyanine dyes, squarylium dyes, pyrylium salts, metal-thiolate complexes, oxonol dyes, diimonium dyes, aminium dyes, croconium dyes, and the like.

Examples of preferable dyes include cyanine dyes described in JP-A No. 58-125246, JP-A No. 59-84356, JP-A No. 59-202829, and JP-A No. 60-78787; methine dyes described in JP-A No. 58-173696, JP-A No. 58-181690, and JP-A No. 58-194595; naphtoquinone dyes described in JP-A No. 58-112793, JP-A No. 58-224793, JP-A No. 59-48187, JP-A No. 59-73996, JP-A No. 60-52940, and JP-A No. 60-63744; squarylium dyes described in JP-A No. 58-112792; and cyanine dyes described in British Patent No. 434,875, and the like.

Examples of preferable dyes also include near IR-absorbing sensitizers described in U.S. Pat. No. 5,156,938, substituted arylbenzo(thio)pyrylium salts described in U.S. Pat. No. 3,881,924; trimethinethiapyrylium salts described in JP-A No.57-142645 (U.S. Pat. No. 4,327,169); pyrylium compounds described in JP-A No. 58-181051, JP-A No 58-220143, JP-A No 59-41363, JP-A No 59-84248, JP-A No 59-84249, JP-A No 59-146063, and JP-A No 59-146061; cyanine dyes described in JP-A No. 59-216146; pentamethinethiopyrylium salts described in U.S. Pat. No. 4,283,475; and pyrylium compounds described in JP-B No. 5-13514 and JP-B No. 5-19702.

Still other examples of preferable dyes include near IR absorbent dyes of formulae (I) and (II) in the specification of U.S. Pat. No. 4,756,993.

Of those dyes, especially preferable dyes are cyanine dyes, phthalocyanine dyes, oxonol dyes, squarylium dyes, pyrylium salts, thiopyrylium dyes, and nickel-thiolate complexes. Further, compounds described on pages 26 to 38 in JP-A No. 2005-99685 are preferable as they are excellent in light to heat conversion efficiency. In particular, cyanine dyes represented by Formula (a) in JP-A No. 2005-99685 are most preferable as they exhibit high interaction with an alkali soluble resin when employed for an image forming layer, and also excellent stability, as well as they being economically efficient.

Degradable Dissolution Inhibitor

A degradable dissolution inhibitor may be further added for forming the image forming layer according to the invention. In particular, it is preferable to use in combination a substance (degradable dissolution inhibitor), such as an onium salt, an o-quinonediazido compound, or an alkyl ester sulfonate, which is thermally decomposable and capable of substantially lowering the solubility of an alkali soluble resin when it is in a non-decomposed state, from the viewpoint of improving the inhibiting effect with respect to dissolution of an image portion into the developer. Preferable examples of the degradable dissolution inhibitor include onium salts such as sulfonium salts, ammonium salts, diaozonium salts, and iodonium salts, and o-quinonediazido compounds. More preferred are sulfonium salts, ammonium salts, and diazonium salts.

Preferable examples of the onium salts used in the invention include ammonium salts described in the specification of U.S. Pat. Nos. 4,069,055 and 4,069,056, JP-A No. 3-140140, JP-A No. 2006-293162, and JP-A No. 2004-117546, sulfonium salts described in J. V. Crivello et al, Polymer J. 17,73 (1985), J. V. Crivello et al, J. Org. Chem., 43, 3055 (1978), W. R. Watt et al, J. Polymer Sci., Polymer Chem. Ed., 22,1789 (1984), J. V. Crivello et al, Polymer Bull., 14,279 (1985), J. V. Crivello et al, Macromorecules, 14 (5), 1141 (1981), J. V. Crivello et al, J. Polymer Sci., Polymer Chem. Ed., 17,2877 (1979), EP Pat. Nos. 370,693, 233,567, 297,443, 297,442, U.S. Pat. Nos. 4,933,377, 3,902,114, 5,041,358, 4,491,628, 4,760,013, 4,734,444, 2,833,827, DE Pat. Nos. 2,904,626, 3,604,580, 3,604,581, JP-A No. 2006-293162, and JP-A No. 2006-258979.

In addition, diazonium salts described in S. I. Sclesinger, Photogr. Sci. Eng., 18,387 (1974), T. S. Bal et al, Polymer, 21,423 (1980), general Formula (1) described in JP-A No. 5-158230, general Formula (1) described in JP-A No. 11-143064, and general Formula (1) described in JP-A No. 11-143064 can be exemplified.

The other preferable examples of the onium salts include phosphonium salts described in D. C. Necker et al, Macromolecules, 17,2468 (1984), C. S. Wen et al, Teh, Proc. Conf Rad. Curing ASIA, p 478 Tokyo, October (1988), U.S. Pat. Nos. 4,069,055 and 4,069,056, iodonium salts described in J. V. Crivello et al, Macromorecules, 10 (6), 1307 (1977), Chem. & Eng. News, November 28, p 31 (1988), EP Pat. No. 104,143, U.S. Pat. Nos. 5,041,358 and 4,491,628, JP-A No. 2-150848, and JP-A No. 2-296514, selenonium salts described in J. V. Crivello et al, Macromorecules, 10 (6), 1307 (1977), J. V. Crivello et al, J. Polymer Sci., Polymer Chem. Ed., 17,1047 (1979), and arsonium salts described in C. S. Wen et al, Teh, Proc. Conf Rad. Curing ASIA, p 478 Tokyo, October (1988).

Examples of the counter anions of the onium salts include tetrafluoroborate, hexafluorophosphate, triisopropylnaphthalensulfonate, 5-nitro-o-toluenesulfonate, 5-sulphosalicyate, 2,5-dimethylbenzensulfonate, 2,4,6-trimethylbenzensulfonate, 2-nitrobenzensulfonate, 3-chlorobenzensulfonate, 3-bromobenzensulfonate, 2-fluorocaprylnaphthalenesulfonate, dodecylbenzensulfonate, 1-naphthol-5-sulfonate, 2-methoxy-4-hydroxy-5 -benzoyl-benzensulfonate, and para-toluene sulfonate. Among these, particularly preferable are alkylaromatic sulfonates such as hexafluorophosphate, triisopropylnaphthalensulfonate, and 2,5-dimethylbenzensulfonate.

These onium salts may be used singly or in combination of plural kinds. In addition, when the image forming layer has a stack structure, the onium salts may be either added in a single layer only or in a plurality of layers. Further, the plurality of compounds may be added in in such a manner that a different compound is added in a different layer.

Preferable quinonediazides may be exemplified by an o-quinonediazide compound. The o-quinonediazide compound used in the invention is a compound having at least one o-quinonediazide group, alkali solubility of which is increased by thermal decomposition, and compound of various structures may be employed herein. That is, o-quinonediazide assists solubility of the sensitive material by both of the effects of loosing the ability of inhibiting dissolution of a binder by thermal decomposition, and o-quinonediazide itself being changed into an alkali soluble substance. As the o-quinonediazide compound used in the invention, for example, compounds described in 'Light-Sensitive Systems' written by J. KOSAR, (John Wiley & Sons. Inc.), p. 339 to 352 may be employed, but sulfonate esters or sulfonate amides of o-quinonediazide reacted with various aromatic polyhydroxy compound or aromatic amino compound are particularly preferably employed. In addition, esters of benzoquinone(1,2)-diazide sulfonate chloride or naphthoquinone-(1,2)-diazide-5-sulfonate chloride with pyrogallol-acetone resin described in JP-B No. 43-28403, and esters of benzoquinone-(1,2)-diazide sulfonate chloride or naphthoquinone-(1,2)-diazide-5-sulfonate chloride with a phenol-formaldehyde resin described in U.S. Pat. Nos. 3,046,120 and 3,188,210 may be also preferably employed.

Furthermore, esters of naphthoquinone-(1,2)-diazide-4-sulfonate chloride with phenol-formaldehyde resin or a cresol-formaldehyde resin, and esters of naphthoquinone-(1,2)-diazide-4-sulfonate chloride with pyrogallol-acetone resin may be similarly preferably employed. The other useful o-quinonediazide compound have been reported in many patents to be known, and may be exemplified by for example, those described in each specification of JP-A No. 47-5303, JP-A No. 48-63802, JP-A No. 48-63803, JP-A No. 48-96575, JP-A No. 49-38701, JP-A No. 48-13354, JP-B No. 41-11222, JP-B No. 45-9610, JP-B No. 49-17481, U.S. Pat. Nos. 2,797,213, 3,454,400, 3,544,323, 3,573,917, 3,674,495, and 3,785,825, British Pat. Nos. 1,227,602, 1,251,345, 1,267,005, 1,329,888, and 1,330,932, and DE Pat. No. 854,890.

The added amount of onium salts and/or o-quinonediazido compound serving as the degradable dissolution inhibitor is preferably from 0.1 to 10 mass %, more preferably from 0.1 to 5 mass %, and particularly preferably from 0.2 to 2 mass %, with respect to the total solid content in the image forming layer according to the invention. These compounds may be used singly or as a mixture of plural kinds.

The added amount of additives other than the o-quinonediazido compound is preferably from 0 to 5 mass %, more preferably from 0 to 2 mass %, and particularly preferably from 0.1 to 1.5 mass %. The additives and the binder which may be used in the invention are preferably included in the same layer.

A non-degradable dissolution inhibitor may also be used, and preferable examples thereof include those specifically described in JP-A No. 10-268512, such as sulfonate ester, phosphate ester, aromatic carboxylic acid ester, aromatic disulfone, carboxylic acid anhydride, aromatic ketone, aromatic aldehyde, aromatic amine, and aromatic ether; those specifically described in JP-A No. 11-190903, such as acid-color forming dye having a lactone skeleton, an N,N-diarylamide skeleton, or a diarylmethylimino skeleton and serving as a colorant; those specifically described in JP-A No. 2000-105454, such as non-ionic surfactants; and the like.

Other Additives

For the purpose of improving the image discrimination (discrimination of hydrophobicity and hydrophilicity) or increasing the resistance to scratch on a surface, a polymer described in JP-A No. 2000-187318 may also be used, which is a polymer obtained from a (meth)acrylate monomer serving as the polymerization component that has 2 or 3 perfluoroalkyl groups having 3 to 20 carbon atoms in a molecule thereof The amount of such compound to be added is preferably from 0.1 to 10 mass % and more preferably from 0.5 to 5 mass %, with respect to the total solid content in the image forming layer according to the invention.

In addition, in the image forming layer according to the invention, a compound for lowering the coefficient of static friction of the surface can be also added to impart a resistance to scratch. Specific examples of the compound include those employed in the specification of U.S. Pat. No. 6,117, 913, such as long-chained alkylcarboxylic esters, and the like. The amount of such compound to be added is preferably from 0.1 to 10 mass % and more preferably from 0.5 to 5 mass %, with respect to the total solid content in the image forming layer.

Further, the image forming layer according to the invention may also include a low-molecular weight compound having an acid group. Examples of the acid group include a sulfonate group, a carboxylate group, and a phosphate acid group. Of these, a compound having a sulfonate group is preferable. Specific examples include aromatic sulfonates such as p-toluenesulfonate and naphthalene sulfonate, and aliphatic sulfonates.

In addition, in order to further improve sensitivity, cyclic acid anhydrides, phenols, organic acids may also be employed. As the cyclic acid anhydrides, phthalic anhydride, tetrahydrophthalic anhydride, hexahydrophthalic anhydride, 3,6-endooxy-Δ4-tetrahydrophthalic anhydride, tetrachlorphthalic anhydride, maleic anhydride, chlormaleic anhydride, α-phenylmaleic anhydride, succinic anhydride, and pyromelitic anhydride, and the like described in the specification of U.S. Pat. No. 4,115,128 may be employed. As the phenols, bisphenol A, p-nitrophenol, p-ethoxyphenol, 2,4,4'-trihydroxybenzophenone, 2,3,4-trihydroxybenzophenone, 4-hydroxybenzophenone, 4,4',4"-trihydroxytriphenylmethane, and 4,4=,3",4"-tetrahydroxy-3,5,3',5'-tetramethyltriphenylmethane, and the like may be employed. Furthermore, the organic acids may be exemplified by sulfonic acids, sulfinic acids, alkyl sulfuric acids, phosphonic acids, phosphoric ester, and carboxylic acids described in JP-A No. 60-88942, JP-A No. 2-96755, and the like, and specifically exemplified by p-toluenesulfonic acid, dodecybenzenesulfonic acid, p-toluenesulfinic acid, ethylsulfuric acid, phenylphosphonic acid, phenylphosphinic acid, phenyl phosphonate, diphenyl phosphonate, benzoic acid, isophthalic acid, adipic acid, p-toluic acid, 3,4-dimethoxybenzoic acid, phthalic acid, terephthalic acid, 4-cyclohexene-1,2-dicarboxylic acid, erucic acid, lauric acid, n-undecanic acid, and ascorbic acid. When the cyclic acid anhydrides, phenols, and organic acids are added to the image forming layer, the ratio contained in the image forming layer is preferably 0.05 to 20 mass %, more preferably 0.1 to 15 mass %, and particularly preferably 0.1 to 10 mass %.

In addition, when preparing the coating liquid of the image forming layer related to the invention, in order to increase stability of treatment with respect to developing condition, there may be added nonionic surfactants described in JP-A No. 62-251740 and JP-A No. 3-208514, ampholytic surfactants described in JP-A No. 59-121044 and JP-A No. 4-13149, siloxane compounds described in EP950517, fluorine-containing monomer copolymer described in JP-A No. 11-288093, and the like.

Specific examples of the nonionic surfactants include sorbitan tristearate, sorbitan monopalmitate, sorbitan trioleate, monoglyceride stearate, and polyoxyethylenenonylphenyl ether. Specific examples of the ampholytic surfactants include alkyldi(amonoethyl)glycine, alkylpolyaminoethylglycine hydrochloride, 2-alkyl-N-carboxyethyl-N-hydroxyethylimidazolinium betaine, and N-tetradecyl-N,N-betaine type (for example, trade name 'AMOGEN K': DAI-ICHI KOGYO SEIYAKU CO., LTD.).

As siloxane compounds, a block copolymer of dimethylsiloxane and polyalkylene oxide is preferable, and specific examples include polyalkylene oxide modified silicones such as DBE-224, DBE-621, DBE-712, DBP-732, and DBP-534, manufactured by CHISSO CORPORATION, and TEGO GLIDE 100 manufactured by Tego Chemie Service.

The ratio of the nonionic surfactants and the ampholytic surfactants contained in the image forming layer is preferably 0.05 to 15 mass % and more preferably 0.1 to 5 mass %.

To the image forming layer in the invention, a printing-out agent for providing a visible image immediately after the heating due to the exposure, a dye or a pigment as a image colorant may be added.

Representative examples of printing-out agent for providing a visible image immediately after the heating due to exposure may be exemplified by a combination of a compound which releases an acid when heated due to exposure (photo-acid releasing agent) and an organic dye capable of forming a salt. Specific examples of such a printing-out agent employable herein include a combination of halogenide o-naphthoquinonediazide-4-sulfonate and a salt-forming organic dye as described in JP-A No. 50-36209 and JP-A No. 53-8128, and a combination of a trihalomethyl compound and a salt-forming organic dye as described in JP-A No. 53-36223, JP-A No. 54-74728, JP-A No. 60-3626, JP-A No. 61-143748, JP-A No. 61-151644, and JP-A No. 63-58440. As the trihalomethyl compound, an oxazole compound and a triazine compound may be exemplified, and both are excellent in stability with time and give clear printout image.

As the image colorant, dyes other than the above-mentioned salt-forming organic dyes can be used. Examples of preferable dyes including the salt-forming organic dyes include oil-soluble dyes and basic dyes. Specific examples of the dye include Oil Yellow #101, Oil Yellow #103, Oil Pink #312, Oil Green BG, Oil Blue BOS, Oil Blue #603, Oil Black BY, Oil Black BS, Oil Black T-505 (all manufactured by Orient Chemical Industry Co., Ltd.), Victoria Pure Blue, Crystal Violet (CI 42555), Methyl Violet (CI 42535), Ethyl Violet, Rhodamine B (CI 145170B), Malachite Green (CI 42000), Methylene Blue (CI 52015), particularly preferably the dyes described in JP-A No. 62-293247. These dyes can be added in a proportion of 0.01 to 10 mass %, preferably 0.1 to 3 mass % of the total solid content in the image forming layer. Further, a plasticizer can be also added, if necessary, to a coating liquid used for the image forming layer according to the invention, so as to make the coated film flexible. Examples of the plasticizer include butylphthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, and oligomers and polymers of acrylic acid or methacrylic acid.

Apart from these, an epoxy compound, vinylethers, a phenol compound having an alkoxymethyl group or a phenol compound having a hydroxymethyl group as described in JP-A No. 8-276558, a crosslinkable compound having an alkali dissolution inhibitory effect as disclosed in JP-A No. 11-160860, or the like, can be suitably added depending on the purpose.

The image forming layer according to the invention obtained in the above manner exhibits excellent film formability and film strength, as well as high alkali solubility in exposed part by infrared ray exposure.

2. Negative-Type Image Forming Layer 2-1. Polymerization Cured Layer

A polymerization cured layer is one type of the negative-type image forming layer. This polymerization cured layer includes an infrared absorbent (A), a radical generator (radical polymerization initiator) (B), and a radically polymerizable compound (C) which carries out a polymerization reaction by a radical generated thereby being cured, and preferably further includes a binder polymer (D). The infrared light absorbed by the infrared absorbent is converted to heat, and a radical polymerization initiator such as onium salt is decomposed by the heat generated upon the process thereby generating a radical. The radically polymerizable compound has at least one ethylenically unsaturated double bond, and can be selected from compounds having at least one, preferably 2 or more terminal ethylenically unsaturated bonds, which can be cured by the radical generated as it leads to a chain polymerization reaction.

2-2. Acid Crosslinked Layer

The other embodiment of the image forming layer includes an acid crosslinked layer. The acid crosslinked layer includes a compound (E) which generates an acid by light or heat (hereinafter, referred to as 'acid generator') and a compound (F) which crosslinks by the acid generated (hereinafter, referred to as 'crosslinking agent'), and further an alkali soluble polymer (G) for forming layers containing (E) and (F) which is capable of reacting with the crosslinking agent in the presence of an acid. In this acid crosslinked layer, the acid generator is decomposed by light irradiation or heating to generate acid, the generated acid enhances an action of the crosslinking agent thereby forming a firmly crosslinked constitution between crosslinking agents or between the crosslinking agent and the binder polymer, and thus the alkali solubility is lowered thereby being insoluble in a developer. In this case, the infrared absorbent (A) is incorporated in the image forming layer to effectively use the energy of infrared laser.

Infrared Absorbent (A)

The image forming layer capable of forming an image by infrared laser includes an infrared absorbent. The infrared absorbent can be used without being particularly limited by the absorption wavelength region as long as it is a substance that absorbs light energy of irradiated radiation and generates heat, which is used for recording. Especially preferable substances are dyes and pigments capable of absorbing IR light and having a maximum absorption in the wavelength region of 800 nm to 1200 nm, from the viewpoint of adaptability to an easily available high-power laser.

The dyes may be any known ones such as those commercially available and those described in literature, e.g., 'Dye Handbook' (edited by the Organic Synthetic Chemistry Association of Japan, 1970). Specific examples of the dye include azo dyes, metal complexed azo dyes, pyrazolonazo dyes, naphtoquinone dyes, anthraquinone dyes, phthalocyanine dyes, carbonium dyes, quinoneimine dyes, methine dyes, cyanine dyes, squarylium dyes, pyrylium salts, metal-thiolate complexes, and the like.

Examples of preferable dyes include cyanine dyes described in JP-A No. 58-125246, JP-A No. 59-84356, JP-A No. 59-202829, and JP-A No. 60-78787; methine dyes described in JP-A No. 58-173696, JP-A No. 58-181690, and JP-A No. 58-194595; naphtoquinone dyes described in JP-A No. 58-112793, JP-A No. 58-224793, JP-A No. 59-48187, JP-A No. 59-73996, JP-A No. 60-52940, and JP-A No. 60-63744; squarylium dyes described in JP-A No. 58-112792; and cyanine dyes described in British Patent No. 434,875, and the like.

Examples of preferable dyes include near IR-absorbing sensitizers described in U.S. Pat. No. 5,156,938, substituted arylbenzo(thio)pyrylium salts described in U.S. Pat. No. 3,881,924; trimethinethiapyrylium salts described in JP-A No.57-142645 (U.S. Pat. No. 4,327,169); pyrylium compounds described in JP-A No. 58-181051, JP-A No. 58-220143, JP-A No. 59-41363, JP-A No. 59-84248, JP-A No. 59-84249, JP-A No. 59-146063, and JP-A No. 59-146061; cyanine dyes described in JP-A No. 59-216146; pentamethinethiopyrylium salts described in U.S. Pat. No. 4,283,475; and pyrylium compounds described in JP-B No. 5-13514 and JP-B No. 5-19702. Still other examples of preferable dyes include near IR absorbent dyes of formulae (I) and (II) in the specification of U.S. Pat. No. 4,756,993.

In addition, other examples of preferable near IR absorbent dyes in the invention include specific indolenin cyanine dye described in Japanese Patent Application Nos. 2001-6326 and 2001-237840.

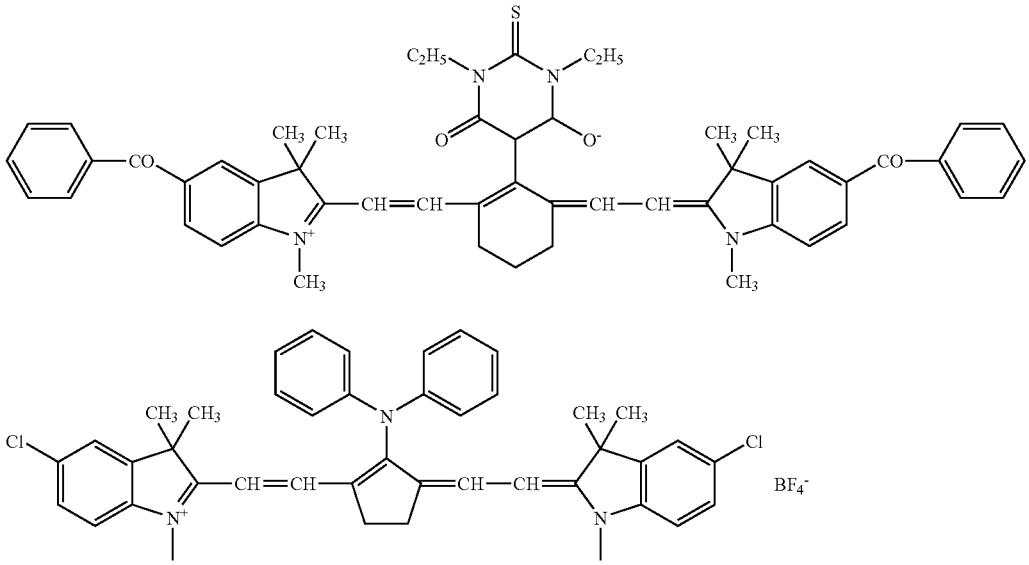

-continued

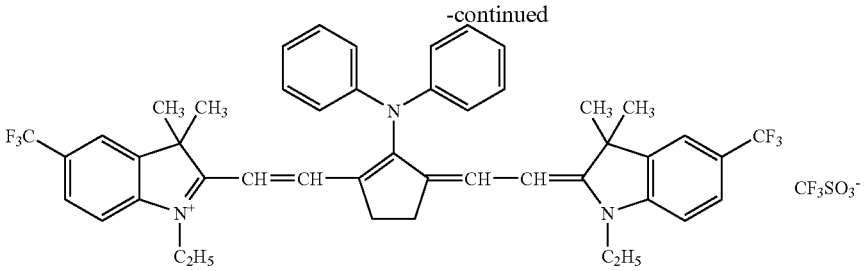

Of those dyes, cyanine dyes, squarylium dyes, pyrylium salts, nickel-thiolate complexes, and indolenincyanine dyes are preferable, and cyanine dyes and inclenine cyanine diys are more preferable, and examples of particularly preferable dyes include a cyanine dye represented by following Formula (A).

Formula (A)

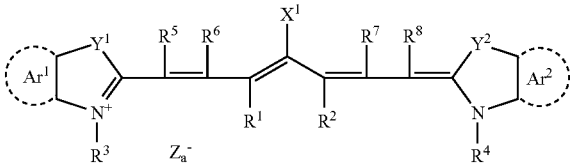

In Formula (A), $X^1$ represents a hydrogen atom, a halogen atom, —$NPh_2$, $X^2$-$L^1$, or a group represented below. Herein, $X^2$ represents an oxygen atom, a nitrogen atom, or a sulfur atom, and $L^1$ represents a hydrocarbon group having 1 to 12 carbon atoms, a heteroatom-containing aromatic ring, a heteroatom-containing hydrocarbon group having 1 to 12 carbon atoms. The hetero atom refers to N, S, O, a halogen atom, or Se. $Xa^-$ has the same meaning as $Za^-$ which will be described later, $R^a$ represents a substituent selected from a hydrogen atom, an alkyl group, an aryl group, a substituted or non-substituted amino group, and a halogen atom.

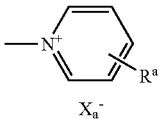

$R^1$ and $R^2$ each independently represents a hydrocarbon group having 1 to 12 carbon atoms. From the viewpoint of storage stability of a coating liquid used for the image forming layer, preferably $R^1$ and $R^2$ are each a hydrocarbon group having 2 or more carbon atoms, and particularly preferably $R^1$ and $R^2$ are bonded to each other to form a 5-membered or 6-membered ring.

$Ar^1$ and $Ar^2$, which may be the same with or different from each other, each represent an aromatic hydrocarbon group which may have a substituent. Preferable examples of the aromatic hydrocarbon group include a benzene ring and a naphthalene ring. Preferable examples of the substituent thereof include a hydrocarbon group having 12 or less carbon atoms, a halogen atom, and an alkoxy group having 12 or less carbon atoms. $Y^1$ and $Y^2$, which may be the same with or different from each other, each represent a sulfur atom or a dialkylmethylene group having 12 or less carbon atoms. $R^3$ and $R^4$, which may be the same with or different from each other, each represent a hydrocarbon group having 20 or less carbon atoms which may have a substituent. Preferable examples of the substituent thereof include an alkoxy group having 12 or less carbon atoms, a carboxyl group, and a sulfo group. $R^5$, $R^6$, $R^7$, and $R^8$, which may be the same with or different from each other, each represent a hydrogen atom or a hydrocarbon group having 12 or less carbon atoms. Of these, preferred is a hydrogen atom from the point of ingredient availability. $Za^-$ represents a counter anion, provided that $Za^-$ is not required when neutralization of electric charge is not necessary as the cyanine dye represented by Formula (A) has an anionic substituent in the structure thereof $Za^-$ is preferably a halogen ion, a perchlorate ion, a tetrafluoroborate ion, a hexafluorophosphate ion, or a sulfonate ion, and particularly preferably a perchlorate ion, a hexafluorophosphate ion, or an arylsulfonate ion, from the point of storage stability of a coating liquid for the image forming layer.

Specific examples of the cyanine dye represented by Formula (A) which can be preferably used for the invention include those described in JP-A No. 2001-133969, paragraph numbers [0017] to [0019].

Other preferable examples of the cyanine dyes include specific indolenine cyanine dyes described in JP-A No. 2002-278057.

Examples of the pigments for use in the invention include commercially available pigments and the pigments described in Color Index (C.I.) Handbook, 'Pigment Handbook' (Japan Society of pigment technologies Ed., 1977), 'State-of-the-Art Pigment Application Technologies' (CMC Publishing Co., Ltd., 1986), 'Printing Ink Technology' (CMC Publishing Co., Ltd., 1984).

Examples of the pigments include black pigments, yellow pigments, orange pigments, brown pigments, red pigments, purple pigments, blue pigments, green pigments, fluorescent pigments, metal powder pigments, as well as polymer-bound colorants. Specific examples thereof include insoluble azo pigments, azolake pigments, condensation azo pigments, chelate azo pigments, phthalocyanine pigments, anthraquinone-based pigments, perylene and perynone-based pigments, thioindigo-based pigments, quinacridone-based pigments, dioxazine-based pigments, isoindolinone-based pigments, quinophtharone-based pigments, dyed lake pigments, azine pigments, nitroso pigments, nitro pigments, natural pigments, fluorescent pigments, inorganic pigments, carbon black, and the like. Among these pigments, preferable is carbon black.

These pigments may be used either with or without being subjected to a surface treatment. Examples of the surface treatment methods include a method of coating a resin or wax on the surface of pigment; a method of attaching a surfactant thereon; a method of binding a reactive substance (e.g., silane coupling agent, epoxy compound, polyisocyanate, or the like) to the surface of pigment; and the like. The surface treatment methods above are described in 'Properties and Applications of Metal Soaps' (Saiwai Shobo), 'Printing Ink Technologies' (CMC Publishing Co., Ltd., 1984), and 'State-of-the-Art Pigment Application Technologies' (CMC Publishing Co., Ltd., 1986).

The particle diameter of the pigment is preferably in the range of 0.01 to 10 μm, more preferably of 0.05 to 1 μm, and particularly preferably of 0.1 to 1 μm, from the viewpoints of stability of the dispersed substance in a coating liquid for the image forming layer and uniformity of the image forming layer.

For dispersing a pigment, any well-known technique used for production of inks, toners, and the like may be used. Suitable dispersing machines include ultrasonic dispersing machine, sand mill, attriter, pearl mill, super mill, ball mill, impeller, disperser, KD mill, colloid mill, dynatron, three roll mill, pressurized kneader, and the like. More detailed description on such dispersing machines is described in the 'State-of-the-Art Pigment Application Technologies' (CMC Publishing Co., Ltd., 1986).

The content of the infrared absorbent in the image forming layer is preferably from 0.01 to 50 mass %, more preferably from 0.1 to 10 mass %, and most preferably from 0.5 to 10 mass %, based on the total solid mass content in the image forming layer. Within the above range, highly sensitive recording is possible, stains are not appeared in the non-image portion, and image of high quality can be formed.

Compound Generating Radical (B)

The radical generator refers to a compound which generates radicals by application of energy by light, heat, or both of them, and initiates and promotes the polymerization of the compound having a polymerizable unsaturated group. The radical generator which can be suitably used for the invention can be selected from well-known thermal polymerization initiators, compounds containing a bond having small bond dissociation energy, and the like. Examples thereof include onium salts, organic halides such as oxazole compounds and s-triazine compounds each having a trihalomethyl group, peroxides, azo-based polymerization initiators, arylazido compounds, carbonyl compounds such as benzophenones, acetophenones, and thioxantones, metallocene compounds, hexaarylbiimidazole compounds, organic borate compounds, disulfonic acid compounds, and the like.

The radical generator which can be particularly preferably used in the invention include onium salts. Especially, onium salts represented by following Formulae (B-1) to (B-3) can be preferably used.

Formula (B-1)

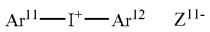

Formula (B-2)

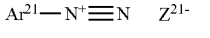

Formula (B-3)

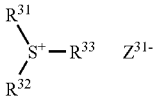

In Formula (B-1), $Ar^{11}$ and $Ar^{12}$ each independently represent an aryl group having 20 or less carbon atoms which may have a substituent. Preferable examples of the substituent in the aryl group include a halogen atom, a nitro group, an alkyl group having 12 or less carbon atoms, an alkoxy group having 12 or less carbon atoms, and an aryloxy group having 12 or less carbon atoms. $Z^{11-}$ represents an inorganic anion or an organic anion.

In Formula (B-2), $Ar^{21}$ represents an aryl group having 20 or less carbon atoms which may have a substituent. Preferable examples of the substituent include a halogen atom, a nitro group, an alkyl group having 12 or less carbon atoms, an alkoxy group having 12 or less carbon atoms, an aryloxy group having 12 or less carbon atoms, an alkylamino group having 12 or less carbon atoms, a dialkylamino group having 12 or less carbon atoms, an arylamino group having 12 or less carbon atoms, and a diarylramino group having 12 or less carbon atoms. $Z^{21-}$ represents the same counter anion referred for $Z^{11-}$.

In Formula (B-3), each of $R^{31}$, $R^{32}$, and $R^{33}$, which may be the same with or different from each other, represents an optionally substituted hydrocarbon group having 20 or less carbon atoms. Examples of the preferable substituent thereof include a halogen atom, a nitro group, an alkyl group having 12 or less carbon atoms, an alkoxy group having 12 or less carbon atoms, and an aryloxy group having 12 or less carbon atoms. $Z^{31-}$ represents the same counter ion referred for $Z^{11-}$.

$Z^{11-}$, $Z^{21-}$, and $Z^{31-}$ in above Formulae (B-1) to (B-3) each represent either an inorganic anion or an organic anion. Herein, examples of the inorganic anion include halogen ions ($F^-$, $Cl^-$, $Br^-$, $I^-$), perchlorate ions ($ClO_4^-$), perborate ions ($BrO_4^-$), tetrafluoroborate ions ($BF_4^-$), $SbF_6^-$, $PF_6^-$, and the like, and examples of the organic anion include organic borate anions, sulfonate ions, phosphate ions, carboxylate ions, $R^{40}—SO_3H^-$, $R^{40}—SO_2^-$, $R^{40}—SO_2S^-$, $R^{40}—SO_2N^-—Y—R^{40}$ ions (herein, $R^{40}$ represents a alkyl group having 1 to 20 carbon atoms or an aryl group having 6 to 20 carbon atoms, and Y represents a single bond, —CO—, or —$SO_2$—), and the like.

Specific examples of the onium salts which may be preferably used in the invention include those described in JP-A No. 2001-133696, paragraph numbers [0030] to [0033].

The onium salts which can be used in the invention preferably have a maximum absorption wavelength of 400 nm or less and more preferably 360 nm or less. By shortening the absorption wavelength into the ultraviolet region in this manner, it becomes possible to handle the planographic printing plate precursor under white light.

These onium salts may be used singly or in combination of two or more kinds.

These onium salts can be added in a proportion of 0.1 to 50 mass %, preferably 0.5 to 30 mass %, and particularly preferably 1 to 20 mass %, of the total solid content of a coating liquid for the image forming layer. Within the above range, highly sensitive recording can be achieved and staining of non-image portion upon printing can also be prevented.

These onium salts are not necessarily added in the image forming layer, and may be also added in the other layer provided near the image forming layer.

Radically Polymerizable Compound (C)

The radically polymerizable compound for use in the image forming layer of the present embodiment is a radically polymerizable compound having at least one ethylenically unsaturated double bond, and is selected from compounds having at least one, preferably two or more terminal ethylenically unsaturated bonds. These compounds are well known in the art, and any one thereof may be used without restriction in the invention. These compounds are present in various chemical forms, for example, as a monomer, a prepolymer such as dimers, trimers, or oligomer or the mixture thereof, the copolymers thereof, and the like. Examples of the monomers and the copolymers include unsaturated carboxylic acids (e.g., acrylic acid, methacrylic acid, itaconic acid, crotonic acid, isocrotonic acid, maleic acid, etc.) and the esters and amides thereof, and preferable examples include esters of an unsaturated carboxylic acid and an aliphatic polyvalent alcohol compound, and amides of an unsaturated carboxylic acid and an aliphatic polyvalent amine compound. Also preferably used are addition reaction products from an unsaturated carboxylic acid ester or amides having a nucleophilic substituent such as a hydroxyl group, an amino group, a mercapto group, or the like and a monofunctional or polyfunctional isocyanates or epoxy; and dehydration condensation products from a monofunctional or polyfunctional carboxylic acid; and the like. In addition, preferable are addition products from an unsaturated carboxylic acid ester or amides having an electrophilic substituent such as an isocyanate group, epoxy group, or the like and a monofunctional or polyfunctional alcohol, amine, or thiol; and substitution products from an unsaturated carboxylic acid ester or amide having a releasable substituent such as a halogen group, a tosyloxy group, or the like and a monofunctional or polyfunctional alcohol, amine, or thiol. Further, it is possible to use compounds wherein the unsaturated carboxylic acid above is replaced by an unsaturated phosphonic acid, styrene, or the like.

Specific examples of the radically polymerizable compound such as esters from an aliphatic polyvalent alcohol compound and an unsaturated carboxylic acid, e.g., acrylic acid esters, methacrylic acid esters, itaconic acid esters, crotonic acid esters, isocrotonic acid esters, and maleic acid esters, include those described in JP-A No. 2001-133696, paragraph numbers [0037] to [0042]. These are applicable to the invention.

Other examples of the esters include aliphatic alcohol-based esters described in JP-B No. 46-27926, JP-B No 51-47334, and JP-A No. 57-196231; compounds having an aromatic skeleton described in JP-A No. 59-5240, JP-A No. 59-5241, and JP-A No. 2-226149; compounds having an amino group described in JP-A No. 1-165613; and the like.

Specific examples of the monomers for the amides from an aliphatic polyvalent amine compound and an unsaturated carboxylic acid include methylene bis-acrylamide, methylene bis-methacrylamide, 1,6-hexamethylene bis-acrylamide, 1,6-hexamethylene bis-methacrylamide, diethylenetriamine trisacrylamide, xylylene bisacrylamide, xylylene bis-methacrylamide, and the like.

Examples of other preferable amide-based monomers include compounds having a cyclohexylene structure described in JP-B No. 54-21726.

In addition, urethane-based addition-polymerizable compounds produced by addition reaction of isocyanate and a hydroxyl group are also preferable, and specific examples thereof include vinyl urethane compounds containing two or more polymerizable vinyl groups per molecule described in JP-B No. 48-41708, which are prepared by reacting a polyisocyanate compound having two or more isocyanate groups per molecule with a vinyl monomer containing the hydroxyl group represented by following Formula (I).

$$CH_2{=}C(R^{41})COOCH_2CH(R^{42})OH \qquad \text{Formula (I)}$$

In Formula (I), $R^{41}$ and $R^{42}$ each represent H or $CH_3$)

In addition, urethane acrylates described in JP-A No. 51-37193, JP-B No. 2-32293, and JP-B No. 2-16765; and urethane compounds having an ethylene oxide skeleton described in JP-B No. 58-49860, JP-B No. 56-17654, JP-B No. 62-39417, and JP-B No. 62-39418 are also preferable.

Further, radically polymerizable compounds having an amino structure or a sulfide structure in the molecule described in JP-A No. 63-277653, JP-A No. 63-260909, and JP-A No. 1-105238 may be also used.

Other examples thereof include polyester acrylates described in JP-A No. 48-64183, JP-B No. 49-43191, and JP-B No. 52-30490, polyfunctional acrylates and methacrylates such as polyester acrylates, and epoxy acrylates obtained by reacting an epoxy resin with a (meth)acrylic acid, and the like. Further, specific unsaturated compounds described in JP-B No. 46-43946, JP-B No. 1-40337, and JP-B No. 1-40336, and vinylphosphonic acid-based compounds described in JP-A No. 2-25493 can also be exemplified. In some cases, structure including a perfluoroalkyl group described in JP-A No. 61-22048 can be preferably used. Moreover, photocurable monomers or oligomers described in Nippon Secchaku Kyokaishi (Journal of Japan Adhesion Society), Vol. 20, No. 7, pages 300 to 308 (1984) can also be used.

Detailed conditions of using these radically polymerizable compounds, for example selection of the structure, whether to be used singly or in combination, and the amount to be added, may be determined arbitrarily according to the desired final performance for recording materials. For instance, the compound is selected from the following standpoints. In view of the sensitivity, a structure having a large content of unsaturated groups per molecule is preferred and in many cases, a bifunctional or more functional compound is preferred. In order to increase the strength of image area, that is, cured layer, a trifunctional or more functional compound is preferred. A combination use of compounds different in the functional number or in the kind of polymerizable group (for example, an acrylic acid ester, a methacrylic acid ester, or a styrene compound) is also an effective method for controlling both the photosensitivity and the strength. A high-molecular weight compound or highly hydrophobic compound is advantageous in sensitivity and film strength, may be disadvantageous in some cases in development speed and in causing precipitation in the developer. Further, compatibility and dispersibility with other components (e.g., binder polymer, initiator, coloring agent, etc.) in the image forming layer are also the important factors in selecting or using the radically polymerizable compound, and for example, it is sometimes possible to increase the compatibility by using the compound of low purity or using two or more kinds of the compounds in combination. In addition, a specific structure may be selected for the purpose of improving the adhesiveness to the support, overcoat layer, and the like. With respect to the compounding ratio of the radically polymerizable compound in the image forming layer, higher ratio is advantageous in sensitivity, but when it is too high, problems may be caused such as that undesired phase separation may take place, or problem upon the production process due to adhesivity of the image forming layer (e.g., default upon production caused by adhesion and transfer of image forming layer components) or precipitation of developer may be caused.

From these points of view, a content of the radically polymerizable compound may be often from 5 to 80 mass %, preferably from 20 to 75 mass %, with respect to the total composition components. Also, these polymerizable compounds may be used alone or in combination of two or more kinds. In addition, with respect to the method using the radically polymerizable compound, the structure, composition, and addition amount of the polymerizable compound may be selected arbitrarily, considering the extent of polymerization inhibition by oxygen, resolution, fogging, change in refractive index, surface adhesiveness, and so on. Further, in some cases, a layer construction and a coating method, using, for example, an undercoat layer or an overcoat layer, and a coating method, may also be considered.

Binder Polymer (D)

In the image forming layer, a binder polymer is preferably used from the viewpoint of improving the film property of the image forming layer, and a linear organic polymer is preferably used as the binder. Herein, any linear organic polymer can be used, but a linear organic polymer which is swellable or soluble in water or weak alkaline aqueous solution is preferably used to allow water development or weak alkali development. The linear organic polymer is selectively used depending on the purpose both as the film forming agent for forming the image forming layer and as the agent for developing in water, weak alkaline solution, or organic solvent.

For example, the use of water-soluble organic polymer allows a water development. Examples of such linear organic polymer include radical polymers having a carboxylic acid group on a side chain, such as those described in JP-A No. 59-44615, JP-B No. 54-34327, JP-B No. 58-12577, JP-B No. 54-25957, JP-A No. 54-92723, JP-A No. 59-53836, and JP-A No. 59-71048, for example, methacrylic acid copolymers, acrylic acid copolymers, itaconic acid copolymers, crotonic acid copolymers, maleic acid copolymers, partially-esterified maleic acid copolymers, and the like. Additional example may also include acidic cellulose derivatives having a carboxylic acid on the side chain. In addition to those, adducts of a polymer having a hydroxyl group and a cyclic acid anhydride, and the like are also useful.

Of these, a (meth)acryl resin having any of a benzyl group, an allyl group, and a carboxyl group on the side chain is preferable from the viewpoint of excellent balance in film strength, sensitivity, and developability.

In addition, the urethane-based binder polymers containing an acid group, described in JP-B No. 7-12004, JP-B No. 7-120041, JP-B No. 7-120042, JP-B No. 8-12424, JP-A No. 63-287944, JP-A No. 63-287947, JP-A No. 1-271741, and JP-A No. 11-352691, have significantly excellent strength thus are advantageous in points of printing durability and low exposure suitability.

In addition to those, polyvinylpyrrolidone, polyethyleneoxide, and the like are also useful as the water-soluble linear organic polymer. For the purpose of increasing the strength of the cured film, an alcohol-soluble nylon, a polyether of 2,2-bis-(4-hydroxyphenyl)-propane and epichlorohydrin, and the like, are also useful.

The weight average molecular weight of the polymer for use in the invention is preferably 5,000 or more, more preferably from 10,000 to 300,000, and the number average molecular weight thereof is preferably 1,000 or more, more preferably from 2,000 to 250,000. The polydispersity index (weight average molecular weight/number average molecular weight) is preferably 1 or more, more preferably from 1.1 to 10.

The polymer may be any of a random polymer, a block polymer, and a graft polymer, but preferred is a random polymer.

The binder polymer for use in the invention may be used singly or as a mixture. The polymers are added in the image forming layer in a proportion of 20 to 95 mass %, preferably 30 to 90 mass %, of the total solid content of a coating liquid for the image forming layer. When the amount added is less than 20 mass %, strength of an image portion may become unsatisfactory upon image formation in some cases. When the amount added is more than 95 mass %, image may be formed in some cases. In addition, a proportion of the radically polymerizable compound having an ethylenically unsaturated double bond to the linear organic polymer is preferably in the range of 1/9 to 7/3 in a mass ratio.

Next, constituents of the acid crosslinked layer will be described. The infrared absorbent used herein can be the same one used for the polymerization cured-type image forming layer.

The content is preferably from 0.01 to 50 mass %, more preferably from 0.1 to 10 mass %, and most preferably from 0.5 to 10 mass %, based on the total solid mass content in the image forming layer.

Within the above range, highly sensitive recording can be achieved, as well as stains in the non-image portion for planographic printing can be controlled.

Acid Generator (E)

According to the present embodiment, an acid generator which generates acid by heat decomposition refers to a compound which generates acid either by irradiation of light in the wavelength region of 200 to 500 nm or by heating to 100° C. or above.

Examples of the acid generator include a photoinitiator for cationic photopolymerization, a photoinitiator for radical photopolymerization, an optical decolorizer for dyes, an optical discolorizer, well-known compounds which generate acids by heat decomposition such as known acid generators for use in the formation of microresist, etc., a mixture thereof, and the like.

Among the acid generators mentioned above, compounds represented by following Formulae (E-1) to (E-5) are preferable.

Formula (E-1)

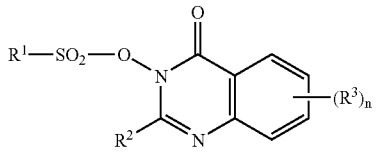

Formula (E-2)

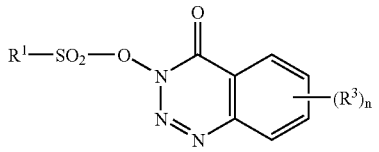

Formula (E-3)

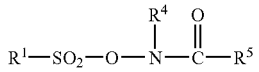

Formula (E-4)

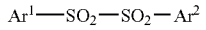

Formula (E-5)

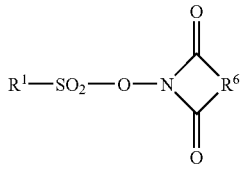

In Formulae (E-1) to (E-5), each of $R^1$, $R^2$, $R^4$, and $R^5$ may the same with or different from each other, and represents a hydrocarbon group having 20 or less carbon atoms which may have a substituent; $R^3$ represents a halogen atom, a hydrocarbon group having 10 or less carbon atoms which may have a substituent or an alkoxy group having 10 or less carbon atoms which may have a substituent; each of $Ar^1$ and $Ar^2$, which may be the same with or different from each other, represents an aryl group having 20 or less carbon atoms which may have a substituent; $R^6$ represents an divalent hydrocarbon group having 20 or less carbon atoms which may have a substituent; and n is an integer of 0 to 4.

In aforementioned Formulae, $R^1$, $R^2$, $R^4$, and $R^5$ are each preferably a hydrocarbon group having 1 to 14 carbon atoms.

Preferable embodiments of the acid generators represented by aforementioned Formulae (E-1) to (E-5) include those specifically described as the compounds of Formulae (I) to (V) in JP-A No. 2001-142230, paragraph numbers [0197] to [0222]. These compounds can be synthesized, for example, according to methods disclosed in JP-A No. 2-100054 and JP-A No. 2-100055.

In addition, onium salts in which the counter anion is a halide or sulfonic acid can be exemplified as the acid generator (E). Especially, those having any structural unit of iodonium salt, sulfonium salt, and diazonium salt represented by the following structural formulae (E-6) to (E-8) can be preferably mentioned.

Formula (E-6)

$$Ar^3—I^+—Ar^4 \quad X^-$$

Formula (E-7)

$$R^8—S^+(R^{10})—R^9 \quad X^-$$

Formula (E-8)

$$Ar^3—N_2^+ \quad X^-$$

In Formulae (E-6) to (E-8), $X^-$ represents a halide ion, $ClO_4^-$, $PF_6^-$, $SbF_6^-$, $BF_4^-$, or $R^7SO_3^-$, where $R^7$ represents a hydrocarbon group having 20 or less carbon atoms which may have a substituent; $Ar^3$ and $Ar^4$ each independently represent an aryl group having 20 or less carbon atoms which may have a substituent; and each of $R^8$, $R^9$, and $R^{10}$ represents a hydrocarbon group having 18 or less carbon atoms which may have a substituent.

Examples of such onium salts include those described as the compounds of Formulae (I) to (III) in JP-A No. 10-39509, paragraph numbers [0010] to [0035].

The amount of acid generator to be added is preferably from 0.01 to 50 mass %, more preferably from 0.1 to 25 mass %, and most preferably from 0.5 to 20 mass %, with respect to the total solid mass content in the image forming layer.

When the amount added is less than 0.01 mass %, an image may not be obtained, and when the amount added is more than 50 mass %, staining in the non-image portion may be caused upon printing.

The aforementioned acid generators may be either used singly or in combination of two or more kinds.

Crosslinking Agent (F)

Next, the crosslinking agent will be described. Examples of the crosslinking agent include the following compounds:

(i) hydroxymethyl group- or alkoxymethyl group-substituted aromatic compounds;

(ii) compounds containing any of an N-hydroxymethyl group, an N-alkoxymethyl group, and an N-acyloxymethyl group; and (iii) epoxy compounds.

Hereinbelow, compounds (i) to (iii) will be described.

Examples of the hydroxymethyl group- or alkoxymethyl group-substituted aromatic compounds (i) include heterocyclic compounds and aromatic compounds polysubstituted by any of a hydroxymethyl group, an acetoxymethyl group, and an alkoxymethyl group. In addition, examples thereof also include resin compounds known as the resol resin which are obtained by polycondensation of a phenol and an aldehyde under the basic condition.

As the heterocyclic compounds or aromatic compounds polysubstituted with any of a hydroxymethyl group and an alkoxymethyl group, compounds having a hydroxymethyl group or an alkoxymethyl group on a position adjacent to the hydroxy group are especially preferable.

In particular, as the heterocyclic compounds or aromatic compounds polysubstituted by an alkoxymethyl group, compounds in which the alkoxymethyl group has 18 or less carbon atom(s) are preferable, and compounds represented by following Formulae (F-1) to (F-4) are even more preferable.

Formula (F-1)

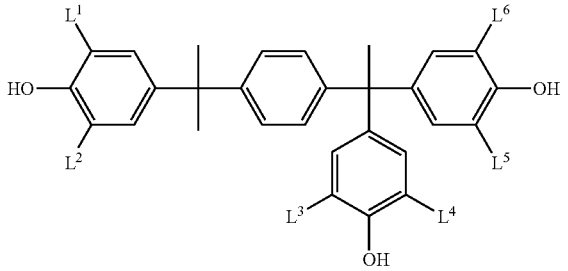

Formula (F-2)

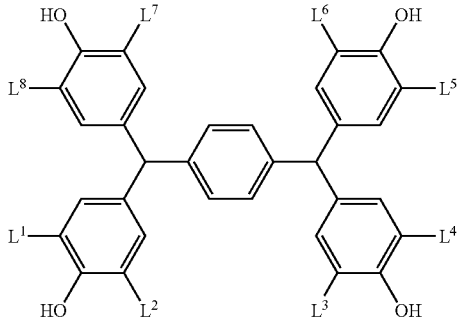

Formula (F-3)

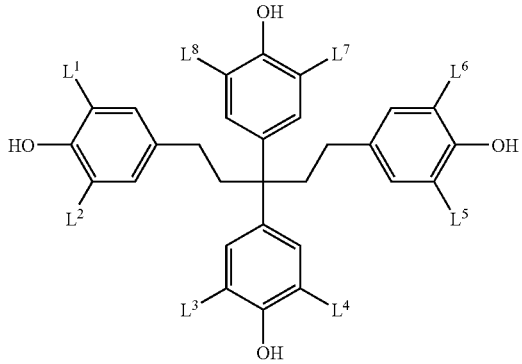

Formula (F-4)

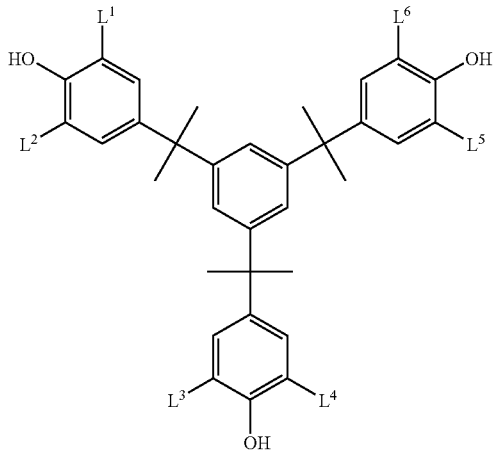

In aforementioned Formulae (F-1) to (F-4), $L^1$ to $L^8$ each independently represent an alkoxymethyl group or a hydroxymethyl group substituted by an alkoxy group having 18 or less carbon atoms, such as methoxymethyl or ethoxymethyl.

These crosslinking agents are preferable from the points of exhibiting high crosslinking efficiency and giving improved printing durability.

Examples of the compounds containing any of an N-hydroxymethyl group, an N-alkoxymethyl group, and an N-acyloxymethyl group (ii) include monomers, oligomer-melamine-formaldehyde condensates, and urea-formaldehyde condensates, described in EP-A No. 0,133,216, DE Nos. 3,634,671 and 3,711,264; alkoxy-substituted compounds described in the specification of EP-A No. 0,212,482; and the like.

Among these, preferred are melamine-formaldehyde derivatives having at least two free N-hydroxymethyl groups, N-alkoxymethyl groups, or N-acyloxymethyl groups, and most preferred is an N-alkoxymethyl derivative.

Examples of the epoxy group (iii) include epoxy compounds having at least one epoxy group which come in any form of monomer, dimer, oligomer, or polymer, for example, reaction products of bisphenol A and epichlorohydrin, reaction products of low-molecular weight phenol-formaldehyde resin and epichlorohydrin, and the like can be exemplified.

In addition to those, epoxy resins described in specifications of U.S. Pat. No. 4,026,705 and British Patent No. 1,539,192 which are already in use can be exemplified.

The amount of compounds (i) to (iii) added as the crosslinking agent is preferably from 5 to 80 mass %, more preferably from 10 to 75 mass %, and most preferably from 20 to 70 mass %, with respect to the total solid mass content in the image forming layer.

When the amount added is less than 5 mass %, durability of the image forming layer for image recording material to be obtained may deteriorate, and when the amount added is more than 80 mass %, storage stability may deteriorate.

In the invention, (iv) a phenol derivative represented by following Formula (F-5) can also be preferably used as the crosslinking agent.

Formula (F-5)

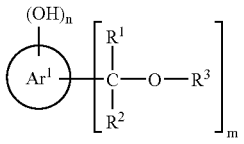

In Formula (F-5), $Ar^1$ represents an aromatic hydrocarbon ring which may have a substituent; each of $R^1$, $R^2$, and $R^3$ represents a hydrogen atom or a hydrocarbon group having 12 or less carbon atoms; m represents an integer of 2 to 4; and n represents an integer of 1 to 3.

From the point of ingredient availability, the aromatic hydrocarbon ring is preferably a benzene ring, a naphthalene ring, or an anthracene ring, and the substituent thereof is preferably a halogen atom, a hydrocarbon group having 12 or less carbon atoms, an alkoxy group having 12 or less carbon atoms, an alkylthio group having 12 or less carbon atoms, a cyano group, a nitro group, a trifluoromethyl group, or the like.

Among those described above, $Ar^1$ is more preferably a non-substituted benzene ring or naphthalene ring, or a benzene ring or naphthalene ring substituted with any of a halogen atom, a hydrocarbon group having 6 or less carbon atoms, an alkoxy group having 6 or less carbon atoms, an alkylthio group having 6 or less carbon atoms, an alkylcarbamoyl group having 12 or less carbon atoms, and a nitro group, from the point of allow making sensitivity high.

Each of the hydrocarbon groups represented by $R^1$ and $R^2$, respectively, is preferably a methyl group for the reason of simple synthesis. The hydrocarbon represented by $R^3$ is preferably a hydrocarbon group having 7 or less carbon atoms such as a methyl group or a benzyl group for the reason of high sensitivity. From the simple synthesis point of view, m is preferably 2 or 3, and n is preferably 1 or 2.

Alkali-Soluble Polymer (G)

As the alkali-soluble polymer which can be used in the crosslinked layer applicable to the invention, a novolak resin or a polymer having a hydroxylaryl group on the side chain can be exemplified. Examples of the novolak resin include resins obtained by condensation of a phenol and an aldehyde under acidic condition.

Among these, preferable examples thereof include a novolak resin obtained by a phenol and formaldehyde, a novolak resin obtained by m-cresol and formaldehyde, a novolak resin obtained by p-cresol and formaldehyde, a novolak resin obtained by o-cresol and formaldehyde, a novolak resin obtained by octylphenol and formaldehyde, a novolak resin obtained by m-/p- mixed cresol and formaldehyde, a novolak resin obtained by mixture of phenol/cresol (may be any mixture of m-, p-, o-, or m-/p-, m-/o-, o-/p-) and formaldehyde, and a high-molecular weight novolak resin having a high ortho binding rate, which is obtained by carrying out a reaction employing phenol and para-formaldehyde as the raw material without using a catalyst in a closed system under high pressure.

As the novolak resin, preferable one may be selected from those having weight average molecular weight of 800 to 300,000 and number average molecular weight of 400 to 60,000, depending on the purpose of use.

In addition, the polymer having a hydroxyaryl group on the side chain is also preferably used. Herein, as the hydroxyaryl group in the polymer, an aryl group to which at least one OH group is bonded can be exemplified.

Examples of the aryl group include a phenyl group, a naphthyl group, an anthracenyl group, a phenanthrenyl group, and the like. Among these, preferred are a phenyl group and a naphthyl group from the viewpoints of easy availability and physical properties.

As the polymer having a hydroxyaryl group on the side chain which can be used for the present embodiment, polymers having at least one of structural units represented by following Formulae (G-1) to (G-4) can be mentioned. However, the invention is not limited to these.

Formula (G-1)

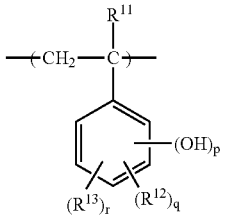

-continued

Formula (G-2)

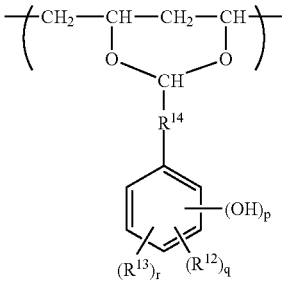

Formula (G-3)

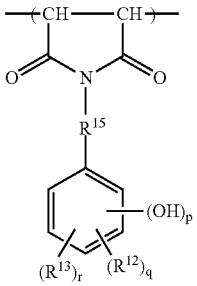

Formula (G-4)

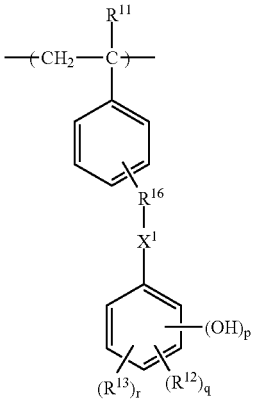

In Formulae (G-1) to (G-4), $R^{11}$ represents a hydrogen atom or a methyl group; each of $R^{12}$ and $R^{13}$, which may be the same with or different from each other, represents a hydrogen atom, a halogen atom, a hydrocarbon group having 10 or less carbon atoms, an alkoxy group having 10 or less carbon atoms, or an aryloxy group having 10 or less carbon atoms, while $R^{12}$ and $R^{13}$ may be bonded or fused to form a benzene ring or a cyclohexane ring; $R^{14}$ represents a single bond or a divalent hydrocarbon group having 20 or less carbon atoms; $R^{15}$ represents a single bond or a divalent hydrocarbon group having 20 or less carbon atoms; $R^{16}$ represents a single bond or a divalent hydrocarbon group having 10 or less carbon atoms; $X^1$ represents a single bond, an ether bond, a thioether bond, an ester bond, or an amide bond; p represents an integer of 1 to 4; and q and r each independently represents an integer of 0 to 3.

These alkali-soluble polymers are described in detail in JP-A No. 2001-142230, paragraph numbers [0130] to [0163].

The alkali-soluble polymer which can be used in the present embodiment may be either used singly or in combination of two or more kinds.

The amount of alkali-soluble polymer to be added is preferably from 5 to 95 mass %, more preferably from 10 to 95 mass %, and most preferably from 20 to 90 mass %, with respect to the total solid content in the image forming layer.

When the amount of alkali-soluble polymer to be added is less than 5 mass %, durability of the image forming layer may be deteriorated, and when the amount added is more than 95 mass %, an image may not be formed.

As the well-known recording material which is applicable to the image forming layer related to the invention, a negative image recording material containing a phenol derivative described in JP-A No. 8-276558, a negative recording material containing a diazonium compound described in JP-A No. 7-306528, a negative image recording material described in JP-A No. 10-203037 which is formed by a crosslinking reaction with a polymer having a heterocyclic group which includes an unsaturated bond in the ring, where the reaction is caused by the action of an acid catalyst, and the like, can be exemplified. The image forming layers described in those disclosures can be applied to the acid crosslinked layer as the negative image forming layer for the invention.

Other Components To such negative-type image forming layer, various compounds may be further added, in addition to the above mentioned compounds, if necessary. For example, dyes having large absorption in visible light region may be employed as colorants for image. In addition, pigments such as phthalocyanine pigments, azo pigments, carbon black, and titanium oxide may be employed.

In addition, in the invention, it is desirable that a small amount of thermopolymerization inhibitor is added, in order to inhibit undesirable thermopolymerization of the compounds having ethylenically unsaturated double bond capable of radical polymerization, during preparation of the coating liquid or during preservation of the coating liquid, when the image forming layer is the polymerization cured layer. Examples of appropriate thermopolymerization inhibitors include hydroquinone, p-methoxypheno l, di-t-butyl-p-cresol, pyrogallo l, t-butylcatechol, benzoquinone, 4,4'-thiobis(3-methyl-6-t-butylphenol), 2,2'-methylenebis(4-methyl-6-t-butylphenol), and N-nitroso-N-phenylhydroxylamine aluminum salts. The additional amount of the thermopolymerization inhibitor is preferably about 0.01 to 5% by mass relative to the mass of total composition. Furthermore, in order to prevent inhibition of polymerization due to oxygen, higher fatty acid derivatives such as behenic acid, behenic acid amide may be added to be distributed on the surface of the image forming layer, in the process of drying after coating, if necessary. The additional amount of the higher fatty acid derivative is preferably about 0.1 to 10% by mass relative to the mass of total composition.

The coating liquid for image forming layer according to the invention may contain any of nonionic surfactants described in JP-A No. 62-251740 and JP-A No. 3-208514, and ampholytic surfactants described in JP-A No. 59-121044 and JP-A No. 4-13149, for the purpose of increasing the stability in processing treatment with respect to conditions for development.

Specific examples of the nonionic surfactants include sorbitan tristearate, sorbitan monopalmitate, sorbitan trioleate, stearic monoglyceride, polyoxyethylene nonylphenyl ether, and the like.

Specific examples of the ampholytic surfactants include alkyldi(aminoethyl)glycine, alkylpolyaminoethylglycine hydrochloride, 2-alkyl-N-carboxyethyl-N-hydroxyethylimidazolinium betaine, N-tetradecyl-N,N-betaine (e.g., trade name: AMOGEN K, manufactured by Daiichi Kogyo Co., Ltd.), and the like.

The amount of the nonionic surfactant or the ampholytic surfactant used in the coating liquid for image forming layer is preferably from 0.05 to 15 mass %, more preferably from 0.1 to 5 mass %.

If desired, the coating liquid for image forming layer according to the invention may also contain a plasticizer for the purpose of making the coated film flexible. Examples of the plasticizer include polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, and the like.

3. Hydrophobic Precursor-Containing Image Forming Layer

As the image forming layer applicable to the planographic printing plate precursor of the invention, a heat-sensitive image forming layer which contains a compound (hereinafter, simply referred to as 'hydrophobic precursor') capable of forming a hydrophobic region by application of heat or irradiation of radiation can be exemplified. Such image forming layer contains a compound capable of forming an image portion i.e., hydrophobic region (inkphilic region) by application of heat which leads particles of the compounds to fuse with each other or, in the case of the microcapsules, leads substances inside the microcapsules to undergo chemical reaction, thereby forming the hydrophobic region. Examples of such compound included in the image forming layer include (a) thermo-reactive functional group-containing polymer particles, (b) micro capsules encapsulating a thermo-reactive functional group-containing compound, and the like. Since the compounds are preferably dispersed in the hydrophilic binder, the on-press development can be adopted, that is, after forming an image (exposure), the planographic printing plate precursor is mounted on a cylinder of the printer without having been subjected to any specific development so as to carry out on-press development by supplying water and/or ink.

The image forming layer include (a) thermo-reactive functional group-containing polymer particles, or (b) microcapsules encapsulating a thermo-reactive functional group-containing compound.

Examples of the thermo-reactive functional group presenting both in (a) and (b) include ethylenically unsaturated groups undergoing polymerization reaction (e.g., an acryloyl group, a methacryloyl group, a vinyl group, an allyl group); isocyanate groups undergoing addition reaction, and their blocked groups, and functional groups having an active hydrogen atom which are reaction partner groups of the isocyanate groups or their blocked groups (e.g., an amino group, a hydroxyl group, a carboxyl group); epoxy groups undergoing addition reaction, and their reaction partners such as an amino group, a carboxyl group, or a hydroxyl group; carboxyl groups undergoing condensation with hydroxyl or amino group, and their reaction partners; and acid anhydrides undergoing ring-opening addition reaction with amino or hydroxyl group, and their reaction partners. However, the thermo-reactive functional group for use in the invention is not limited thereto, and any and every functional group undergoing any type of reactions is acceptable herein as long as it forms some chemical bond.

Thermo-Reactive Functional Group-Containing Polymer Particles (a)

Examples of the thermo-reactive functional group suitable for the polymer particles (a) include an acryloyl group, a methacryloyl group, a vinyl group, an allyl group, an epoxy group, an amino group, a hydroxyl group, a carboxyl group, an isocyanate group, an acid anhydride group, and their protecting groups. Introduction of the functional group into the polymer particles may be effected during polymerization to obtain the polymer, or by proceeding polymer reaction for the group after the polymerization.

When the thermo-reactive functional group is introduced during polymerization to obtain the polymer, it is preferable that an emulsion polymerization or suspension polymerization is carried out with the use of a monomer having a thermo-reactive functional group.

Specific examples of the monomer having a thermo-reactive functional group include allyl methacrylate, allyl acrylate, vinyl methacrylate, vinyl acrylate, glycidyl methacrylate, glycidyl acrylate, 2-isocyanatoethyl methacrylate and its blocked isocyanates which is blocked with alcohol or the like, 2-isocyanatoethyl acrylate and its blocked isocyanates which are blocked with alcohol or the like, 2-aminoethyl methacrylate, 2-aminoethyl acrylate, 2-hydroxyethyl methacrylate, 2-hydroxyethyl acrylate, acrylic acid, methacrylic acid, maleic anhydride, difunctional acrylates, and difunctional methacrylates. However, the monomer having a thermo-reactive functional group which can be used in the invention is not limited to these.

Examples of the monomers not having the thermo-reactive functional group, which are copolymerizable with the aforementioned monomers, include styrene, alkyl acrylates, alkyl methacrylates, acrylonitrile, and vinyl acetate, but the monomer not having the thermo-reactive functional group which can be used in the invention is not limited to these.

The polymer reaction for introducing the thermo-reactive functional group after the polymerization to obtain polymer is described, for example, in WO96/34316A.

Among the thermo-reactive functional group-containing polymer particles (a), those readily fuse to or aggregate with each other by application of heat are preferable from the viewpoint of image formability, and particularly those having hydrophilic surfaces and capable of dispersing in water are preferable from the viewpoint of on-press developability. Further, when the polymer particles only is applied and dried at a temperature lower than the solidifying temperature of the particles to prepare a film, it is preferable that the contact angle of the formed film (to a water drop in air) is smaller than the contact angle of a film (to a water drop in air) prepared by being dried at a temperature higher than the solidifying temperature of the particles.

In order for the surface hydrophilicity of the polymer particles to satisfy such the preferable condition, a hydrophilic polymer or oligomer such as those of polyvinyl alcohol or polyethylene glycol, or a hydrophilic low-molecular compound can be adsorbed in the surfaces of the polymer particles. However, the method of hydrophilicating the surfaces of the particles is not limited thereto, and any known surface-hydrophilicating methods are employable for the purpose.

The thermo-fusing temperature of the thermo-reactive functional group-containing polymer particles (a) is preferably at least 70° C., more preferably at least 80° C. in view of stability over time. However, if the thermo-fusing temperature of the polymer particles is too high, it is unfavorable from the viewpoint of sensitivity thereof. Therefore, the thermo-fusing temperature of the polymer particles is preferably from 80 to 250° C., more preferably from 100 to 150° C.

The average particle size of the polymer particles (a) is preferably from 0.01 to 20 μm, more preferably from 0.05 to 2.0 μm, most preferably from 0.1 to 1.0 μm. Within the range, excellent image resolution and stability over time can be obtained.

The amount of polymer particles (a) added is preferably from 50 to 98 mass %, more preferably from 60 to 95 mass %, with respect to the solid content in the image forming layer.

Microcapsules Encapsulating Thermo-Reactive Functional Group-Containing Compound (b)

As the thermo-reactive functional group suitable for the compound to be encapsulated into microcapsules, those already mentioned for the functional groups present both in (a) and (b) can be exemplified. Examples thereof include a polymerizable unsaturated group, a hydroxyl group, a carboxyl group, a carboxylate group, an acid anhydride group, an amino group, an epoxy group, an isocyanate group, a blocked isocyanate group, and the like.

The compound having a polymerizable unsaturated group is preferably a compound having at least one, more preferably at least two of ethylenically unsaturated bonds such as an acryloyl group, a methacryloyl group, a vinyl group, and an allyl group. These compounds are well known in the industrial field, and any of them may be employed in the invention without particular limitation. These compounds are present in various chemical structures, for example in the form of monomer, prepolymer such as dimer, trimer, or oligomer, or the mixture thereof, and the copolymer thereof.

Specifically, for example, unsaturated carboxylic acids (for example, acrylic acid, methacrylic acid, itaconic acid, crotonic acid, isocrotonic acid, and maleic acid), and esters and unsaturated carboxylic amides thereof may be exemplified. Among these, preferred are esters and amides of an unsaturated carboxylic acid with an aliphatic polyvalent amine.

Further, there may be also employed addition reaction products of an unsaturated carboxylic ester or unsaturated carboxylic amide having a nucleophillic substituent such as a hydroxyl group, an amino group, and a mercapto group, with a monofunctional or polyfunctional isocyanate or epoxide, and reaction products from dehydration condensation of an unsaturated carboxylic ester or unsaturated carboxylic amide having a nucleophilic substituent such as a hydroxyl group, an amino group, and a mercapto group, with a mono functional or polyfunctional carboxylic acid.

Furthermore, there may be also preferable addition reaction products of an unsaturated carboxylic ester or unsaturated carboxylic amide having an electrophilic substituent such as isocyanate group or epoxy group, with a monofunctional or polyfunctional alcohol, amine or thiol, and reaction products from substitution reaction of an unsaturated carboxylic ester or unsaturated carboxylic amide having an elimination substituent such as a halogen group and tosyloxy group, with a monofunctional or polyfunctional alcohol, amine or thiol.

As other preferable examples, the above compounds in which the unsaturated carboxylic acids are substituted with an unsaturated phosphonic acid or chloromethylstyrene, may be exemplified.

Specific examples of these compounds are described in JP-A No. 2001-27742, paragraph numbers [0014] to [0035], and a production method for microcapsules encapsulating these compounds is described in detail in the same application, paragraph numbers [0036] to [0039]. These disclosures are applicable to the invention.

The microcapsule walls which are suitable for the microcapsules (b) have a three-dimensional crosslinked structure, and they can swell in solvents. Therefore, the wall material for the microcapsule is preferably polyurea, polyurethane, polyester, polycarbonate, polyamide, or a mixture thereof, particularly preferably polyurea or polyurethane. Also, a compound having a thermo-reactive functional group may be introduced into the microcapsule walls.

The average particle size of the microcapsules (b) is preferably from 0.01 to 20 μm, more preferably from 0.05 to 2.0 μm, particularly preferably from 0.10 to 1.0 μm. Within the range, excellent image resolution and stability with time can be obtained.

The image forming mechanism employing microcapsules having thermo-reactive functional groups (b) may be any type, as long as any of the microcapsule material, the compound contained in the microcapsules, and other optional components that exist in the image forming layer containing the microcapsules dispersed therein, can react to form an image portion which is a hydrophobic region (inkphilic region). Examples of such mechanism include a type wherein the microcapsules fuse to each other when heat is applied as described above; a type wherein a chemical reaction takes place due to heat by a compound among the encapsulated compounds oozed on the outer surfaces of the microcapsules or completely oozed through the microcapsules in a coating step, or by an outer compound penetrated into the microcapsule walls; a type wherein the microcapsule material and/or the encapsulated compound reacts with a hydrophilic resin added or a low-molecular compound added; a type wherein at least two different types of microcapsule wall materials or at least two different types of compounds to be encapsulated are prepared such that they have different functional groups capable of undergoing thermal reaction with each other, and used in combination so that the micro capsules can react with each other; and the like.

Accordingly, the thermal fusion of microcapsules due to heat is preferable for image formation but is not essential in the invention.

The amount of microcapsules (b) to be added to image forming layer is preferably from 10 to 60 mass %, more preferably from 15 to 40 mass % in terms of the solid content. Within the above range, excellent on-press developability, as well as excellent sensitivity and printing durability can be obtained.

In case where the microcapsules (b) are added to the image forming layer, a solvent capable of dissolving the compound encapsulated and capable of swelling the capsule wall material may be added to the dispersant of the microcapsules. The solvent promotes the diffusion of the encapsulated, thermo-reactive functional group-containing compound, out of the microcapsules.

The solvent may be selected depending on the dispersing medium for the microcapsules, the wall material for the microcapsules, the wall thickness, and the contents of the microcapsules, and the solvent may be readily selected from various commercially available products. For example, for water-dispersible microcapsules wherein the walls are made of crosslinked polyurea or polyurethane, the solvent is preferably selected from alcohols, ethers, acetals, esters, ketones, polyalcohols, amides, amines, fatty acids, and the like.

A solvent which can not be dissolved in the microcapsule dispersion by itself, but can be dissolved therein when the solvent is combined with other solvent mentioned above may also be used. The amount of the solvent to be added is determined depending on a combination of other materials. However, if the amount of the solvent is lower than an appropriate amount, the image formation may become unsatisfactory; but if too large, stability of the dispersion may deteriorate. In general, the amount of the solvent is preferably from 5 to 95 mass %, more preferably from 10 to 90 mass %, and even more preferably from 15 to 85 mass % of the coating liquid.

Other Components

The heat-sensitive image forming layer according to the present embodiment may also include other various additives depending on the purpose, in addition to the thermo-reactive functional group-containing polymer particles (a) or the microcapsules encapsulating a thermo-reactive functional group-containing compound (b) each having image forming property.

Reaction Initiator and Reaction Promoter

A compound having the ability to initiate or promote the reaction of the thermo-reactive functional group-containing compound may be added to the heat-sensitive image forming layer. Examples of the compound which can initiate or promote the reaction include compounds that generate a radical or cation due to heat. Specific examples thereof include lophine dimers, trihalomethyl compounds, peroxides, azo compounds, onium salts such as diazonium salts or diphenyliodonium salts, acylphosphines, and imidosulfonates.

These compounds may be added in the amount of preferably 1 to 20 mass %, more preferably 3 to 10 mass %, of the solid content in the image forming layer. Within the above range, excellent reaction initiation effect or reaction promoting effect can be achieved without deteriorating the on-press developability.

Hydrophilic Resin

A hydrophilic resin may be also added in the heat-sensitive image forming layer for the invention, so as to provide excellent on-press developability, as well as improved film strength of the heat-sensitive image forming layer.

As the hydrophilic resin, those having a hydrophilic group such as hydroxyl, carboxyl, hydroxymethyl, hydroxypropyl, amino, aminoethyl, aminopropyl, carboxymethyl, or the like, are preferable.

Specific examples of the hydrophilic resin include gum arabic, casein, gelatin, starch derivatives, carboxymethyl cellulose and sodium salts thereof, cellulose acetate, sodium alginate, vinyl acetate-maleic acid copolymers, styrene-maleic acid copolymers, polyacrylic acids and salts thereof, polymethacrylic acid and salts thereof, homopolymers and copolymers of hydroxyethyl methacrylate, homopolymers and copolymers of hydroxyethyl acrylate, homopolymers and copolymers of hydroxypropyl methacrylate, homopolymers and copolymers of hydroxypropyl acrylate, homopolymers and copolymers of hydroxybutyl methacrylate, homopolymers and copolymers of hydroxybutyl acrylate, polyethylene glycols, hydroxypropylene polymers, polyvinyl alcohols, hydrolyzed polyvinyl acetates having a degree of hydrolysis of at least 60% by mass, and preferably at least 80% by mass, polyvinylformals, polyvinylbutyrals, polyvinylpyrrolidones, homopolymers and copolymers of acrylamide, homopolymers and copolymers of methacrylamide, homopolymers and copolymers of N-methylolacrylamide.

The amount of the hydrophilic resin to be added to the thermosensitive image forming layer is preferably from 5 to 40 mass %, and more preferably from 10 to 30 mass % of the solid content in the image forming layer. Within the range, excellent on-press developability and film strength can be obtained.

Since such thermoresponsive image forming layer (heat-sensitive image forming layer) is treated through scanning exposure to IR laser light or the like to form an image, the infrared absorbent (A) may be included in the image forming layer. The amount added is preferably from 1 to 30 mass %, more preferably from 5 to 25 mass %, of total solid content of a coating liquid for the image forming layer. When the content is within the above range, the image forming layer excellent in sensitivity and image forming property can be obtained.

The image forming layer containing the hydrophobic precursor can be formed by applying a coating liquid onto a hydrophilic surface of the support, where the coating liquid is prepared by dissolving or dispersing the necessary components as above in a solvent. The solid content concentration of the coating liquid for forming the image forming layer is preferably from 1 to 50 mass %.

Other Planographic Printing Plate Precursors

The invention can be also preferably employed in IR laser recording-type planographic printing plate precursor. Hereinbelow, examples of the IR laser recording-type planographic printing plate precursor and an image forming layer employed therein will be described in detail.

1. Positive-Type Image Forming Layer

As the positive-type image forming layer, the known positive-type image forming layers (a) and (b) shown below can be preferably used.

(a) A conventional positive-type image forming layer containing naphthoquinone diazide and a novolak resin.

(b) A positive-type chemical sensitized image forming layer containing a combination of an alkali-soluble compound protected with an acid-decomposable group and an acid generator.

The layers (a) and (b) are well known in this field of art, and it is more preferable that they are used in combination with the following positive-type image forming layers (c) to (f).

(c) Apositive-type laser-sensitive image forming layer disclosed in JP-A No. 10-282672, which contains a sulfonate ester polymer and an infrared absorbent and is capable of forming a planographic printing plate requiring no developing treatment.

(d) A positive-type laser-sensitive image forming layer disclosed in EP No. 652,483 and JP-A No. 6-502260, which contains a carboxylate ester polymer and an acid generator or an infrared absorbent and is capable of forming a planographic printing plate requiring no developing treatment.

(e) A positive-type laser-sensitive image forming layer disclosed in JP-A No. 11-095421, which contains an alkali-soluble compound and a substance that is heat-decomposable and substantially decreases the solubility of the alkali-soluble compound when the substance is in a non-decomposed state.

(f) An alkali-developable elution type positive image forming layer, which contains an infrared absorbent, a novolak resin, and a dissolution inhibitor, and is capable of forming an alkali-developable elusion type positive planographic printing plate.

2. Negative-Type Image Forming Layer

As the negative-type image forming layer, the known negative-type image forming layers (g) to (l) shown below can be employed in the invention.

(g) A negative-type image forming layer containing a polymer having a photo-crosslinkable group and an azide compound.

(h) A negative-type image forming layer disclosed in JP-A No. 59-101651, which contains a diazo compound.

(i) A photopolymerizable negative-type image forming layer disclosed in U.S. Pat. No. 262,276 and JP-A No. 2-63054, which contains a photopolymerization initiator and an addition-polymerizable unsaturated compound.

(j) A negative-type image forming layer disclosed in JP-A No. 11-095421, which contains an alkali-soluble compound, an acid generator, and an acid crosslinkable compound.

(k) A laser-sensitive negative composition disclosed in JP-A No. 2000-122272, which contains a sulfonyl acetate polymer and an infrared absorbent and is capable of forming a planographic printing plate requiring no developing treatment.

(l) An image forming layer composition disclosed in Japanese Patent No. 2,938,397, wherein thermoplastic hydrophobic polymer particles are dispersed in a hydrophilic binder polymer; an on-press developing-type image forming layer composition disclosed in JP-A No. 2001-277740, which employs microcapsules containing a thermo-reactive compound.

The planographic printing plate precursor of the invention can be prepared by forming an image forming layer on a support by applying a coating liquid, where the coating liquid is prepared by dissolving the components required for forming the image forming layer in a solvent. In the planographic printing plate precursor, a protective layer, a resinous hydrophilic layer, an undercoat layer, a back coat layer, or the like may also be formed depending on the purpose, in addition to the image forming layer.

Examples of the solvent usable herein includes ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethyl sulfoxide, sulforane, γ-butyrolactone, toluene, and the like. In addition, in the case of employing a water-soluble image forming layer, water or an aqueous solvent such as alcohols can be used. However, the solvent used in the invention is not limited thereto, and may be suitably selected according to the property of the image forming layer. These solvents may be used either singly or in combination.

The concentration of the components (total solid content including additives) in the solvent is preferably from 1 to 50 mass %.

The coating amount applied on the support (in terms of the solid content) in dry weight may vary depending on the use thereof, but it is general that the preferable weight is from 0.5 to 5.0 g/m$^2$ with respect to the photosensitive printing plate. As the coating amount decreases, although the appeared sensitivity increases, film properties of the photosensitive film deteriorate.

As the coating method, various methods can be employed. For example, employable are bar coating, spin coating, spraying, curtain coating, dipping, air knife coating, blade coating, roll coating, and the like.

As above, since the planographic printing plate precursor of the invention is provided with a hydrophilic layer having high hydrophilicity and excellent stability thereof, after the image formation, improved staining resistance of the non-image portion upon printing even in a severe condition can be exhibited and a large number of prints of high quality can be obtained.

EXAMPLES

Hereinbelow, the present invention will be described in detail with reference to Examples, but the scope of the invention is not limited to these Examples.

Synthesis Example

Synthesis of Specific Hydrophilic Polymer (1-7)

Dimethylsulfoxide (30 g) was put into a 500-ml three-necked flask, and then stirred with heating at 80° C. under a nitrogen flow. Thereto, a mixed solution of acrylamide (14.2 g, 0.20 mol), (3-acrylamidepropyl)trimethylammonium chloride (13.78 g, 0.05 mol), mercaptopropyltrimethoxy silane (1.22 g, 6.25 mmol), 2,2-azobis(2,4-dimethylvaleronitrile) (155 mg, 0.66 mmol), and dimethylsulfoxide (30 g) was added dropwise over 1 hour. After the dropwise addition, the mixture was stirred for 6 hours under heating. After the reaction, the reaction solution was left to cool to room temperature, and then put into acetonitrile (2L). The precipitated solid was taken by filtration, and washed with acetonitrile to obtain Specific Hydrophilic Polymer: Exemplary Compound (1-7). The dry mass weight of the polymer was 25.4 g.

Other specific hydrophilic polymers of the invention were also synthesized in the same manner.

Example 1

-Thermal Positive-Type Planographic Printing Plate Precursor-

Preparation of Support

An aluminum plate (material: 1050) having a thickness of 0.3 mm was degreased by washing it with trichloroethylene. Thereafter, a surface of the plate was sand-grained with the use of a nylon brush and an aqueous suspension of a 400-mesh pumiston, and then washed well with water. This plate was etched by dipping the plate in a 25 mass % aqueous solution of sodium hydroxide at 45° C. for 9 seconds, then washed with water, dipped in 2 mass % nitric acid for 20 seconds, and further washed with water. Through the process, the etched amount of the sand-grained surface was about 3 g/m$^2$.

Next, a direct current anodic oxide film having a thickness of 2.4 g/m$^2$ was formed on the plate by using 7 mass % sulfuric acid as an electrolytic solution and a current density of 15 A/dm$^2$. The plate was then washed with water and dried to obtain an aluminum support.

Thereafter, the aluminum support was immersed in a treatment bath containing 1 mass % aqueous solution of No. 3 sodium silicate at a temperature of 30° C. for 10 seconds, thereby effecting silicate treatment. Thereafter, water washing by spraying using well water was performed. Thereupon, a silicate adhering amount was 3.6 mg/m$^2$.

Formation of Hydrophilic Layer

The components shown below were uniformly mixed, and stirred at 20° C. for 2 hours for hydrolysis to take place. As the result, a sol-like Coating liquid Composition 1 was obtained.

| Coating liquid Composition 1 | |
|---|---|
| Specific Hydrophilic Polymer: Exemplary Compound (1-7) | 0.21 g |
| ethanol | 4.70 g |
| water | 4.70 g |
| aqueous solution of nitric acid (1 N) | 0.10 g |

The above Coating liquid Composition 1 was applied onto the aluminium support to give a dry weight of 0.1 g/m$^2$, and dried at 120° C. for 10 minutes with heating to form thereon a hydrophilic layer, thereby obtaining Support for planographic printing plate 1.

The contact angle (to a water drop in air) of the surface of the hydrophilic layer on Support for planographic printing plate 1 thus formed was measured with CA-Z (manufactured by Kyowa Kaimen Kagaku Co., Ltd.), which was 7°. This result confirms that the excellent hydrophilicity is exhibited.

Formation of Image Forming Layer

The image forming layer was formed on Support for planographic Printing Plate 1 according to the method below to obtain Positive-type Planographic Printing Plate Precursor 101 of Example 1.

That is, Coating Liquid for positive-type Image Forming Layer 1 shown below was applied using a bar coater, and dried in PERFECT OVEN PH200 manufactured by TABAI ESPEC CORP., at 130° C. for 50 seconds to provide an image forming layer with a dry weight of 1.3 g/m$^2$. Thereafter, Coating Liquid for positive-type Image Forming Layer 2 shown below was applied using a bar coater, and dried in PERFECT OVEN PH200 manufactured by TABAI ESPEC CORP., at 130° C. for 60 seconds to provide an image forming layer with a dry weight of 0.26 g/m$^2$, thereby forming a positive-type image forming layer having a multi-layered constitution.

| Coating Liquid for positive-type Image Forming Layer 1 | |
|---|---|
| N-(4-aminosulfonylphenyl)methacrylamide/acrylonitrile/methyl methacrylate copolymer (36/34/30 in mass %: weight average molecular weight of 50,000, acid value of 2.65) | 1.9 g |
| m/p cresol novolak (m/p = 6/4, weight average molecular weight of 4,500, containing 0.8 mass % unreacted cresol) | 0.3 g |
| Cyanine Dye A (structure shown below) | 0.13 g |
| 4,4'-bishydroxyphenylsulfone | 0.13 g |
| tetrahydrophthalic anhydride | 0.19 g |
| p-toluenesulfonic acid | 0.008 g |
| 3-methoxy-4-diazo diphenylamine hexafluorophosphate | 0.032 g |
| Compound in which a counter ion of ethyl violet is changed to 6-hydroxy-2-naphthalenesulfonate ion | 0.078 g |
| Fluorine-based Surfactant (methyl ethyl ketone 30%, MEGAFACE F-780, manufactured by DAINIPPON INK AND CHEMICALS, INCORPORATED) | 0.2 g |
| methyl ethyl ketone | 16.0 g |
| 1-methoxy-2-propanol | 8.0 g |
| γ-butyrolactone | 8.0 g |

Cyanine Dye A

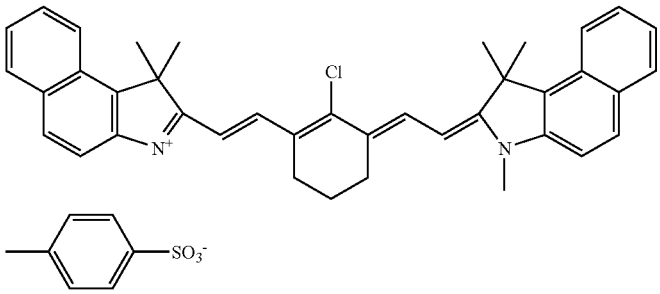

| Coating Liquid for positive-type Image Forming Layer 2 | |
|---|---|
| phenol/m/p cresol novolak (phenol/m/p = 5/3/2, mass average molecular weight of 5,000, containing 0.8 mass % unreacted cresol) | 0.27 g |
| Acrylic Resin B (structure shown below) | 0.042 g |
| Cyanine Dye A (structure shown above) | 0.019 g |
| long-chain alkyl group-containing Polymer F (structure shown below) | 0.042 g |
| Sulfonium salt Compound C (structure shown below) | 0.065 g |
| Ammonium Compound D (structure shown below) | 0.004 g |
| Fluorine-based Surfactant (methyl ethyl ketone 30%, MEGAFACE F-780, manufactured by DAINIPPON INK AND CHEMICALS, INCORPORATED) | 0.02 g |
| Fluorine-based Surfactant E (structure shown below) (methyl ethyl ketone 60%) | 0.032 g |
| methyl ethyl ketone | 13.0 g |
| 1-methoxy-2-propanol | 7.0 g |

Acrylic Resin B Mw 50,000

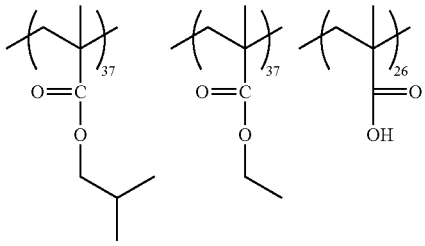

-continued

Coating Liquid for positive-type Image Forming Layer 2

Sulfonium Compound

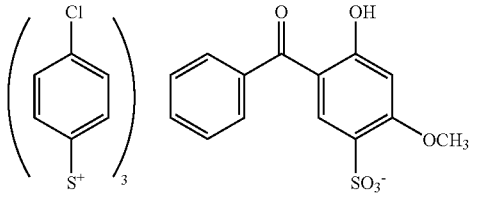

Ammonium Compound D

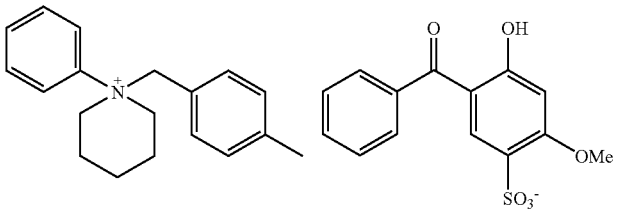

Fluorine-based Surfactant E

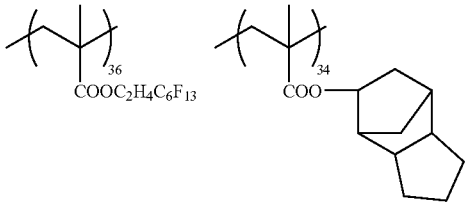

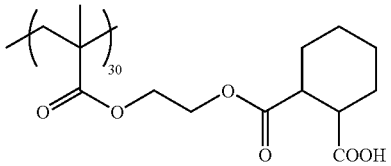

Mw 16,000

Long-chain alkyl group-containing Polymer F

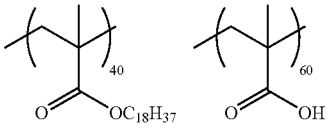

Weight average molecular weight: 66,000

Exposure, Development Treatment, and Evaluation

The obtained planographic printing plate precursor was exposed to high power laser with the use of TREND SETTER 3244VFS manufactured by Creo Corp., at a number of revolution of drum of 150 rpm by altering the exposure energy. Next, a developer DT-2 (1:8 dilution) manufactured by FUJIFILM and a finisher FG-1 (1:1 dilution) manufactured by FUJIFILM were charged into an AUTOMATIC PROCESSOR LP-940H manufactured by FUJIFILM, and subjected to a development treatment under conditions of a developer temperature of 32° C. and a developing period of 12 seconds. The conductance of the developer was 43 mS/cm. After the development, the planographic printing plate was placed and printing was started using a printer RISURON 226 manufactured by KOMORI Corporation.

The film reduction of the image forming layer before and after the development was evaluated by measuring the density on the image forming layer using a REFLECTING DENSITOMETER D19C manufactured by X-rite.

Those showing almost none film reduction were ranked as A, those showing a slight film reduction but in the acceptable level were ranked as B, those difficult to be used for commercial purpose were ranked as C, and those with almost no image forming layer left were ranked as D. The results are shown in Table 1.

Printing and Evaluation

A staining resistance of Positive-type Planographic Printing Plate Precursor 101, and also a staining resistance thereof when left unattended were evaluated in the following manner. The results are shown in Table 1.

1. Evaluation of Staining Resistance

Printing was performed with the printer using a black ink, DIC-GEOS (N), manufactured by DAINIPPON INK AND CHEMICALS, INCORPORATED, to give 10,000 prints. Thereafter, blanket staining was evaluated by visual observation.

The staining resistance was evaluated into 4 grades of A to D, wherein those showing least staining were ranked as A while those showing most staining being ranked as D. The results are shown in Table 1.

A: No Staining

B: Staining cannot be confirmed by visual observation (within a degree that can be confirmed by a magnifier)

C: Partly stained

D: Completely stained

2. Evaluation of Staining Resistance when Left Unattended

For this evaluation, 10,000 prints were printed, the plate was left for 1 hour, and then printing was restarted. A blanket staining in the non-image portion was evaluated by visual observation.

The same evaluation standard as in the above evaluation of staining resistance was employed. The results are shown in Table 1.

Examples 2 to 5

-Thermal Positive-Type Planographic Printing Plate Precursor-

Formation of Hydrophilic Layer

The components shown below were uniformly mixed, and stirred at 20° C. for 2 hours for hydrolysis to take place. As the result, a sol-like Coating liquid Composition 2 was obtained.

| Coating liquid Composition 2 | |
|---|---|
| Specific Hydrophilic Polymer: Exemplary Compound shown in Table 1 below | 0.21 g |
| tetramethoxysilane | 0.63 g |
| ethanol | 4.70 g |
| water | 4.70 g |
| aqueous solution of nitric acid (1 N) | 0.10 g |

The above Coating liquid Composition 2 was applied onto the aluminium support prepared in Example 1 to give a dry weight of 0.2 g/m$^2$, and dried at 120° C. for 10 minutes with heating to form thereon a hydrophilic layer, thereby obtaining Supports for planographic printing plate 2 to 5.

The contact angle (to a water drop in air) of the surface of the hydrophilic layer on each of Supports for planographic printing plate thus formed was measured with CA-Z (manufactured by Kyowa Kaimen Kagaku Co., Ltd.), which was 10° or less as shown in Table 1 below. This result confirms that the excellent hydrophilicity is exhibited.

The positive-type image forming layer as in Example 1 was provided on each of Supports for planographic printing plate 2 to 5, to obtain Positive-type Planographic Printing Plate Precursors 102 to 105 of Examples 2 to 5, respectively.

Comparative Examples 1 and 2

A Support for planographic printing plate 6 was prepared in the same manner as in Example 1, except that a coating liquid in which the Specific Hydrophilic Polymer was excluded from the Coating liquid Composition 2 was used. The same positive-type image forming layer as in Example 1 was provided on Support 6 to obtain Positive-type Planographic Printing Plate Precursor C-101 of Comparative Example 1.

Positive-type Planographic Printing Plate Precursor C-102 of Comparative Example 2 was also obtained in the same manner as in Example 1, except that Coating liquid Composition 1 was not applied on the aluminum support and thus Support for printing plate 7 having no hydrophilic layer was used.

Evaluation

Obtained Planographic Printing Plate Precursors 102 to 105 of Examples 2 to 5, respectively, and Planographic Printing Plate Precursors C-101 and C-102 of Comparative Examples 1 and 2, respectively were subjected to exposure and development as in Example 1 to measure the film reduction caused by the development.

Thereafter, printing was also performed as in Example 1, and staining resistance and staining resistance when left unattended were evaluated. The results are shown in Table 1.

TABLE 1

| | | | Hydrophilic Layer | | | | Evaluation Results | | |
|---|---|---|---|---|---|---|---|---|---|
| | Planographic printing plate precursor | Support | Specific Hydrophilic Polymer | Polymer/ TMOS mass ratio | Coating amount (g/m$^2$) | Contact angle (degree) | Film reduction by development | Staining resistance | Staining resistance when left unattended |
| Example 1 | 101 | 1 | 1-7 | 100/0 | 0.2 | 7 | B | A | A |
| Example 2 | 102 | 2 | 1-7 | 25/75 | 0.2 | 8 | A | A | A |
| Example 3 | 103 | 3 | 1-12 | 25/75 | 0.2 | 8 | A | A | A |
| Example 4 | 104 | 4 | 2-1 | 25/75 | 0.2 | 8 | A | A | A |
| Example 5 | 105 | 5 | 2-10 | 25/75 | 0.2 | 7 | A | A | A |
| Comparative example 1 | C-101 | 6 | — | — | 0.2 | 8 | B | D | D |
| Comparative example 2 | C-102 | 7 | — | — | — | 12 | B | D | D |

As is clear from Table 1, it is understood that Planographic Printing Plate Precursor C-101 of Comparative Example 1, which includes a support having a hydrophilic layer formed from an inorganic component with no specific hydrophilic polymer, shows deteriorated staining resistance. Further, it is understood that Planographic Printing Plate Precursor C-102 of Comparative Example 2, which includes a support having no hydrophilic layer, also shows deteriorated staining resistance.

On the other hand, it is understood that each of Planographic Printing Plate Precursors 101 to 105 of Examples 1 to 5, respectively, which includes a hydrophilic layer employing a specific hydrophilic polymer according to the present invention on a support, shows no film reduction due to the development, as well as excellent staining resistance.

From these results, it is confirmed that the planographic printing plate precursor of the invention provides excellent prints with no stain on a non-image portion.

Examples 6 to 10 and Comparative Examples 3 and 4

-Thermal Positive-type Planographic Printing Plate Precursor-

Coating liquid for positive-type image forming layer 3 of the composition shown below was prepared. The coating liquid was applied onto Supports for planographic printing plate 1 to 7 used in Examples 1 to 5 and Comparative Examples 1 and 2 to give a dry weight of 1.7 g/m$^2$, and these were dried to form thermal positive-type image forming layers, thereby obtaining Positive-type Planographic Printing Plate Precursors 201 to 205, C-201, and C-202.

| Coating Liquid for Positive-type Image Forming Layer 3 | |
|---|---|
| novolak resin (m-cresol/p-cresol = 60/40, mass average molecular weight of 7,000, containing 0.5 mass % unreacted cresol) | 1.0 g |
| Infrared Absorbent (above Cyanine Dye A) | 0.1 g |
| tetrahydrophthalic anhydride | 0.05 g |
| p-toluenesulfonic acid | 0.002 g |
| Compound in which a counter ion of ethyl violet is changed to 6-hydroxy-β-naphthalenesulfonic acid | 0.02 g |

-continued

| Coating Liquid for Positive-type Image Forming Layer 3 | |
|---|---|
| Fluorine-based Surfactant (MEGAFACE F-177, manufactured by DAINIPPON INK AND CHEMICALS, INCORPORATED) | 0.05 g |
| methyl ethyl ketone | 12 g |

Exposure, Development Treatment, and Evaluation

The obtained planographic printing plate precursors 201 to 207 were exposed imagewise with the use of TREND SETTER 3244 manufactured by Creo Corp., which was equipped with a semiconductor laser that emits 830 nm light with beam diameter of 17 μm (1/e$^2$), output power 500 mW, at a main scanning rate of 5 m/sec and with the energy on the precursor surface of 140 mJ/cm$^2$.

Thereafter, a development treatment was subjected to obtain planographic printing plates with the use of an alkaline developer prepared by adding 1 g of $C_{12}H_{25}N(CH_2CH_2COONa)_2$ to 1 L of an aqueous solution containing 5.0 mass % of a potassium salt including a combination of non-reducing sugar and base i.e., D-sorbit/potassium oxide $K_2O$, and 0.015 mass % of OLEFIN AK-02 (manufactured by Nisshin Chemical Co., Ltd). The development treatment was carried out under conditions of a development temperature of 30° C. and a developing period of 12 seconds with the use of AUTOMATIC PROCESSOR PS900NP manufactured by FUJIFILM which had been filled with the alkaline developer. After the development treatment, further treatment with a washing step with water was carried out using gum (FP-2W (1:1)) or the like.

The film reduction of the image forming layer before and after the development was evaluated in the same manner as in Example 1. The results are shown in Table 2.

Printing and Evaluation

A staining resistance of Planographic Printing Plates obtained above, and also a staining resistance thereof when left unattended, were evaluated in the same manner as in Example 1. The results are shown in Table 2.

TABLE 2

| | | | Hydrophilic layer | | | | Evaluation Results | | |
|---|---|---|---|---|---|---|---|---|---|
| | Planographic printing plate precursor | Support | Specific hydrophilic polymer | Polymer/TMOS mass ratio | Coating amount (g/m$^2$) | Contact angle (degree) | Film reduction by development | Staining resistance | Staining resistance when left unattended |
| Example 6 | 201 | 1 | 1-7 | 100/0 | 0.2 | 7 | A | A | A |
| Example 7 | 202 | 2 | 1-7 | 25/75 | 0.2 | 7 | A | A | A |
| Example 8 | 203 | 3 | 1-12 | 25/75 | 0.2 | 8 | A | A | A |
| Example 9 | 204 | 4 | 2-1 | 25/75 | 0.2 | 7 | A | A | A |
| Example 10 | 205 | 5 | 2-10 | 25/75 | 0.2 | 8 | A | A | A |
| Comparative Example 3 | C-201 | 6 | — | — | 0.2 | 8 | B | D | D |
| Comparative Example 4 | C-202 | 7 | — | — | — | 12 | B | D | D |

From the results in Table 2, it is confirmed that each of Planographic Printing Plate Precursors of Examples 6 to 10 shows no film reduction due to the development, and also that they provide excellent prints with no stain on a non-image portion.

Examples 11 to 15 and Comparative Examples 5 and 6

-Thermal Negative-type Planographic Printing Plate Precursors-

A Coating liquid for negative-type image forming layer 1 of the composition shown below was prepared. The coating liquid was applied onto Supports for planographic printing plate 1 to 7 used in Examples 1 to 5 and Comparative Examples 1 and 2 to give a dry weight of 1.7 g/m$^2$, and these were dried to form thermal negative-type image forming layers, thereby obtaining Negative-type Planographic Printing Plate Precursors 301 to 305, C-301, and C-302.

| Coating Liquid for Negative-type Image Forming Layer 1 | |
|---|---|
| Infrared Absorbent (Cyanine Dye A shown above) | 0.07 g |
| Acid Generator [SH-1] (structure shown below) | 0.3 g |
| Crosslinking Agent [KZ-1] (structure shown below) | 0.5 g |
| alkali-soluble polymer (MARUKA LYNCUR-MS-4P, manufactured by Maruzen Petrochemical Co., Ltd.) | 1.5 g |
| naphthalenesulfonate of Victoria Pure Blue (manufactured by Hodogaya Chemical Co., LTD.) | 0.035 g |
| Fluorine-based Surfactant (MEGAFACE F-177, manufactured by DAINIPPON INK AND CHEMICALS, INCORPORATED) | 0.01 g |
| phthalic anhydride | 0.05 g |
| methyl ethyl ketone | 12 g |
| methanol | 10 g |
| 1-methoxy-2-propanol | 4 g |
| 3-methoxy-1-propanol | 4 g |

[SH-1]

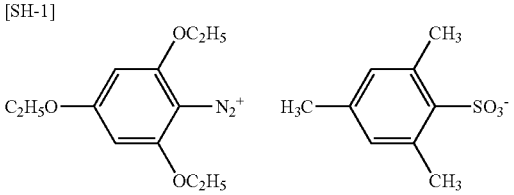

[KZ-1]

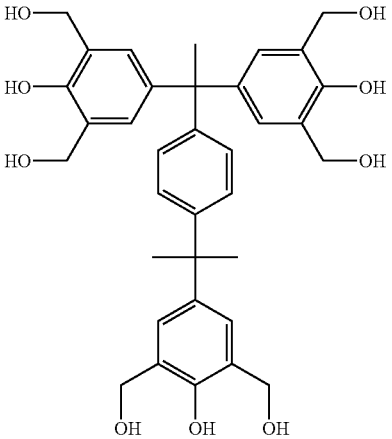

Exposure and Development Treatment

Obtained Negative-type Planographic Printing Plate Precursors 301 to 307 were exposed with the use of TREND SETTER 3244VFS manufactured by Creo Corp., which was equipped with water-cooling type 40W IR semiconductor laser. The exposure was performed under conditions of the output power of 9W, a number of revolution of outer drum of 210 rpm, the energy on the precursor surface of 100 mJ/cm$^2$, and the resolution of 2400 dpi. After the exposure, a heat treatment was carried out in an oven (manufactured by WISCONSIN OVEN) at 288° F. for 75 seconds, followed by a development treatment using an AUTOMATIC PROCESSOR LP-940H manufactured by FUJIFILM, to obtain planographic printing plates. A developer used was an aqueous 1:8 diluted solution of DP-4 manufactured also by FUJIFILM while the temperature of a developing bath was set to 30° C., and a finisher used was an aqueous 1:1 diluted solution of FP-2W manufactured also by FUJIFILM.

Printing and Evaluation

A printing durability of each of planographic printing plates obtained by above exposure and development were evaluated in the following manner. The results are shown in Table 3.

The obtained planographic printing plate was placed and printing was started using a printer RISURON manufactured by KOMORI Corporation and ink of DIC-GEOS (N) BLACK, manufactured by DAINIPPON INK AND CHEMICALS, INCORPORATED. The number of prints given up till the point where a density of a solid image is started to get lower which is confirmed visually, was set as an index. For the evaluation results, the number of prints from the Planographic Printing Plate obtained in Example 11 was used as the standard (100), and other Planographic Printing Plates were assessed with reference to that standard for a comparative assessment of printing durability thereof It means that the larger value indicates more excellent sensitivity.

The staining resistance and the staining resistance when left unattended were evaluated in the same manner as in Example 1. The results are shown in Table 3 below.

TABLE 3

| | | | Hydrophilic layer | | | | Evaluation Results | | |
|---|---|---|---|---|---|---|---|---|---|
| | Planographic printing plate precursor | Support | Specific hydrophilic polymer | Polymer/ TMOS mass ratio | Coating amount (g/m$^2$) | Contact angle (degree) | Printing Durability | Staining resistance | Staining resistance when left unattended |
| Example 11 | 301 | 1 | 1-7 | 100/0 | 0.2 | 7 | 100 | A | A |
| Example 12 | 302 | 2 | 1-7 | 25/75 | 0.2 | 7 | 100 | A | A |
| Example 13 | 303 | 3 | 1-12 | 25/75 | 0.2 | 8 | 100 | A | A |
| Example 14 | 304 | 4 | 2-1 | 25/75 | 0.2 | 7 | 100 | A | A |
| Example 15 | 305 | 5 | 2-10 | 25/75 | 0.2 | 8 | 100 | A | A |
| Comparative Example 5 | C-301 | 6 | — | — | 0.2 | 8 | 60 | D | D |
| Comparative Example 6 | C-302 | 7 | — | — | — | 12 | 70 | D | D |

From the results in Table 3, it is confirmed that each of Planographic Printing Plate Precursors of Examples 11 to 15 is excellent in printing durability, and also that they provide excellent prints with no stain on a non-image portion.

Examples 16 to 20 and Comparative Examples 7 and 8

-Thermal Negative-type (Microcapsule-type) Planographic Printing Plate Precursor- Synthesis of Microcapsule (1)

As the oil-phase component, 5 g of xylene diisocyanate adduct (TAKENATE D-110N, manufactured by Mitsui Takeda Chemical Industries, Ltd.), 3.8 g of 4,4'-diphenylmethanediisocyanate oligomer (MIRIONATE MR-200, manufactured by Nippon Polyurethane Co., Ltd.), 4 g of a vinyloxy compound of the structure below, 1.5 g of an infrared absorbent dye of the structure below, and 0.1 g of PIONIN A-41-C (manufactured by Takemoto Yushi Co., Ltd.), were dissolved in 18 g of ethyl acetate.

As the aqueous-phase component, 40 g of 4 mass % aqueous solution of PVA-205 was prepared. The oil-phase component and the aqueous-phase component were mixed, and emulsified using a homogenizer at 12,000 rpm for 10 minutes. The obtained emulsified product was added to 25 g of 5% aqueous solution of tetraethylene pentaamine, and the mixture was stirred at room temperature for 30 minutes and then further stirred at 40° C. for 3 hours. A Microcapsule Liquid (1) thus obtained was diluted with distilled water to give a solid content concentration of 20 mass %. The average particle size of the microcapsule was 0.34 μm.

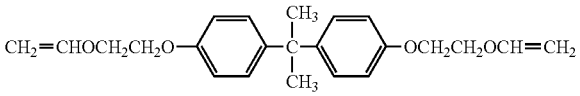

Vinyloxy Compound

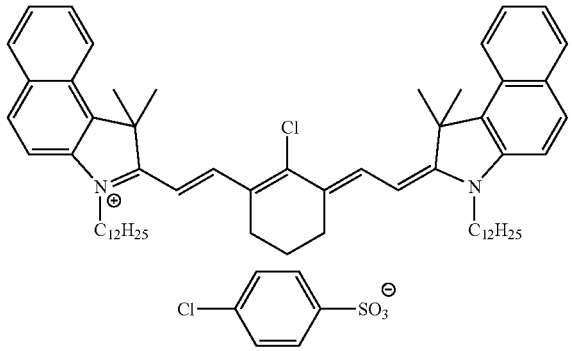

Infrared Absorbent Dye

Formation of Hydrophilic Layer

The components shown below were uniformly mixed, and stirred at 20° C. for 2 hours for hydrolysis to take place. As the result, a sol-like Coating liquid Composition 3 was obtained.

| Coating liquid Composition 3 | |
|---|---|
| Specific Hydrophilic Polymer: Exemplary Compound (1-7) | 0.21 g |
| tris(acetylacetone)aluminum | 0.01 g |
| methanol | 4.70 g |
| water | 4.70 g |

Thereafter, the above Coating liquid Composition 3 was applied onto the aluminum support prepared in Example 1 to give a dry weight of 0.2 g/m$^2$, and dried at 120° C. for 1 minute with heating to form thereon a hydrophilic layer, thereby obtaining Support for planographic printing plate 8.

Further, Supports for planographic printing plate 9 to 12 were obtained in the same manner as for Support for planographic printing plate 8, except that Coating liquid Composition 4 shown below was used.

| Coating liquid Composition 4 | |
|---|---|
| Specific Hydrophilic Polymer: Exemplary Compound shown in Table 4 below | 0.21 g |
| tetramethoxysilane | 0.63 g |
| tris(acetylacetone)aluminum | 0.01 g |
| methanol | 4.70 g |
| water | 4.70 g |

Further, Support for planographic printing plate 13 was obtained in the same manner as for Supports for planographic printing plate 9 to 12, except that the coating liquid in which the Specific Hydrophilic Polymer was excluded from the Coating liquid Composition 4 was used.

Also, the aluminum support as in Example 1 onto which Coating liquid Composition 3 was not applied was obtained as a support having no hydrophilic layer, such to give Support for planographic printing plate 14.

The contact angle (to a water drop in air) of the surface of the hydrophilic surface of each of supports obtained herein was measured with CA-Z, manufactured by Kyowa Kaimen Kagaku Co., Ltd. The results are shown in Table 4.

Formation of Image Forming Layer

A Coating Liquid for microcapsule-type image forming layer 1 of the composition shown below was prepared. The coating liquid was applied onto Supports for planographic printing plates 8 to 14 thus obtained to give a dry weight (coating amount of recording layer) of 1.0 g/m$^2$, and these were dried to form microcapsule-type image forming layers, thereby obtaining Microcapsule-type Planographic Printing Plate Precursors 401 to 405, C-401, and C-402.

| Coating Liquid for microcapsule-type image forming layer 1 | |
|---|---|
| Microcapsule Liquid (1) obtained by above synthesis | 25 g |
| Acid Precursor of the structure below | 0.5 g |
| water | 75 g |

Acid Precursor

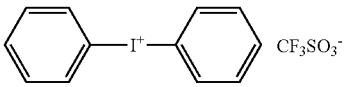

Exposure and Development Treatments, and Evaluation

Obtained microcapsule-type Planographic Printing Plate Precursors 401 to 405, C-401, and C-402 were exposed with the use of Trend Setter 3244VFS manufactured by Creo Corp., which was equipped with water-cooling type 40W IR semiconductor laser. The exposure was performed under conditions of the energy on the precursor surface of 300 mJ/cm$^2$, and the resolution of 2400 dpi. After the exposure, without development, the exposed precursor was mounted on a cylinder of a printer SOR-M, manufactured by Heidelberg Co., and dampening water was supplied followed by ink to start printing. The dampening water used was 4% solution of IF-102 manufactured by FUJIFILM, and the ink used was VALEUS Black manufactured by DAINIPPON INK AND CHEMICALS, INCORPORATED.

As a result, a non-image portion on the recording layer was removed by dampening water while printing was carried out for several prints, and thus on-press development was achieved in all planographic printing plate precursors without any problem. Herein, from the start of on-press development, the number of sheet used for staining on a non-image portion of prints to be removed was referred to as 'number of sheet for on-press development', and the number of sheet was indicated in Table 4. It means that smaller value of 'number of sheet for on-press development' indicates more excellent on-press developability.

-Evaluation of Printing Durability-

Obtained Planographic Printing Plate Precursors 401 to 405, C-401, and C-402 were exposed with the use of Trend Setter 3244VFS manufactured by Creo Corp., under conditions of the energy on the precursor surface of 300 mJ/cm$^2$ and the resolution of 2400 dpi. After the exposure, without development, printing was performed using a printer RISURON manufactured by KOMORI Corporation and a black ink DIC-GEOS (N) manufactured by DAINIPPON INK AND CHEMICALS, INCORPORATED. The number of prints given up till the point where a density of a solid image is started to get lower which is confirmed visually, was set as an index. For the evaluation results, the number of prints from the Planographic Printing Plate obtained in Example 16 was used as the standard (100), and other Planographic Printing Plates were assessed with reference to that standard for a comparative assessment of printing durability thereof The results are shown in Table 4.

-Evaluation of Staining Resistance and Staining Resistance when Left Unattended- For Planographic Printing Plate Precursors 401 to 405, C-401, and C-402, printing was performed after the exposure as in the evaluation of printing durability above, using a printer RISURON manufactured by KOMORI Corporation and a black ink DIC-GEOS (N) manufactured by DAINIPPON INK AND CHEMICALS, INCORPORATED. The staining resistance and the staining resistance when left unattended were evaluated in the same manner as in Example 1. The results are shown in Table 4 below.

From the results in Table 4, it is found that all of Planographic Printing Plate Precursors of Examples 16 to 20 are excellent in on-press developability and printing durability, and also that they provide excellent prints with no stain on a non-image portion. Accordingly, it is confirmed that high hydrophilicity is maintained on a non-image portion of planographic printing plate employing the support for planographic printing plate of the invention. It is also believed that since the adhesiveness between the hydrophilic layer and the image forming layer is excellent, excellent printing durability is exhibited.

Examples 21 to 25 and Comparative Examples 9 and 10

-Thermal Negative-type (Microcapsule-type) Planographic Printing Plate Precursor- Formation of Hydrophilic Layer The components shown below were uniformly mixed, and stirred at 20° C. for 2 hours for hydrolysis to take place. As the result, a sol-like Coating liquid Composition 5 was obtained.

| Coating liquid Composition 5 | |
|---|---|
| Specific Hydrophilic Polymer: Exemplary Compound (1-7) | 0.21 g |
| tris(acetylacetone)aluminum | 0.01 g |
| methanol | 4.70 g |
| water | 4.70 g |

Thereafter, the above Coating liquid Composition 5 was applied onto the aluminum support prepared in Example 1 to give a dry weight of 0.2 g/m$^2$, and dried at 120° C. for 1 minute with heating to form thereon a hydrophilic layer, thereby obtaining Support for planographic printing plate 15.

Further, Supports for planographic printing plate 16 to 19 were obtained in the same manner as for Support for planographic printing plate 15, except that Coating liquid Composition 6 shown below was used.

TABLE 4

| | | | Hydrophilic layer | | | | Evaluation Results | | | |
|---|---|---|---|---|---|---|---|---|---|---|
| | Planographic printing plate precursor | Support | Specific hydrophilic polymer | Polymer/ TMOS mass ratio | Coating amount (g/m$^2$) | Contact angle (degree) | number of sheet for on-press development | Printing durability | Staining resistance | Staining resistance when left unattended |
| Example 16 | 401 | 8 | 1-7 | 100/0 | 0.2 | 7 | 20 | 100 | A | A |
| Example 17 | 402 | 9 | 1-7 | 25/75 | 0.2 | 7 | 20 | 100 | A | A |
| Example 18 | 403 | 10 | 1-12 | 25/75 | 0.2 | 8 | 20 | 100 | A | A |
| Example 19 | 404 | 11 | 2-1 | 25/75 | 0.2 | 7 | 20 | 100 | A | A |
| Example 20 | 405 | 12 | 2-10 | 25/75 | 0.2 | 6 | 20 | 100 | A | A |
| Comparative Example 7 | C-401 | 13 | — | — | 0.2 | 8 | 25 | 65 | D | D |
| Comparative Example 8 | C-402 | 14 | — | — | — | 12 | 30 | 85 | D | D |

| Coating liquid Composition 6 | |
|---|---|
| Specific Hydrophilic Polymer: Exemplary Compound shown in Table 5 below | 0.21 g |
| tetramethoxysilane | 0.63 g |
| tetraethoxysilane | 0.01 g |
| acetylacetone | 0.02 g |
| methanol | 4.70 g |
| water | 4.70 g |

Further, Support for planographic printing plate 20 was obtained in the same manner as for Supports for planographic printing plates 16 to 19, except that the coating liquid in which the Specific Hydrophilic Polymer was excluded from the Coating liquid Composition 6 was used.

Also, the aluminum support as in Example 1 onto which the application of Coating liquid Composition 5 was not carried out was obtained as a support having no hydrophilic layer, such to give Support for planographic printing plate 21.

The contact angle (to a water drop in air) of the surface of the hydrophilic layer on each of supports obtained herein was measured with CA-Z, manufactured by Kyowa Kaimen Kagaku Co., Ltd. The results are shown in Table 5.

Formation of Image Forming Layer

A Coating Liquid for microcapsule-type image forming layer 2 of the composition shown below was prepared. The coating liquid was applied onto Supports for planographic printing plate 15 to 21 thus obtained to give a dry weight of 1.0 g/m$^2$, and these were dried to form microcapsule-type image forming layers, thereby obtaining Microcapsule-type Planographic Printing Plate Precursors 501 to 505, C-501, and C-502.

| Coating Liquid for microcapsule-type image forming layer 2 | |
|---|---|
| Binder Polymer (1) shown below | 0.162 g |
| Infrared Absorbent Dye (1) shown below | 0.020 g |
| Polymerization Initiator (1) shown below | 0.100 g |
| Polymerizable Monomer | 0.385 g |
| (ARONIX M-215 (trade name), manufactured by TOAGOSEI CO., LTD.) | |
| Fluorine-based Surfactant (1) shown below | 0.044 g |
| methyl ethyl ketone | 1.091 g |
| propylene glycol monomethyl ether | 8.609 g |
| Microcapsule Liquid (2) | |
| microcapsule (2) shown below | 2.640 g |
| (in terms of solid content) | |
| water | 2.425 g |

Binder polymer (1)

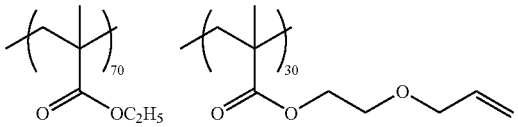

Polymerization Initiator (1)

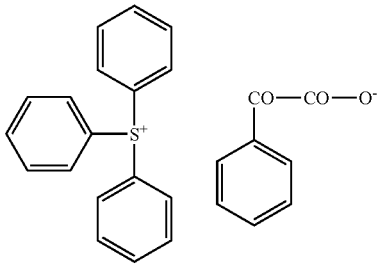

Infrared Absorbent (1)

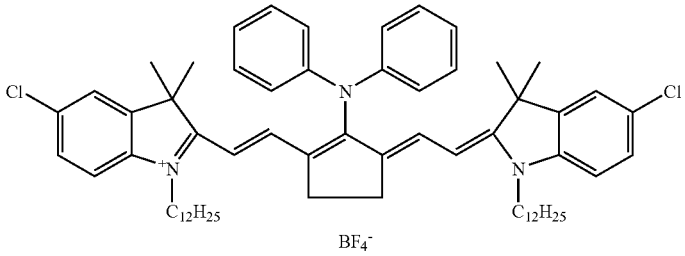

-continued

Coating Liquid for microcapsule-type image forming layer 2

Fluorine-based Surfactant (1)

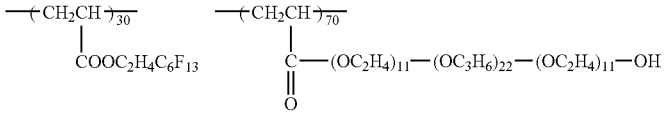

Synthesis of Microcapsule (2)

As the oil-phase component, 10 g of trimethylolpropane and xylene diisocyanate adduct (TAKENATE D-110N, manufactured by Mitsui Takeda Chemical Industries, Ltd.), 3.15 g of petaerythritol triacrylate (SR444, manufactured by NIPPON KAYAKU CO., LTD), 0.35 g of Infrared Absorbent (2) shown below, 1 g of 3-(N,N-diethtylaino)-6-methyl-7-anilinofuloran (ODB, manufactured by YAMAMOTO CHEMICAL Inc.), and 0.1 g of PIONIN A-41C (manufactured by Takemoto Yushi Co., Ltd.), were dissolved in 17 g of ethyl acetate.

As the aqueous-phase component, 40 g of 4 mass % aqueous solution of PVA-205 was prepared. The oil-phase component and the aqueous-phase component were mixed, and emulsified using a homogenizer at 12,000 rpm for 10 minutes. The obtained emulsified product was added to 25 g of distilled water, and the mixture was stirred at room temperature for 30 minutes and then further stirred at 40° C. for 3 hours. A Microcapsule Liquid (2) thus obtained was diluted with distilled water to give a solid content concentration of 20 mass %. The average particle size of the microcapsule obtained was 0.2 μm.

Infrared Absorbent (2)

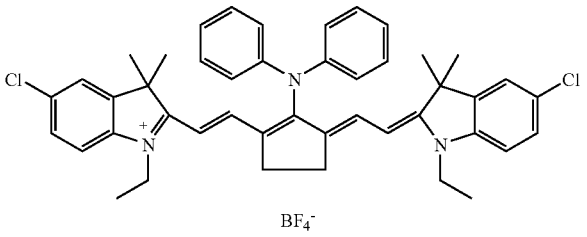

Exposure, Development Treatment, and Evaluation

Obtained Microcapsule-type Planographic Printing Plate Precursors 501 to 505, C-501, and C-502 were exposed with the use of Trend Setter 3244VFS manufactured by Creo Corp., which was equipped with water-cooling type 40W IR semiconductor laser. The exposure was performed under conditions of the energy on the precursor surface of 150 mJ/cm$^2$, and the resolution of 2400 dpi. After the exposure, without development, the exposed precursor was mounted on a cylinder of a printer SOR-M, manufactured by Heidelberg Co., and dampening water was supplied followed by ink to start printing. The dampening water used was 4% solution of IF-102 manufactured by FUJIFILM, and the ink used was VALUES Black manufactured by DAINIPPON INK AND CHEMICALS, INCORPORATED.

As a result, a non-image portion on the recording layer was removed by dampening water while printing was repeated several prints, and thus on-press development was achieved in all planographic printing plate precursors without any problem. Herein, from the start of on-press development, the number of sheet used for staining on a non-image portion of prints to be removed was referred to as 'number of sheet for on-press development', and the number of sheet was indicated in Table 5.

-Evaluation of Printing Durability-

Obtained Planographic Printing Plate Precursors 501 to 505, C-501, and C-502 were exposed with the use of Trend Setter 3244VFS manufactured by Creo Corp., under conditions of the energy on the precursor surface of 150 mJ/cm$^2$ and the resolution of 2400 dpi. Without development, printing was performed using a printer RISURON manufactured by KOMORI Corporation and a black ink DIC-GEOS (N) manufactured by DAINIPPON INK AND CHEMICALS, INCORPORATED. The number of prints given up till the point where a density of a solid image is started to get lower which is confirmed visually, was set as an index. For the evaluation results, the number of prints from the Planographic Printing Plate obtained in Example 21 was used as the standard (100), and other Planographic Printing Plates were assessed with reference to that standard for a comparative assessment of printing durability thereof The results are shown in Table 5.

-Evaluation of Staining Resistance and Staining Resistance when Left Unattended- For Planographic Printing Plate Precursors 501 to 505, C-501, and C-502, printing was performed after the exposure as in the evaluation of printing durability above, using a printer RISURON manufactured by KOMORI Corporation and a black ink DIC-GEOS (N) manufactured by DAINIPPON INK AND CHEMICALS, INCORPORATED. The staining resistance and the staining resistance when left unattended were evaluated in the same manner as in Example 1. The results are shown in Table 5 below.

TABLE 5

| | | | Hydrophilic layer | | | | Evaluation Results | | | |
|---|---|---|---|---|---|---|---|---|---|---|
| | Planographic printing plate precursor | Support | Specific hydrophilic polymer | Polymer/ TMOS mass ratio | Coating amount (g/m$^2$) | Contact angle (degree) | number of sheet for on-press development | Printing durability | Staining resistance | Staining resistance when left unattended |
| Example 21 | 501 | 15 | 1-7 | 100/0 | 0.2 | 7 | 20 | 100 | A | A |
| Example 22 | 502 | 16 | 1-7 | 25/75 | 0.2 | 7 | 20 | 100 | A | A |

TABLE 5-continued

| | Planographic printing plate precursor | Support | Hydrophilic layer: Specific hydrophilic polymer | Polymer/TMOS mass ratio | Coating amount (g/m$^2$) | Contact angle (degree) | Evaluation Results: number of sheet for on-press development | Printing durability | Staining resistance | Staining resistance when left unattended |
|---|---|---|---|---|---|---|---|---|---|---|
| Example 23 | 503 | 17 | 1-12 | 25/75 | 0.2 | 8 | 20 | 100 | A | A |
| Example 24 | 504 | 18 | 2-1 | 25/75 | 0.2 | 7 | 20 | 100 | A | A |
| Example 25 | 505 | 19 | 2-10 | 25/75 | 0.2 | 6 | 20 | 100 | A | A |
| Comparative Example 9 | C-501 | 20 | — | — | 0.2 | 8 | 25 | 70 | D | D |
| Comparative Example 10 | C-502 | 21 | — | — | — | 12 | 30 | 80 | D | D |

From the results in Table 5, it is found that all of Planographic Printing Plate Precursors of Examples 21 to 25 are excellent in on-press developability and printing durability, and also that they provide excellent prints with no stain on a non-image portion. Accordingly, it is confirmed that high hydrophilicity is exhibited in a non-image portion of planographic printing plate employing the support for planographic printing plate of the invention, thus is surely confirming that high hydrophilicity is maintained. It is also believed that since the adhesiveness between the hydrophilic layer and the image forming layer is excellent, excellent printing durability is exhibited.

Examples 26 to 28

-Thermal Positive-type Planographic Printing Plate Precursor-

Preparation of Supports for Planographic Printing Plate 22 to 24

A molten metal was prepared with the use of used beverage can (UBC) metal, and subjected to a molten treatment followed by filtration to prepare an ingot having a thickness of 500 mm and width of 1200 mm by a DC casting method. The plate was shaved from a surface thereof by an average depth of 10 mm using a shaver and then subjected to soaking treatment at 550° C. for about 5 hours. At a temperature 400C, the plate was hot-rolled using a hot-roller to give a rolled plate having a thickness of 2.7 mm. Further, a heat treatment was carried out at 500° C. using a continuous annealing machine, followed by cold-rolling to obtain Aluminum Plates AL-1 and AL-2 each having a thickness of 0.3 mm and a width of 1060 mm.

Further, Aluminum Plate AL-3 was obtained by subjecting an aluminum material of JIS A 1050 to the same treatment as above.

The compositions of aluminum plates Al-1 to Al-3 were shown in Table 6 below. Here, a unit of numerical values in Table 6 is in mass %.

TABLE 6

| Aluminum plates | Al | Si | Fe | Cu | Mn | Mg | Cr | Zn | Ti |
|---|---|---|---|---|---|---|---|---|---|
| AL-1 | 96.86 | 0.24 | 0.43 | 0.10 | 0.89 | 1.35 | 0.01 | 0.10 | 0.02 |
| AL-2 | 97.37 | 0.25 | 0.35 | 0.15 | 0.95 | 0.69 | 0.01 | 0.20 | 0.03 |
| AL-3 | 99.55 | 0.08 | 0.27 | 0.04 | 0.02 | 0.01 | 0.00 | 0.01 | 0.02 |

Surface Roughening Treatment

The obtained aluminum plates were subjected to surface treatment to prepare aluminum supports 1 to 3.

The surface treatment was carried out by performing the following treatments (a) to (e) in a continuous manner.

(a) Mechanical Surface Roughening Treatment using Brush and Abrasive

The mechanical surface roughening treatment was carried out using a suspension prepared by suspending pumiston (average particle size of 30 μm) with a specific gravity of 1.13 into water, which is served as abrasive slurry, with the use of one rotating brush at a brush-rotation speed of 250 rpm to give Ra after the surface roughening of 0.58 μm.

As a roller brush, brushes produced by implanting the hairs densely in holes formed in stainless steel rollers with a diameter of 300 nm was used, where the hair was 6-10 nylon and the hair length was 50 mm and the hair diameter was 0.295 mm.

Two supporting rollers of 200 mm in diameter were placed in lower parts of the brushes with a separation distance between stainless steel rollers of 300 mm.

The brush rollers were pushed until the load of the driving motor for rotating the brushes was increased by 7 kW or more from the load before the brush rollers being pushed against the aluminum plate. The rotation direction of the brushes was the same as the moving direction of the aluminum web W.

The mechanical surface roughening was carried out, while supplying water and pumiston to the tank for collecting slurry in order to give the constant concentration of the abrasive, by continuously determining the concentration of the abrasive from the temperature and specific gravity of the abrasive slurry. The fine pumiston pulverized in the mechanical surface roughening was removed by a separator in the particle size adjusting part so as to give an almost constant particle size distribution in the abrasive slurry. The separator used was CYCLONE.

(b) Etching Treatment in Alkaline Aqueous Solution

Etching treatment was carried out by spraying an aqueous solution having the concentration of sodium hydroxide of 370 g/L and the concentration of aluminum ion of 100 g/L to the aluminum plate at 60° C. The etched amount of a surface of the aluminum plate to be subjected to electrochemical surface roughening treatment later was 3 g/m$^2$. Thereafter, the solution was removed with a nip roller. Then the plate was washed with water with the use of a device for water-wash treatment in which a curtain-like liquid film freely falls for washing, and further washed with water for 5 seconds with the use of a spray tube constituting spray chips for fan-like spraying which are placed at 80 mm intervals. Finally, the solution was removed with a nip roller.

(c) Electrochemical Surface Roughening Treatment

The electrochemical surface roughening treatment was carried out according to the method described in JP-A No. 2005-35034, p. 35 (b) to p. 36 (h). The aluminum supports 1 and 2 prepared by subjecting the aluminum plates employing UBC aluminum material to an electrochemical surface roughening treatment gave a partial un-etched portion, and thus a uniform surface structure was not obtained.

(d) Anodic Oxidation Treatment

The anodic oxidation treatment was carried out using an anodic oxidation device shown in FIG. 4 in JP-A NO. 2005-35034. As an electrolyte, an electrolyte (temperature: 33° C.) having the concentration of aluminum ion of 5 g/L prepared by dissolving aluminum sulfate into a sulfuric acid aqueous solution of 170 g/L was used. The anodic oxidation treatment was carried out in a manner that an average current density while the aluminum plate is under an anode reaction (about 16 seconds) is 15 A/dm$^2$. The final oxidized film amount was 2.4 g/m$^2$. The aluminum plate was under an anode reaction for 16 seconds.

Thereafter, the solution was removed by a nip roller, and the plate was washed with water and then again treated with a nip roller for removal.

(e) Silicate Treatment

The aluminum plate was dipped in 2.5 mass % aqueous solution of sodium silicate (solution temperature: 20° C.) for 10 seconds. The Si amount of a surface of the aluminum plate when measured with an X-ray fluorescence spectrometer was 3.5 mg/m$^2$. Thereafter, the solution was removed by a nip roller, and the plate was washed with water and then again treated with a nip roller for removal. Further, the plate was dried with hot air at 90° C. for 10 seconds.

Formation of Hydrophilic Layer

The components shown below were uniformly mixed, and stirred at 20° C. for 2 hours for hydrolysis to take place. As the result, a sol-like Composition 7 was obtained.

Thereafter, the components shown below including the Composition 7 were mixed to obtain Coating liquid Composition 8.

| Composition 7 | |
|---|---|
| Specific Hydrophilic Polymer: Exemplary Compound (1-1) | 0.5 g |
| acetylacetone | 0.12 g |
| ethanol | 2.63 g |
| tetraethoxytitanium | 0.13 g |
| water | 0.02 g |
| tetramethoxysilane | 1.49 g |

| Coating liquid Composition 8 | |
|---|---|
| Composition 7 obtained above | 17.54 g |
| 5% aqueous solution of sodium dioctylsuccinate-2-sulfonate | 0.52 g |
| 20% aqueous dispersion of SNOWTEX C (colloidal silica) | 2.48 g |
| methanol | 7.06 g |

Thereafter, the above Coating liquid Composition 8 was applied onto the aluminum supports 1 to 3 prepared above to give a dry weight of 0.2 g/m$^2$, and dried at 120° C. for 10 minutes with heating to form a surface, thereby obtaining Supports for planographic printing PLATES 22 to 24.

The contact angle (to a water drop in air) of the surface of the hydrophilic layer on each support thus formed was measured with CA-Z manufactured by Kyowa Kaimen Kagaku Co., Ltd., which was 5°.

The positive-type image forming layer was formed on Supports for planographic Printing Plate 22 to 24 in the same manner as in Example 1 to obtain Planographic Printing Plate Precursors 601 to 603 of Examples 26 to 28.

Exposure and development treatments and further evaluations on Planographic Printing Plate Precursors 601 to 603 were carried out. As a result, excellent prints with no stain on a non-image portion were obtained. In addition, a film reduction of the image forming layer due to the development was not observed, and also excellent adhesiveness between the support and the image forming layer was obtained.

Accordingly, it was found that the same results as in the case where a high purity aluminum support is used can be obtained even in the case where a low purity aluminum support is used because of the hydrophilic layer provided according to the invention.

According to Examples 1 to 28, it is confirmed that a large number of prints with no stain on a non-image portion can be obtained by the support for planographic printing plate employable in the planographic printing plate precursor of the invention, since high hydrophilicity is provided and this hydrophilicity is maintained even in a severe printing condition.

According to the invention, a planographic printing plate precursor having excellent hydrophilicity of non-image portion and ability to maintain this hydrophilicity without being limited by the material of a support, as well as excellent adhesiveness between an image portion and a support, can be provided.

Hereinafter, exemplary embodiment of the invention will be described. However, the present invention is not limited to the exemplary embodiments described below.

[1] A planographic printing plate precursor comprising:

a support;

a hydrophilic layer comprising a hydrophilic polymer chemically bonded to a surface of the support, where the hydrophilic polymer has a positively-charged substituent and at least one reactive group selected from the group consisting of a reactive group capable of directly chemically bonding to a surface of the support and a reactive group capable of chemically bonding to a surface of the support via a crosslinked structure; and an image forming layer, wherein the hydrophilic layer and the image forming layer are provided in that order on the support.

[2] The planographic printing plate precursor according to [1], wherein the hydrophilic polymer has the reactive group on a terminal.

[3] The planographic printing plate precursor according to [1] or [2], wherein the hydrophilic polymer includes a structural unit (i) and a structural unit (ii) of the following Formula (1):

Formula (1)

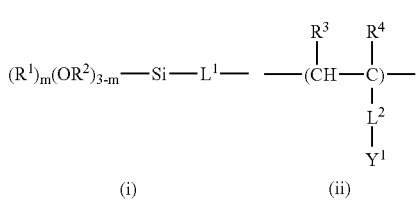

wherein Formula (1) represents a polymer having a silane coupling group represented by the structural unit (i) on an end of a polymer unit represented by the structural unit (ii); and wherein in Formula (1): $R^1$, $R^2$, $R^3$, and $R^4$ each independently represents a hydrogen atom or a substituent having 1 to 30 carbon atoms; m represents 0, 1, or 2; $L^1$ and $L^2$ each independently represents a single bond or an organic linking group; and $Y^1$ represents a positively-charged substituent.

[4] The planographic printing plate precursor according to [3], wherein $Y^1$ in Formula (1) is an ammonio group, a substituted ammonio group, a phosphonio group, or a substituted phosphonio group.

[5] The planographic printing plate precursor according to [1] or [2], wherein the hydrophilic polymer includes a structural unit (iii) and a structural unit (iv) of the following Formula (2):

Formula (2)

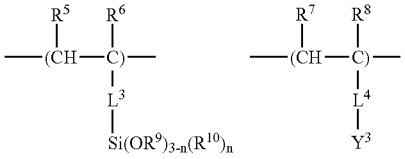

(iii) (iv)

wherein in Formula (2): $R^5$, $R^6$, $R^7$, $R^8$, $R^9$, and $R^{10}$ each independently represents a hydrogen atom or a substituent having 1 to 30 carbon atoms; n represents 0, 1, or 2; $L^3$ and $L^4$ each independently represents a single bond or an organic linking group; and $Y^3$ represents a positively-charged substituent.

[6] The planographic printing plate precursor according to [5], wherein $Y^3$ in Formula (2) is an ammonio group, a substituted ammonio group, a phosphonio group, or a substituted phosphonio group.

[7] The planographic printing plate precursor according to [1] or [2], wherein the support is an aluminum support.

[8] The planographic printing plate precursor according to [7], wherein the purity of aluminum in the aluminum support is in the range of 95 to 99.4 mass %.

[9] The planographic printing plate precursor according to [7], wherein the aluminum support comprises: 0.3 to 1 mass % of Fe; 0.15 to 1 mass % of Si; 0.1 to 1 mass % of Cu; 0.1 to 1.5 mass % of Mg; 0.1 to 1.5 mass % of Mn; 0.1 to 1.5 mass % of Zn; 0.01 to 0.1 mass % of Cr; 0.01 to 0.5 mass % of Ti; and 95 to 99.4 mass % of Al.

All publications, patent applications, and technical standards mentioned in this specification are herein incorporated by reference to the same extent as if each individual publication, patent application, or technical standard was specifically and individually indicated to be incorporated by reference.

What is claimed is:

1. A planographic printing plate precursor comprising:

a support;

a hydrophilic layer comprising a hydrophilic polymer chemically bonded to a surface of the support, where the hydrophilic polymer has a positively-charged substituent and at least one reactive group selected from the group consisting of a reactive group capable of directly chemically bonding to a surface of the support and a reactive group capable of chemically bonding to a surface of the support via a crosslinked structure; and an image forming layer, wherein the hydrophilic layer and the image forming layer are provided in that order on the support, wherein the hydrophilic polymer includes a structural unit (i) and a structural unit (ii) of the following Formula (1):

Formula (1)

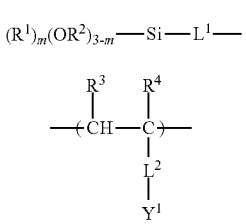

(i)

(ii)

wherein Formula (1) represents a polymer having a silane coupling group represented by the structural unit (i) on an end of a polymer unit represented by the structural unit (ii);

wherein in Formula (1): $R^1$, $R^2$, $R^3$, and $R^4$ each independently represents a hydrogen atom or a substituent having 1 to 30 carbon atoms; m represents 0, 1, or 2; $L^1$ and $L^2$ each independently represents a single bond or an organic linking group; and $Y^1$ represents an ammonio group, a substituted ammonio group, a phosphonio group, or a substituted phosphonio group; and wherein the counter anion of the positively-charged substituent is $SO_4^{2-}$, $S_2O_3^{2-}$, $SO_3^-$, a halogen ion, $ClO_4^-$, $BF_4^-$, $PF_6^-$, $SbF_6^-$, $BiCl_5^-$, $AsF_6^-$, $SbCl_6^-$, $SnCl_6^-$, $R—SO_3^-$, or $R—COO^-$, wherein R is a hydrogen atom, an alkyl group, an aryl group, or a heterocyclic group.

2. The planographic printing plate precursor according to claim 1, wherein the hydrophilic polymer has the reactive group on a terminal.

3. The planographic printing plate precursor according to claim 1, wherein the support is an aluminum support.

4. The planographic printing plate precursor according to claim 3, wherein the purity of aluminum in the aluminum support is in the range of 95 to 99.4 mass %.

5. The planographic printing plate precursor according to claim 3, wherein the aluminum support comprises: more than 0.40 to 0.50 mass % of Fe; more than 0.25 to 0.30 mass % of Si; 0.10 to 0.15 mass % of Cu; 0.80 to 1.5 mass % of Mg; 0.10 to 1.00 mass % of Mn; 0.1 to 0.3 mass % of Zn; 0.01 to 0.05 mass % of Cr; 0.02 to 0.05 mass % of Ti; and 95 to 99.4 mass % of Al.

6. The planographic printing plate precursor according to claim 1, wherein $L^2$ represents an organic linking group selected from the following structures:

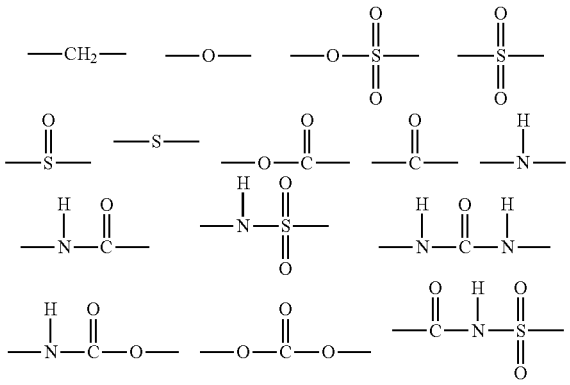

-continued
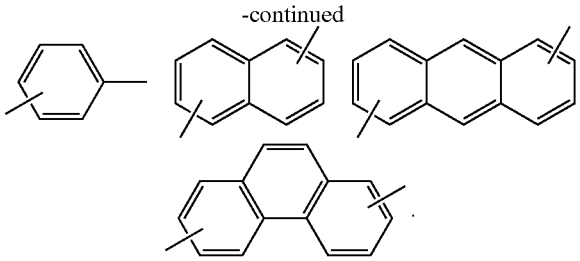
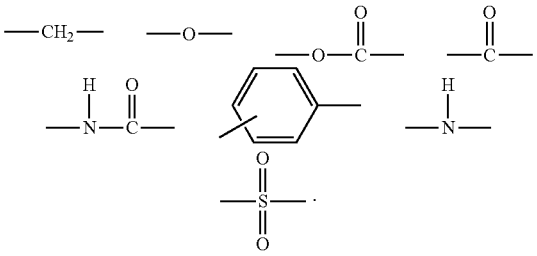
7. The planographic printing plate precursor according to claim 6, wherein $L^2$ represents an organic linking group selected from the following structures:
* * * * *